US010896650B2

(12) United States Patent
Saitoh et al.

(10) Patent No.: US 10,896,650 B2
(45) Date of Patent: Jan. 19, 2021

(54) VIDEO SIGNAL LINE DRIVE CIRCUIT, DISPLAY DEVICE INCLUDING SAME, AND DRIVE METHOD FOR VIDEO SIGNAL LINE

(71) Applicant: SHARP KABUSHIKI KAISHA, Sakai (JP)

(72) Inventors: Kohji Saitoh, Sakai (JP); Kosuke Kawamoto, Sakai (JP); Kazuhisa Yoshimoto, Sakai (JP); Kazuya Kondoh, Sakai (JP); Masaki Uehata, Sakai (JP); Yasuki Mori, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 2 days.

(21) Appl. No.: 16/305,859

(22) PCT Filed: May 25, 2017

(86) PCT No.: PCT/JP2017/019477
§ 371 (c)(1),
(2) Date: Nov. 29, 2018

(87) PCT Pub. No.: WO2017/208954
PCT Pub. Date: Dec. 7, 2017

(65) Prior Publication Data

US 2019/0164512 A1 May 30, 2019

(30) Foreign Application Priority Data

Jun. 1, 2016 (JP) ..... 2016-109822

(51) Int. Cl.
*G09G 5/00* (2006.01)
*G09G 3/36* (2006.01)
*G09G 3/20* (2006.01)

(52) U.S. Cl.
CPC ..... *G09G 3/3614* (2013.01); *G09G 3/20* (2013.01); *G09G 3/36* (2013.01); *G09G 2300/0452* (2013.01); *G09G 2330/021* (2013.01)

(58) Field of Classification Search
USPC ..... 345/209, 87, 205, 102, 76, 96, 690, 211, 345/7, 212, 204, 208, 207, 694, 92, 214;
(Continued)

(56) References Cited

U.S. PATENT DOCUMENTS 10,109,254 B2 * 10/2018 Mizusako ..... G09G 3/3614 345/209
2002/0196220 A1 * 12/2002 Sato ..... G09G 3/342 345/87
(Continued)

FOREIGN PATENT DOCUMENTS

JP 2014-052535 A 3/2014

*Primary Examiner* — Thuy N Pardo
(74) *Attorney, Agent, or Firm* — ScienBiziP, P.C.

(57) ABSTRACT

A short-circuiting circuit short-circuits source bus lines such that a sum of numbers assigned to two source bus lines forming each set in each group is equal for all sets when it is assumed that K consecutive source bus lines (K is an even number greater than or equal to 4) form one group and numbers from 1 to K are assigned to the K source bus lines. For example, with four consecutive source bus lines forming one group, in each group, the short-circuiting circuit short-circuits the first and fourth source bus lines and short-circuits the second and third source bus lines.

15 Claims, 39 Drawing Sheets

(58) Field of Classification Search
USPC ..... 348/555, 51, 790, 791
See application file for complete search history.

(56) References Cited

U.S. PATENT DOCUMENTS

2003/0085885 A1* 5/2003 Nakayoshi ..... G09G 3/3225 345/205
2006/0114204 A1* 6/2006 Sato ..... G09G 3/342 345/87
2006/0119566 A1* 6/2006 Sato ..... G09G 3/342 345/102
2006/0232539 A1* 10/2006 Hashimoto ..... G09G 3/3688 345/96
2007/0229447 A1* 10/2007 Takahara ..... G09G 3/3406 345/102
2007/0236424 A1* 10/2007 Kimura ..... G09G 3/3233 345/76
2008/0007499 A1* 1/2008 Kawabe ..... G09G 3/3266 345/82
2008/0225061 A1* 9/2008 Kimura ..... G09G 3/3233 345/690
2008/0238897 A1* 10/2008 Kimura ..... G09G 3/3666 345/204
2008/0291326 A1* 11/2008 Shishido ..... G09G 3/3611 348/555
2009/0179882 A1* 7/2009 Uchiyama ..... H04N 9/3167 345/207
2009/0284516 A1* 11/2009 Hashimoto ..... G09G 3/3688 345/211
2010/0060806 A1* 3/2010 Ina ..... G09G 3/3688 348/791
2010/0085492 A1* 4/2010 Shiomi ..... G09G 3/3648 348/790
2010/0295844 A1* 11/2010 Hayashi ..... G09G 3/3666 345/214
2011/0181562 A1* 7/2011 Higashi ..... G09G 3/3611 345/204
2011/0316989 A1* 12/2011 Imai ..... G09G 3/004 348/51
2013/0249887 A1* 9/2013 Umezaki ..... G09G 3/3208 345/212
2014/0028640 A1* 1/2014 Kimura ..... G09G 3/36 345/204
2014/0078122 A1* 3/2014 Higashi ..... G09G 3/3611 345/204
2014/0375622 A1* 12/2014 Nakagawa ..... G09G 3/3674 345/212
2015/0042542 A1* 2/2015 Fujikawa ..... G02B 27/0101 345/7
2015/0138261 A1* 5/2015 Nakayama ..... G09G 3/3685 345/694
2015/0145842 A1* 5/2015 Maeda ..... G09G 3/2092 345/208
2015/0262528 A1* 9/2015 Takahara ..... G09G 3/3225 345/212
2016/0284307 A1* 9/2016 Nakagawa ..... G09G 3/3233 345/209

* cited by examiner

| S1 | S2 | S3 | S4 | S5 | S6 | S7 | S8 | S9 | S10 | S11 | S12 |
|---|---|---|---|---|---|---|---|---|---|---|---|
| R | G | B | R | G | B | R | G | B | R | G | B |
| + | − | + | − | + | − | + | − | + | − | + | − |
| + | − | + | − | + | − | + | − | + | − | + | − |
| + | − | + | − | + | − | + | − | + | − | + | − |
| + | − | + | − | + | − | + | − | + | − | + | − |

(RELATED ART)

(RELATED ART)

(RELATED ART)

(RELATED ART)

(RELATED ART)

(RELATED ART)

(RELATED ART)

(RELATED ART)

(RELATED ART)

PRIOR ART

PRIOR ART

PRIOR ART

PRIOR ART

PRIOR ART

PRIOR ART

PRIOR ART

PRIOR ART

PRIOR ART

Fig.51

| S1 | S2 | S3 | S4 | S5 | S6 | S7 | S8 | S9 | S10 | S11 | S12 |
|---|---|---|---|---|---|---|---|---|---|---|---|
| R | G | B | R | G | B | R | G | B | R | G | B |
| + | − | + | − | + | − | + | − | + | − | + | − |
| + | − | + | − | + | − | + | − | + | − | + | − |
| + | − | + | − | + | − | + | − | + | − | + | − |
| + | − | + | − | + | − | + | − | + | − | + | − |

PRIOR ART

VIDEO SIGNAL LINE DRIVE CIRCUIT, DISPLAY DEVICE INCLUDING SAME, AND DRIVE METHOD FOR VIDEO SIGNAL LINE

TECHNICAL FIELD

The present invention relates to a video signal line drive circuit that drives video signal lines disposed in a display unit of a display device, and a display device including the video signal line drive circuit, and more particularly to a video signal line drive circuit that performs charge sharing in which charge is shared between two video signal lines by short-circuiting the two video signal lines.

BACKGROUND ART

Conventionally, there is known an active matrix-type liquid crystal display device including TFTs (thin film transistors) as switching elements. The liquid crystal display device includes a liquid crystal panel composed of two insulating glass substrates facing each other. One of the glass substrates composing the liquid crystal panel has gate bus lines (scanning signal lines) and source bus lines (video signal lines) disposed thereon, and TFTs are provided near intersection portions of the gate bus lines and the source bus lines. Each TFT is connected at its gate electrode to a gate bus line, connected at its source electrode to a source bus line, and connected at its drain electrode to a pixel electrode. The other glass substrate composing the liquid crystal panel is provided with a common electrode for applying a voltage between the pixel electrodes and the common electrode through a liquid crystal layer. In such a configuration, a voltage is applied between the pixel electrode and the common electrode (liquid crystal layer), based on a video signal that is received by a source electrode of a corresponding TFT from a source bus line when a gate electrode of the corresponding TFT receives an active scanning signal from a gate bus line. By this, liquid crystal is driven, and a desired image is displayed on a display unit of the liquid crystal panel.

Meanwhile, the liquid crystal has a property that it deteriorates by continuous application of a direct-current voltage. Hence, to suppress the deterioration of the liquid crystal, the liquid crystal display device performs alternating-current driving in which the polarity of a liquid crystal application voltage (a voltage between the pixel electrode and the common electrode) is reversed on a frame-by-frame basis. Note, however, that when all pixels have the same polarity (the polarity of a liquid crystal application voltage) in each frame, flicker is likely to occur upon displaying an image. Hence, to suppress the occurrence of flicker, there are conventionally adopted various polarity reversal systems for reversing the polarity not only on a frame-by-frame basis but also spatially. Those various polarity reversal systems will be described below.

FIG. 42 is a diagram showing the arrangement of pixels and polarity changes at each pixel in a liquid crystal display device adopting a system called a "dot-reversal system". In this system, spatially, the polarity is reversed every gate bus line and every source bus line. FIG. 43 is a diagram showing the arrangement of pixels and polarity changes at each pixel in a liquid crystal display device adopting a system called a "two-dot-reversal system". In this system, spatially, the polarity is reversed every two gate bus lines and every source bus line. FIG. 44 is a diagram showing the arrangement of pixels and polarity changes at each pixel in a liquid crystal display device adopting a system called a "source-reversal system". In this system, spatially, the polarity is reversed every source bus line. Note that in all systems, each pixel has different polarities for an even frame and an odd frame.

Here, a trial calculation is done of power required to charge and discharge source bus lines when each of the dot-reversal system, the two-dot-reversal system, and the source-reversal system is adopted. Note that trial calculation conditions are as follows: the resolution is WXGA (1280×800); the arrangement of the pixels is of an RGB vertical stripe type such as those shown in FIGS. 42 to 44; the wiring line capacitance of a single source bus line is 100 pF; as shown in FIG. 45, a direct-current voltage (0 V) is applied to the common electrode, a positive-polarity source application voltage is +5 V, and a negative-polarity source application voltage is −5 V; the length of a vertical flyback period is the length of 10 horizontal scanning periods; and the refresh rate is 60 Hz or 120 Hz.

In general, power P required to charge and discharge a single source bus line is found by the following equation:

$$P=cfV^2$$

In the above equation, c represents the wiring line capacitance of the source bus line, f represents the frequency (reversal frequency) at which polarity reversal is performed, and V represents the voltage applied to the source bus line.

In addition, power P(all) required to charge and discharge all source bus lines on the above-described trial calculation conditions is found by the following equation:

$$P(\text{all})=cfV^2\times1280\times3$$

In addition, it is assumed that the power P(all) is power for a white display screen in a normally black panel, and the voltage applied to the liquid crystal for the white display screen is 5 V. In this case, the amplitude of a voltage applied to the source bus lines is 10 V.

Taking into account the above respects, for each system, a trial calculation is done of power P(all) for when the refresh rate is 60 Hz and for when the refresh rate is 120 Hz.

<In a Case in which the Polarity Reversal System is the Dot-Reversal System and the Refresh Rate is 60 Hz>

The values of requirements for a trial calculation are found as follows:

one vertical scanning period=1 sec/60 Hz=about 16.7 ms;

one horizontal scanning period=16.7 ms/(800+10)=about 20.58 μs;

reversal cycle=20.58 μs×2=41.15 μs; and reversal frequency=1 sec/41.15 μs=24.3 kHz.

By the above, power P(all) required to charge and discharge all source bus lines in a case in which the polarity reversal system is the dot-reversal system and the refresh rate is 60 Hz is as follows:

$$P(\text{all}) = 100\ \text{pF}\times24.3\ \text{kHz}\times10\ \text{V}^2\times1280\times3$$
$$= \text{about } 933\ \text{mW}$$

<In a Case in which the Polarity Reversal System is the Dot-Reversal System and the Refresh Rate is 120 Hz>

The values of requirements for a trial calculation are found as follows:

one vertical scanning period=1 sec/120 Hz=about 8.8 ms;

one horizontal scanning period=8.8 ms/(800+10)=about 10.29 μs;

reversal cycle=10.29 μs×2=20.58 μs; and reversal frequency=1 sec/20.58 μs=48.6 kHz.

By the above, power P(all) required to charge and discharge all source bus lines in a case in which the polarity reversal system is the dot-reversal system and the refresh rate is 120 Hz is as follows:

$$P(\text{all}) = 100\ \text{pF} \times 48.6\ \text{kHz} \times 10\ \text{V}^2 \times 1280 \times 3$$
$$= \text{about } 1866\ \text{mW}$$

<In a Case in which the Polarity Reversal System is the Two-Dot-Reversal System and the Refresh Rate is 60 Hz>

The values of requirements for a trial calculation are found as follows:

one vertical scanning period=1 sec/60 Hz=about 16.7 ms;

one horizontal scanning period=16.7 ms/(800+10)=about 20.58 μs;

reversal cycle=20.58 μs×4=82.3 μs; and reversal frequency=1 sec/82.3 μs=12.15 kHz.

By the above, power P(all) required to charge and discharge all source bus lines in a case in which the polarity reversal system is the two-dot-reversal system and the refresh rate is 60 Hz is as follows:

$$P(\text{all}) = 100\ \text{pF} \times 12.15\ \text{kHz} \times 10\ \text{V}^2 \times 1280 \times 3$$
$$= \text{about } 467\ \text{mW}$$

<In a Case in which the Polarity Reversal System is the Two-Dot-Reversal System and the Refresh Rate is 120 Hz>

The values of requirements for a trial calculation are found as follows:

one vertical scanning period=1 sec/120 Hz=about 8.8 ms;

one horizontal scanning period=8.8 ms/(800+10)=about 10.29 μs;

reversal cycle=10.29 μs×4=41.16 μs; and reversal frequency=1 sec/41.16 μs=24.3 kHz.

By the above, power P(all) required to charge and discharge all source bus lines in a case in which the polarity reversal system is the two-dot-reversal system and the refresh rate is 120 Hz is as follows:

$$P(\text{all}) = 100\ \text{pF} \times 24.3\ \text{kHz} \times 10\ \text{V}^2 \times 1280 \times 3$$
$$= \text{about } 933\ \text{mW}$$

<In a Case in which the Polarity Reversal System is the Source-Reversal System and the Refresh Rate is 60 Hz>

The values of requirements for a trial calculation are found as follows:

one vertical scanning period=1 sec/60 Hz=about 16.7 ms;

one horizontal scanning period=16.7 ms/(800+10)=about 20.58 μs;

reversal cycle=20.58 μs×1620=33.33 ms; and reversal frequency=1 sec/33.33 ms=30 Hz.

By the above, power P(all) required to charge and discharge all source bus lines in a case in which the polarity reversal system is the source-reversal system and the refresh rate is 60 Hz is as follows:

$$P(\text{all}) = 100\ \text{pF} \times 30\ \text{Hz} \times 10\ \text{V}^2 \times 1280 \times 3$$
$$= \text{about } 1.2\ \text{mW}$$

<In a Case in which the Polarity Reversal System is the Source-Reversal System and the Refresh Rate is 120 Hz>

The values of requirements for a trial calculation are found as follows:

one vertical scanning period=1 sec/120 Hz=about 8.8 ms;

one horizontal scanning period=8.8 ms/(800+10)=about 10.29 μs;

reversal cycle=10.29 μs×1620=16.67 ms; and reversal frequency=1 sec/16.67 ms=60 Hz.

By the above, power P(all) required to charge and discharge all source bus lines in a case in which the polarity reversal system is the source-reversal system and the refresh rate is 120 Hz is as follows:

$$P(\text{all}) = 100\ \text{pF} \times 60\ \text{Hz} \times 10\ V^2 \times 1280 \times 3$$
$$= \text{about } 2.3\ \text{mW}$$

By the above, it can be grasped that the source-reversal system should be adopted to reduce power consumption. However, when the source-reversal system is adopted, the same-polarity voltage is applied to each source bus line throughout one frame period. Hence, an effect of suppressing the occurrence of flicker is small for a vertical direction (a direction in which the source bus lines extend). Hence, there is also proposed a polarity reversal system in which the occurrence of flicker is suppressed by devising a connection relationship between the source bus lines and the pixels while power consumption is reduced by driving a source driver in the same manner as the source-reversal system, which will be described below.

FIG. 46 is a diagram showing the arrangement of pixels and polarity changes at each pixel in a liquid crystal display device adopting a system called a "Z-reversal system". In this system, for example, pixels in odd rows are connected to source bus lines disposed on the left side in FIG. 46, and pixels in even rows are connected to source bus lines disposed on the right side in FIG. 46. In such a configuration, in each frame, a voltage of a reversed polarity is applied every source bus line. By this, spatially, the same polarity reversal as that of the dot-reversal system (see FIG. 42) is performed.

FIG. 47 is a diagram showing the arrangement of pixels and polarity changes at each pixel in a liquid crystal display device adopting a system called a "2H-Z-reversal system". In this system, with four rows forming one set, for example, pixels in the first and second rows are connected to source bus lines disposed on the left side in FIG. 47, and pixels in the third and fourth rows are connected to source bus lines disposed on the right side in FIG. 47. In such a configuration, in each frame, a voltage of a reversed polarity is applied every source bus line. By this, spatially, the same polarity reversal as that of the two-dot-reversal system (see FIG. 43) is performed.

Note that a system may be adopted in which, as shown in FIG. 48, the system called a "2H-Z-reversal system" and a system called a "2S-reversal system" (a system for reversing the polarity every two source bus lines) are combined. Note, however, that the names of the reversal systems described above are not generally uniquely determined.

By adopting polarity reversal systems such as those described above, the occurrence of flicker is suppressed while power consumption is reduced.

Meanwhile, as a technique for reducing power consumption, there is known a technique called "charge sharing" in which before applying a charging voltage to each source bus line from the source driver, charge is shared between two adjacent source bus lines by short-circuiting the two source bus lines. When charge sharing is performed, the voltages of two source bus lines transition to an intermediate voltage between the voltage of one source bus line and the voltage of the other source bus line without receiving supply of charge from the source driver. Therefore, power required to charge the source bus lines is reduced.

Note that a technique related to charge sharing is disclosed in, for example, Japanese Laid-Open Patent Publication No. 2014-052535. According to a liquid crystal display device disclosed in Japanese Laid-Open Patent Publication No. 2014-052535, a charge sharing system can be selected according to a polarity reversal system to be adopted, and selection of a charge share system can be performed using a small number of external control signals.

PRIOR ART DOCUMENT

Patent Document

[Patent Document 1] Japanese Laid-Open Patent Publication No. 2014-052535

SUMMARY OF THE INVENTION

Problems to be Solved by the Invention

As described above, as a technique for reducing power consumption, there is conventionally known a technique called "charge sharing". However, according to the conventional charge sharing system, an effect of reduction in power consumption cannot be sufficiently obtained depending on a display image, which will be described below.

FIG. 49 is a schematic diagram for describing combinations of source bus lines that perform charge sharing in a conventional example. Note that FIG. 49 only shows a portion corresponding to 12 source bus lines S1 to S12. Note also that FIG. 49 shows which one of R (red), G (green), and B (blue) pixels is connected to each source bus line, and shows the polarities of pixels (the polarities of a liquid crystal application voltage) up to the fourth rows in a given frame (e.g., an even frame). These respects are also the same for FIG. 1. In this conventional example, as shown in a portion indicated by reference character 9 in FIG. 49, with two adjacent source bus lines forming one set, charge sharing is performed between one source bus line and the other source bus line.

Now, changes in source voltage before and after switching frames for when all-red display is performed will be described. Note that it is assumed that the voltage of the common electrode is 5.0 V, the maximum value of the source application voltage is 9.5 V, and the minimum value of the source application voltage is 0.5 V. In addition, it is assumed that in an even frame, a positive-polarity voltage is applied to odd-column source bus lines, and a negative-polarity voltage is applied to even-column source bus lines. When all-red display is performed, the source voltages change as shown in FIG. 50.

In the even frame, the source voltages of the source bus lines S1 and S7 are 9.5 V, the source voltages of the source bus lines S3, S5, S9, and S11 are 5.5 V, the source voltages of the source bus lines S2, S6, S8, and S12 are 4.5 V, and the source voltages of the source bus lines S4 and S10 are 0.5 V.

When a charge sharing period has come, charge sharing is performed between two adjacent source bus lines (charge sharing is performed using the combinations shown in FIG. 49). When attention is focused on the source bus lines S5, S6, S11, and S12, charge sharing is performed between a source bus line with a source voltage of 5.5 V and a source bus line with a source voltage of 4.5 V. Therefore, the source voltages of the source bus lines S5, S6, S11, and S12 approach 0.5 V. In addition, when attention is focused on the source bus lines S1, S2, S7, and S8, charge sharing is performed between a source bus line with a source voltage of 9.5 V and a source bus line with a source voltage of 4.5 V. Therefore, the source voltages of the source bus lines S1, S2, S7, and S8 approach 7.0 V. Furthermore, when attention is focused on the source bus lines S3, S4, S9, and S10, charge sharing is performed between a source bus line with a source voltage of 5.5 V and a source bus line with a source voltage of 0.5 V. Therefore, the source voltages of the source bus lines S3, S4, S9, and S10 approach 3.0 V.

After the charge sharing period ends, a voltage of an opposite polarity to that for the even frame is applied to each source bus line. By this, in an odd frame, the source voltages of the source bus lines S1 and S7 become 0.5 V, the source voltages of the source bus lines S3, S5, S9, and S11 become 4.5 V, the source voltages of the source bus lines S2, S6, S8, and S12 become 5.5 V, and the source voltages of the source bus lines S4 and S10 become 9.5 V.

Here, when attention is focused on the source voltages of the source bus lines S3 and S9, upon transitioning from the even frame to the odd frame, the source voltages should change from 5.5 V to 4.5 V. However, during the charge sharing period, the source voltages are reduced to 3.0 V from 5.5 V by charge sharing. Hence, after the charge sharing period ends, there is a need to increase the source voltages from 3.0 V to 4.5 V by supplying charge to the source bus lines from the source driver. That is, while the source voltages only need to be changed by 1.0 V when charge sharing is not performed, the source voltages need to be changed as much as 1.5 V when charge sharing is performed. The same can also be applied for the source bus lines S2 and S8. As such, in the above-described example, upon performing all-red display, power loss occurs in one-third of all source bus lines. As a result, an effect of reduction in power consumption cannot be sufficiently obtained. As described above, in the conventional charge sharing system, an effect of reduction in power consumption cannot be sufficiently obtained depending on a display image.

Note that a configuration is also considered in which charge sharing is performed between source bus lines for the same color as shown in FIG. 51. However, according to such a configuration, since the number of intersection points of wiring lines for short-circuiting source bus lines (hereinafter, referred to as "short-circuiting wiring lines") and source bus lines increases, a large number of parasitic capacitances are likely to occur. Due to this, a voltage change occurring when charge sharing is performed becomes gentle, and an effect of reduction in power consumption by charge sharing cannot be sufficiently obtained. In addition, since a circuit needs to be formed in units of six source bus lines, the circuit size increases, which is not desirable in terms of the cost and the area of the source driver.

In view of the above respects, an object of the present invention is to provide a source driver (video signal line drive circuit) using a charge sharing system that achieves lower power consumption than the conventional case.

Means for Solving the Problems

A first aspect of the present invention is directed to a video signal line drive circuit that drives a plurality of video signal lines, the video signal line drive circuit including:

a charging voltage output unit configured to apply charging voltages including a positive-polarity voltage and a negative-polarity voltage, to the plurality of video signal lines in each frame; and a short-circuiting circuit configured to short-circuit, with two video signal lines forming one set, two video signal lines forming each set upon switching frames, charging voltages of different polarities being applied to the two video signal lines in each frame, wherein the short-circuiting circuit short-circuits the video signal lines such that a sum of numbers assigned to two video signal lines forming each set in each group is equal for all sets when it is assumed that K video signal lines (K is an even number greater than or equal to 4) form one group and numbers from 1 to K are assigned to the K video signal lines.

According to a second aspect of the present invention, in the first aspect of the present invention, the K video signal lines are K consecutive video signal lines.

According to a third aspect of the present invention, in the second aspect of the present invention, the charging voltage output unit applies a charging voltage of a reversed polarity every video signal line.

According to a fourth aspect of the present invention, in the first aspect of the present invention, the K video signal lines are K alternate video signal lines.

According to a fifth aspect of the present invention, in the fourth aspect of the present invention, the charging voltage output unit applies charging voltages of reversed polarities every two video signal lines.

According to a sixth aspect of the present invention, in the first aspect of the present invention, the K video signal lines are four video signal lines.

According to a seventh aspect of the present invention, in the sixth aspect of the present invention, when attention is focused on eight consecutive video signal lines, odd-numbered video signal lines form one group, and even-numbered video signal lines form another group.

According to an eighth aspect of the present invention, in the first aspect of the present invention, the short-circuiting circuit sets longer time during which two video signal lines are short-circuited, for a larger difference between numbers assigned to two video signal lines forming each set.

According to a ninth aspect of the present invention, in the first aspect of the present invention, a capacitance is provided on at least a wiring line for short-circuiting two video signal lines that form a set having a smallest difference between numbers assigned to two video signal lines in each group.

A tenth aspect of the present invention is directed to a display device including:

a video signal line drive circuit according to a first aspect of the present invention; and a display unit including a plurality of video signal lines; a plurality of scanning signal lines intersecting the plurality of video signal lines; and a plurality of pixel formation portions arranged in a matrix form at respective intersections of the plurality of video signal lines and the plurality of scanning signal lines.

According to an eleventh aspect of the present invention, in the tenth aspect of the present invention, the plurality of pixel formation portions include a red pixel formation portion that forms a pixel for displaying red; a green pixel formation portion that forms a pixel for displaying green; and a blue pixel formation portion that forms a pixel for displaying blue, and the red pixel formation portion, the green pixel formation portion, and the blue pixel formation portion are arranged side by side in a direction in which the plurality of scanning signal lines extend.

According to a twelfth aspect of the present invention, in the eleventh aspect of the present invention, K video signal lines are four consecutive video signal lines, and the charging voltage output unit applies a charging voltage of a reversed polarity every video signal line.

According to a thirteenth aspect of the present invention, in the eleventh aspect of the present invention, K video signal lines are four alternate video signal lines, when attention is focused on eight consecutive video signal lines, odd-numbered video signal lines form one group, and even-numbered video signal lines form another group, and the charging voltage output unit applies charging voltages of reversed polarities every two video signal lines.

According to a fourteenth aspect of the present invention, in the tenth aspect of the present invention, when attention is focused on any video signal line among the plurality of video signal lines, pixel formation portions that receive supply of a video signal from the focused video signal line are arranged in a staggered manner every scanning signal line or every two scanning signal lines.

A fifteenth aspect of the present invention is directed to a method for driving a plurality of video signal lines, the method including:

a charging voltage outputting step of applying charging voltages including a positive-polarity voltage and a negative-polarity voltage, to the plurality of video signal lines in each frame; and a short-circuiting step of short-circuiting, with two video signal lines forming one set, two video signal lines forming each set upon switching frames, charging voltages of different polarities being applied to the two video signal lines in each frame, wherein in the short-circuiting step, the video signal lines are short-circuited such that a sum of numbers assigned to two video signal lines forming each set in each group is equal for all sets when it is assumed that K video signal lines (K is an even number greater than or equal to 4) form one group and numbers from 1 to K are assigned to the K video signal lines.

Effects of the Invention

According to the first aspect of the present invention, two video signal lines for the same color to which voltages of different polarities are applied in each frame can be short-circuited. Hence, when, for example, single primary color display is performed, the overall amount of transition of video signal voltages by charge sharing increases over the conventional case. As such, even when an image that has not been able to sufficiently obtain an effect of reduction in power consumption by charge sharing in the conventional case is displayed, the effect of reduction in power consumption can be sufficiently obtained. By the above, a video signal line drive circuit using a charge sharing system that can achieve lower power consumption than the conventional case is implemented.

According to the second aspect of the present invention, a video signal line drive circuit is implemented in which a plurality of consecutive video signal lines form one group, and which provides the same effect as that of the first aspect of the present invention.

According to the third aspect of the present invention, since a so-called "source-reversal system" is adopted as a polarity reversal system, power consumption can be remarkably reduced compared with the case of adopting a so-called "dot-reversal system" as a polarity reversal system.

According to the fourth aspect of the present invention, a video signal line drive circuit is implemented in which a plurality of alternate video signal lines form one group, and which provides the same effect as that of the first aspect of the present invention.

According to the fifth aspect of the present invention, since a so-called "2S-reversal system" is adopted as a polarity reversal system, power consumption can be remarkably reduced compared with the case of adopting a so-called "dot-reversal system" as a polarity reversal system.

According to the sixth aspect of the present invention, without making a circuit configuration complex, a video signal line drive circuit that provides the effect of the first aspect of the present invention is implemented.

According to the seventh aspect of the present invention, the same effect as that of the sixth aspect of the present invention is obtained.

According to the eighth aspect of the present invention, even if parasitic capacitances occur at intersection portions of video signal lines and a short-circuiting wiring line, the occurrence of a difference in reaching rate for a potential assumed to be reached at the end time of charge sharing is suppressed.

According to the ninth aspect of the present invention, the same effect as that of the eighth aspect of the present invention is obtained.

According to the tenth aspect of the present invention, a display device that can achieve lower power consumption than the conventional case is implemented.

According to the eleventh aspect of the present invention, a display device configured to include three-color subpixels can achieve lower power consumption than the conventional case.

According to the twelfth aspect of the present invention, a display device that can more reliably reduce power consumption than the conventional case is implemented.

According to the thirteenth aspect of the present invention, a display device that can more reliably reduce power consumption than the conventional case is implemented.

According to the fourteenth aspect of the present invention, spatial polarity reversal is performed every line or every two lines in a vertical direction (a direction in which the video signal lines extend). Hence, not only a reduction in power consumption over the conventional case, but also suppression of the occurrence of flicker is possible.

According to the fifteenth aspect of the present invention, the same effect as that of the first aspect of the present invention can be provided by a video signal line drive method.

BRIEF DESCRIPTION OF THE DRAWINGS

FIG. 51 is a diagram for describing a configuration in which charge sharing is performed between source bus lines for the same color in a conventional configuration.

MODES FOR CARRYING OUT THE INVENTION

Embodiments of the present invention will be described below with reference to the accompanying drawings. Note that, in the following embodiments, it is assumed that normally black mode is adopted as the display mode of a liquid crystal display device. Note also that it is assumed that one pixel is composed of three subpixels (a red subpixel, a green subpixel, and a blue subpixel) arranged side by side in a direction in which gate bus lines extend.

1. First Embodiment

1.1 Overall Configuration and Overview of Operation

Figure 2:
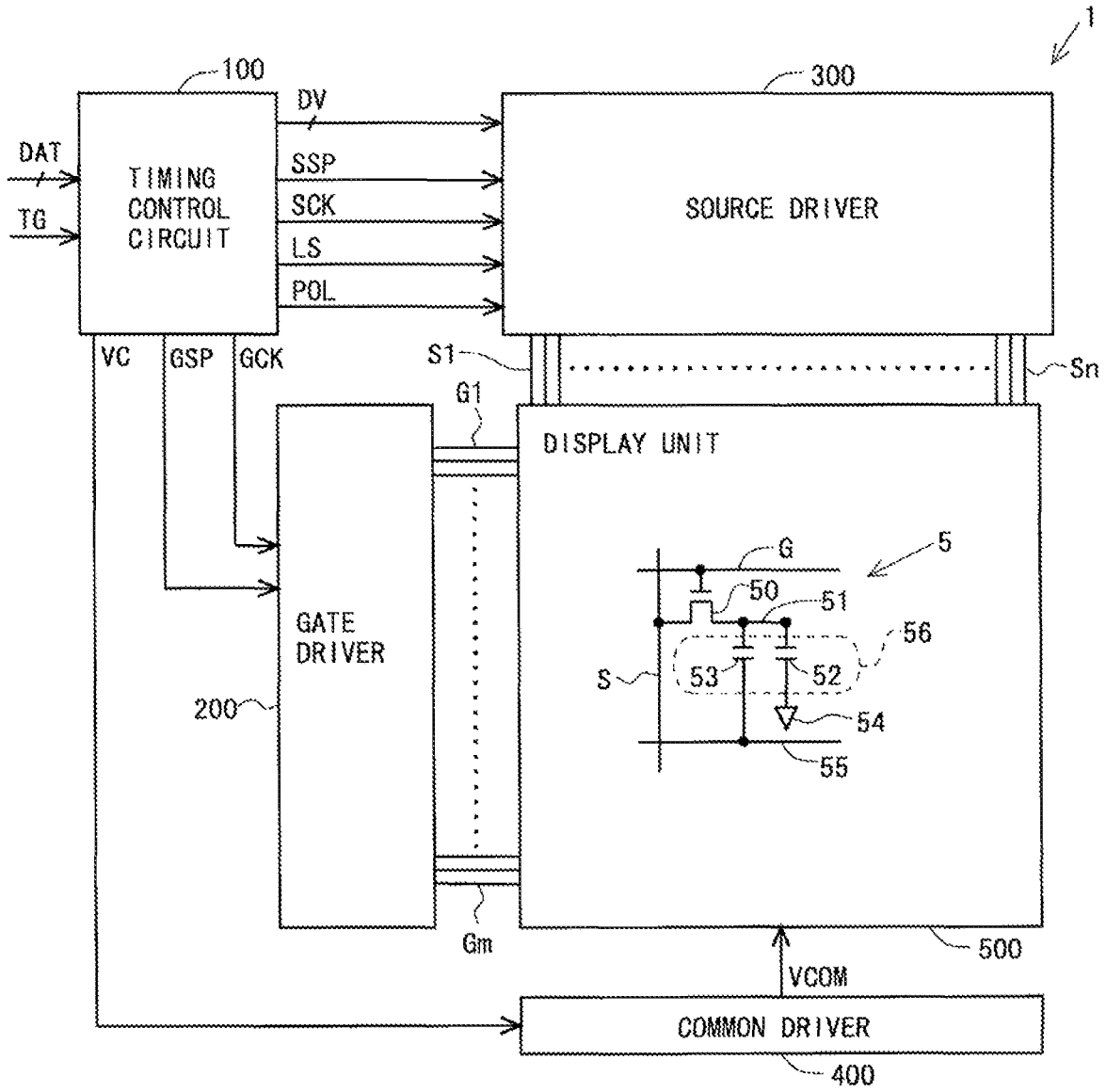
FIG. 2 is a block diagram showing an overall configuration of the liquid crystal display device according to the first embodiment.
Figure 44:
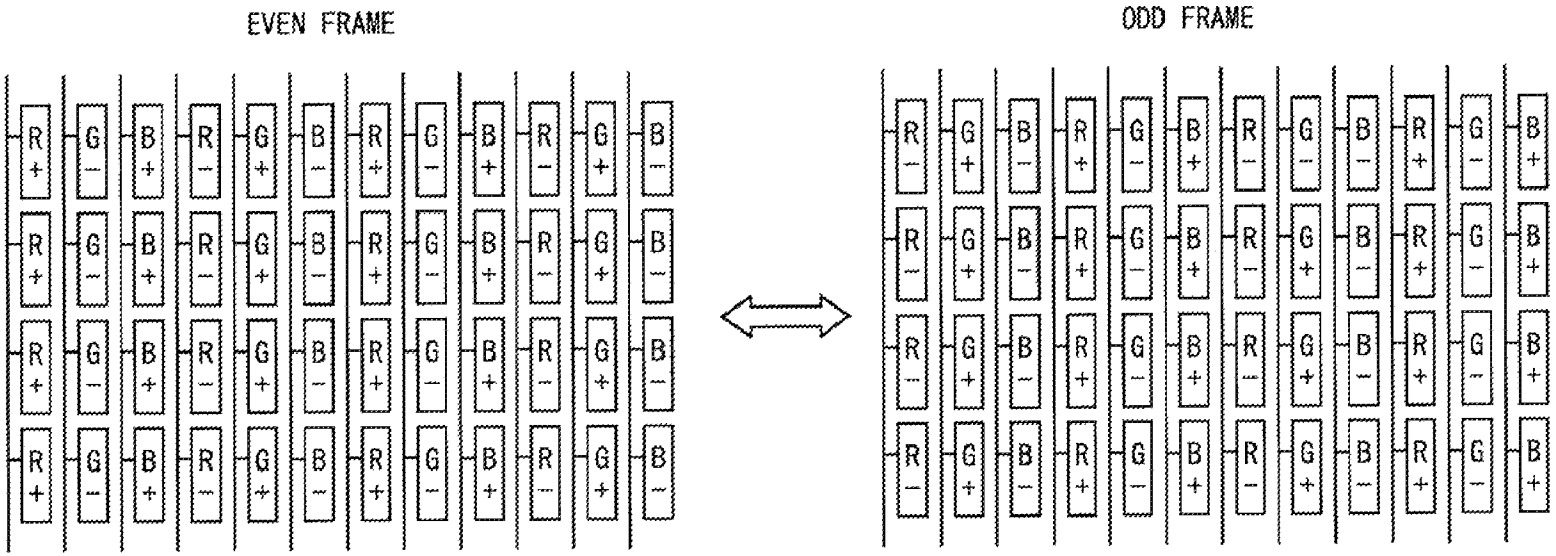
FIG. 44 is a diagram showing the arrangement of pixels and polarity changes at each pixel in a liquid crystal display device adopting a system called a "source-reversal system".
Figure 45:
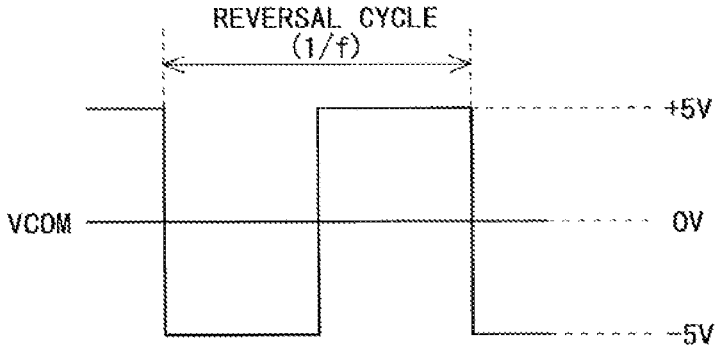
FIG. 45 is a diagram for describing trial calculation conditions used when a trial calculation of power required to charge and discharge source bus lines is done.

FIG. 2 is a block diagram showing an overall configuration of an active matrix-type liquid crystal display device 1 according to a first embodiment of the present invention. As shown in FIG. 2, the liquid crystal display device 1 includes a timing control circuit 100, a gate driver (scanning signal line drive circuit) 200, a source driver (video signal line drive circuit) 300, a common driver (common electrode drive circuit) 400, and a display unit 500. Note that it is assumed that the liquid crystal display device 1 according to the present embodiment adopts the source-reversal system (see FIG. 44) as a polarity reversal system.

In the display unit 500 there are disposed a plurality of (m) gate bus lines (scanning signal lines) G1 to Gm and a plurality of (n) source bus lines (video signal lines) S1 to Sn. Pixel formation portions 5 that form pixels are provided at the respective intersections of the gate bus lines G1 to Gm and the source bus lines S1 to Sn. That is, the display unit 500 includes a plurality of (m×n) pixel formation portions 5. The plurality of pixel formation portions 5 are arranged in a matrix form and thereby form a pixel matrix of m rows×n columns. Each pixel formation portion 5 includes a TFT 50 which is a switching element connected at its gate terminal to a gate bus line G passing through a corresponding intersection, and connected at its source terminal to a source bus line S passing through the intersection; a pixel electrode 51 connected to a drain terminal of the TFT 50; a common electrode 54 and an auxiliary capacitance electrode 55 which are provided so as to be shared by the plurality of pixel formation portions 5; a liquid crystal capacitance 52 formed by the pixel electrode 51 and the common electrode 54; and an auxiliary capacitance 53 formed by the pixel electrode 51 and the auxiliary capacitance electrode 55. By the liquid crystal capacitance 52 and the auxiliary capacitance 53, a pixel capacitance 56 is formed. Note that in the display unit 500 of FIG. 2, only those components provided for one pixel formation portion 5 are shown. Note also that the configuration of the pixel formation portion 5 is not limited to that shown in FIG. 2, and for example, a configuration in which the auxiliary capacitance 53 and the auxiliary capacitance electrode 55 are not provided can also be adopted.

The timing control circuit 100 receives an image signal DAT and a timing signal group TG such as a horizontal synchronizing signal and a vertical synchronizing signal, which are transmitted from an external source, and outputs digital video signals DV, and a source start pulse signal SSP, a source clock signal SCK, a latch strobe signal LS, a polarity control signal POL, a gate start pulse signal GSP, a gate clock signal GCK, and a common electrode control signal VC which are for controlling image display in the display unit 500.

The gate driver 200 repeats application of an active scanning signal to each of the gate bus lines G1 to Gm, based on the gate start pulse signal GSP and the gate clock signal GCK which are outputted from the timing control circuit 100, with one vertical scanning period as a cycle.

The source driver 300 applies a driving video signal to each of the source bus lines S1 to Sn to charge the pixel capacitance 56 of each pixel formation portion 5 in the display unit 500, based on the digital video signals DV, the source start pulse signal SSP, the source clock signal SCK, the latch strobe signal LS, and the polarity control signal POL which are outputted from the timing control circuit 100. Note that the detailed configuration and operation of the source driver 300 will be described later.

The common driver 400 applies a predetermined voltage VCOM to the common electrode 54 based on the common electrode control signal VC outputted from the timing control circuit 100.

By applying the scanning signals to the respective gate bus lines G1 to Gm, applying the driving video signals to the respective source bus lines S1 to Sn, and applying the predetermined voltage VCOM to the common electrode 54 in the above-described manner, an image based on the image signal DAT transmitted from the external source is displayed on the display unit 500. Note that a system for data transmission between the timing control circuit 100 and each driver is not particularly limited.

Meanwhile, for the TFTs 50 in the display unit 500, for example, an oxide TFT (a thin film transistor having an oxide semiconductor layer) can be adopted. The oxide semiconductor layer is formed of, for example, an oxide semiconductor film containing an In—Ga—Zn—O-based semiconductor (e.g., an indium gallium zinc oxide) which is a ternary oxide of In (indium), Ga (gallium), and Zn (zinc). When an oxide TFT is adopted for the TFTs 50, since so-called "pause driving" can be performed, it becomes possible to remarkably reduce power consumption over the conventional case. Note that the present invention does not exclude the use of other TFTs than oxide TFTs.

1.2 Configuration and Operation of the Source Driver

1.2.1 Outline

Figure 3:
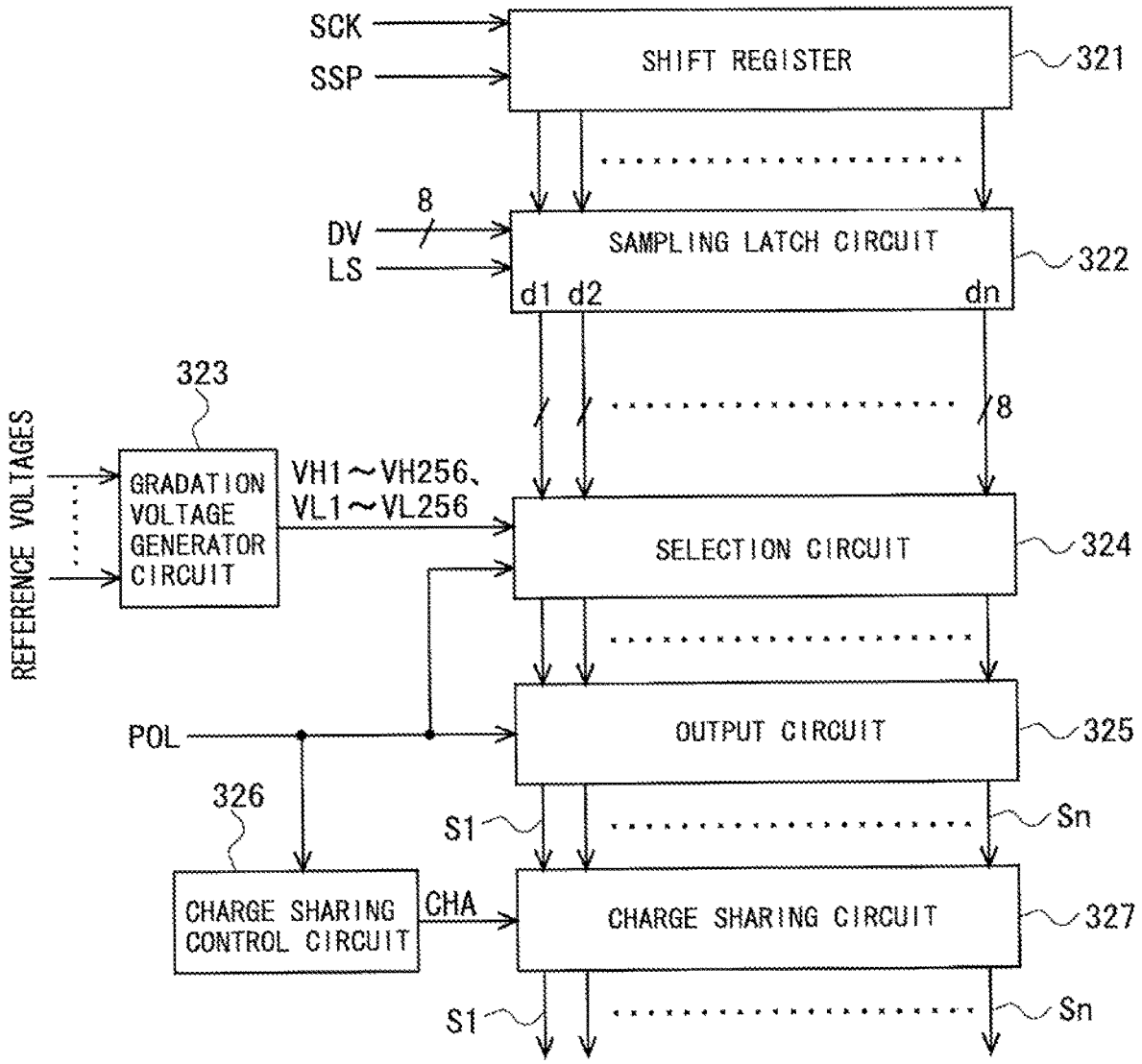
FIG. 3 is a block diagram showing an exemplary configuration of a source driver in the first embodiment.

FIG. 3 is a block diagram showing an exemplary configuration of the source driver 300 of the present embodiment. Note that here it is assumed that 256-level gradation representation is possible. The source driver 300 includes an n-stage shift register 321; a sampling latch circuit 322 that outputs 8-bit internal image signals d1 to dn for the respective source bus lines S1 to Sn; a gradation voltage generator circuit 323 that outputs voltages corresponding to 256 positive-polarity and negative-polarity gradation levels, respectively; a selection circuit 324 for selecting voltages to be applied to the respective source bus lines S1 to Sn from among the voltages generated by the gradation voltage generator circuit 323; an output circuit 325 for applying the voltages selected by the selection circuit 324, as driving video signals to the source bus lines S1 to Sn; a charge sharing control circuit 326 that generates a charge sharing control signal CHA that controls charge sharing operation; and a charge sharing circuit 327 for short-circuiting source bus lines so that charge sharing can be performed.

Note that, in the present embodiment, a charging voltage output unit is implemented by the output circuit 325 and a short-circuiting circuit is implemented by the charge sharing circuit 327.

A source start pulse signal SSP and a source clock signal SCK are inputted to the shift register 321. The shift register 321 sequentially transfers a pulse included in the source start pulse signal SSP from an input terminal to an output terminal based on the source clock signal SCK. According to the transfer of the pulses, sampling pulses for the respective source bus lines S1 to Sn are sequentially outputted from the shift register 321, and the sampling pulses are sequentially inputted to the sampling latch circuit 322.

The sampling latch circuit 322 samples and holds 8-bit digital video signals DV transmitted from the timing control circuit 100, at timing of the sampling pulses outputted from the shift register 321. Furthermore, the sampling latch circuit 322 simultaneously outputs the held digital video signals DV as 8-bit internal image signals d1 to dn at timing of a pulse of a latch strobe signal LS.

The gradation voltage generator circuit 323 generates voltages (gradation voltages) VH1 to VH256 and VL1 to VL256 corresponding to 256 gradation levels for each of the positive and negative polarities, based on a plurality of reference voltages provided from a predetermined power supply circuit (not shown), and outputs the generated voltages as a gradation voltage group.

The selection circuit 324 selects any of the voltages included in the gradation voltage group VH1 to VH256 and VL1 to VL256 outputted from the gradation voltage generator circuit 323, based on the internal image signals d1 to dn outputted from the sampling latch circuit 322, and outputs the selected voltages. At that time, the polarities of voltages to be selected from the gradation voltage group are determined based on a polarity control signal POL transmitted from the timing control circuit 100. The voltages outputted from the selection circuit 324 are inputted to the output circuit 325.

The output circuit 325 performs impedance transformation on the voltages outputted from the selection circuit 324, based on the polarity control signal POL outputted from the timing control circuit 100, and outputs the transformed voltages as driving video signals (charging voltages) to the source bus lines S1 to Sn.

Figure 4:
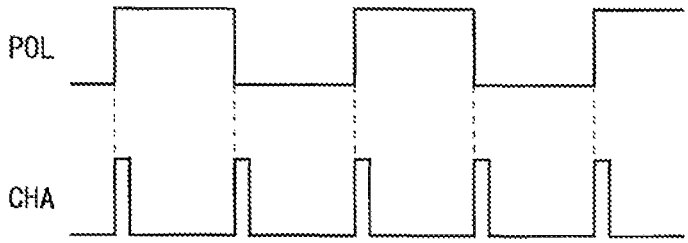
FIG. 4 is a signal waveform diagram for describing generation of a charge sharing control signal in the first embodiment.

The charge sharing control circuit 326 generates a charge sharing control signal CHA that controls charge sharing operation performed by the charge sharing circuit 327, based on the polarity control signal POL outputted from the timing control circuit 100. FIG. 4 is a signal waveform diagram for describing generation of a charge sharing control signal CHA. A polarity control signal POL whose level changes between a high level and a low level on a frame-by-frame basis is provided to the charge sharing control circuit 326. When the charge sharing control circuit 326 detects a change in the level of the polarity control signal POL, as shown in FIG. 4, the charge sharing control circuit 326 brings the level of the charge sharing control signal CHA to a high level for a certain period. During a period during which the level of the charge sharing control signal CHA is thus brought to a high level, the charge sharing circuit 327 performs charge sharing as will be described later.

The charge sharing circuit 327 short-circuits two source bus lines connected to each other through a switch, based on the charge sharing control signal CHA outputted from the charge sharing control circuit 326. More specifically, with two source bus lines, to which charging voltages of different polarities are applied in each frame, forming one set, the charge sharing circuit 327 short-circuits two source bus lines forming each set, upon switching frames. By this, upon switching frames, charge sharing is performed.

Note that the source driver 300 may be implemented by a single IC or may be implemented by a plurality of ICs. Note also that the source driver 300 may be implemented by other modes than an IC.

1.2.2 Combinations of Source Bus Lines that Perform Charge Sharing

Figure 1:
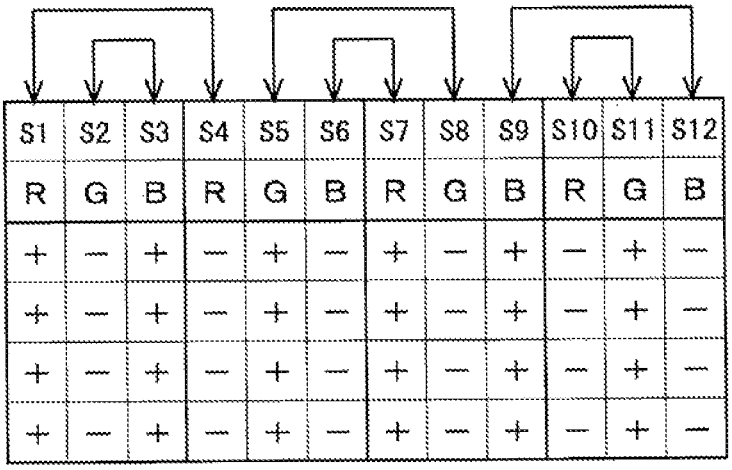
FIG. 1 is a schematic diagram for describing combinations of source bus lines used when an active matrix-type liquid crystal display device according to a first embodiment of the present invention performs charge sharing.

FIG. 1 is a schematic diagram for describing combinations of source bus lines in which charge sharing is performed. As shown in FIG. 1, in the present embodiment, the charge sharing circuit 327 is configured such that, with four source bus lines forming one group, charge sharing is performed between two outer source bus lines and between two inner source bus lines. For example, when attention is focused on the source bus lines S1 to S4, charge sharing is performed between the source bus line S1 and the source bus line S4 and between the source bus line S2 and the source bus line S3. Such a configuration is repeated every four source bus lines.

As described above, in the present embodiment, the source-reversal system is adopted as a polarity reversal system. Therefore, as can be grasped from FIG. 1, charge sharing is performed between two source bus lines to which voltages of different polarities are applied in each frame.

1.2.3 Configuration of a Portion Near an Output Portion (the Output Circuit and the Charge Sharing Circuit)

Figure 5:
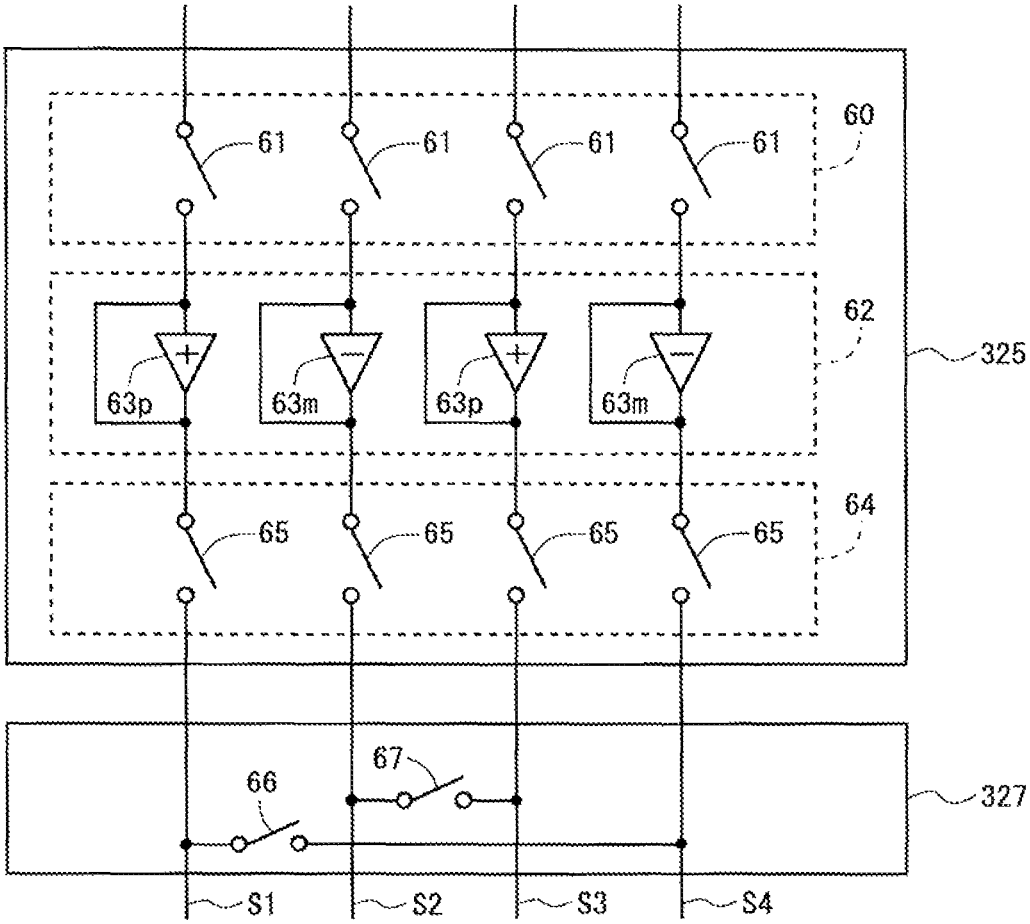
FIG. 5 is a circuit diagram showing a configuration of a portion near an output portion of the source driver (an output circuit and a charge sharing circuit) in the first embodiment.

FIG. 5 is a circuit diagram showing a configuration of a portion near an output portion (the output circuit 325 and the charge sharing circuit 327) of the source driver 300. Note that FIG. 5 only shows a portion corresponding to four source bus lines S1 to S4.

The output circuit 325 is composed of a first switching unit 60 including a plurality of switching switches 61; a buffer unit 62 including a plurality of amplifiers 63*p* for positive polarity and a plurality of amplifiers 63*m* for negative polarity; and a second switching unit 64 including a plurality of switching switches 65. Inside the output circuit 325, with two source bus lines forming one set, a connection destination of each source bus line is switched between an amplifier 63*p* for positive polarity and an amplifier 63*m* for negative polarity. For example, for a given source bus line, when a positive-polarity voltage is to be applied in an even frame and a negative-polarity voltage is to be applied in an odd frame, corresponding switching switches 61 and 65 operate such that a charging voltage is applied to the given source bus line through an amplifier 63*p* for positive polarity in the even frame and a charging voltage is applied to the given source bus line through an amplifier 63*m* for negative polarity in the odd frame. The operation of the switching switches 61 and 65 is controlled by a polarity control signal POL.

The charge sharing circuit 327 is composed of a short-circuit control switch 66 that controls a short circuit between the source bus line S1 and the source bus line S4; and a short-circuit control switch 67 that controls a short circuit between the source bus line S2 and the source bus line S3. The operation of the short-circuit control switches 66 and 67 is controlled by a charge sharing control signal CHA.

Note that although the number of source bus lines matches the number of amplifiers in the present embodiment, the present invention is not limited thereto. A single amplifier may be provided for every group of a plurality of source bus lines.

<1.2.3.1 Second Switching Unit in the Output Circuit>

Now, with reference to FIG. 6, a detailed exemplary configuration of the second switching unit 64 will be described. Note that FIG. 6 only shows a portion corresponding to two source bus lines. Note also that in FIG. 6 an odd-column source bus line is denoted by reference character So, an even-column source bus line is denoted by reference character Se, a line connected to an amplifier 63*p* for positive polarity is denoted by reference character Sp, and a line connected to an amplifier 63*m* for negative polarity is denoted by reference character Sm.

The second switching unit 64 is composed of a first connection control unit 65*a* that controls a connection destination of the odd-column source bus line So; a second connection control unit 65*b* that controls a connection destination of the even-column source bus line Se; and an output control unit 68 that controls output of a charging voltage (driving video signal) to each source bus line.

The first connection control unit 65*a* is composed of an inverter 650; a CMOS switch 651 including a P-type TFT 6511 and an N-type TFT 6512; and a CMOS switch 652 including a P-type TFT 6521 and an N-type TFT 6522. The inverter 650 has an input terminal to which a polarity control signal POL is provided, and has an output terminal connected to a gate electrode of the P-type TFT 6511 and a gate electrode of the N-type TFT 6522. The polarity control signal POL is provided to a gate electrode of the N-type TFT 6512 and a gate electrode of the P-type TFT 6521, and a logically inverted signal of the polarity control signal POL is provided to the gate electrode of the P-type TFT 6511 and the gate electrode of the N-type TFT 6522. The CMOS switch 651 has an input terminal connected to the amplifier 63*p* for positive polarity, and has an output terminal connected to the output control unit 68. The CMOS switch 652 has an input terminal connected to the amplifier 63*m* for negative polarity, and has an output terminal connected to the output control unit 68.

The second connection control unit 65*b* is composed of an inverter 653; a CMOS switch 654 including a P-type TFT 6541 and an N-type TFT 6542; and a CMOS switch 655 including a P-type TFT 6551 and an N-type TFT 6552. The inverter 653 has an input terminal to which the polarity control signal POL is provided, and has an output terminal connected to a gate electrode of the N-type TFT 6542 and a gate electrode of the P-type TFT 6551. The polarity control signal POL is provided to a gate electrode of the P-type TFT 6541 and a gate electrode of the N-type TFT 6552, and a logically inverted signal of the polarity control signal POL is provided to the gate electrode of the N-type TFT 6542 and the gate electrode of the P-type TFT 6551. The CMOS switch 654 has an input terminal connected to the amplifier 63*p* for positive polarity, and has an output terminal connected to the output control unit 68. The CMOS switch 655 has an input terminal connected to the amplifier 63*m* for negative polarity, and has an output terminal connected to the output control unit 68.

In the above-described configuration, when the polarity control signal POL is at a high level, the CMOS switch 651 and the CMOS switch 655 are in an on state and the CMOS switch 652 and the CMOS switch 654 are in an off state. Therefore, an output voltage from the amplifier 63*p* for positive polarity is outputted from the first connection control unit 65*a*, and an output voltage from the amplifier 63*m* for negative polarity is outputted from the second connection control unit 65*b*. On the other hand, when the polarity control signal POL is at a low level, the CMOS switch 651 and the CMOS switch 655 are in an off state and the CMOS switch 652 and the CMOS switch 654 are in an on state. Therefore, an output voltage from the amplifier 63*m* for negative polarity is outputted from the first connection control unit 65*a*, and an output voltage from the amplifier 63*p* for positive polarity is outputted from the second connection control unit 65*b*.

Figure 6:
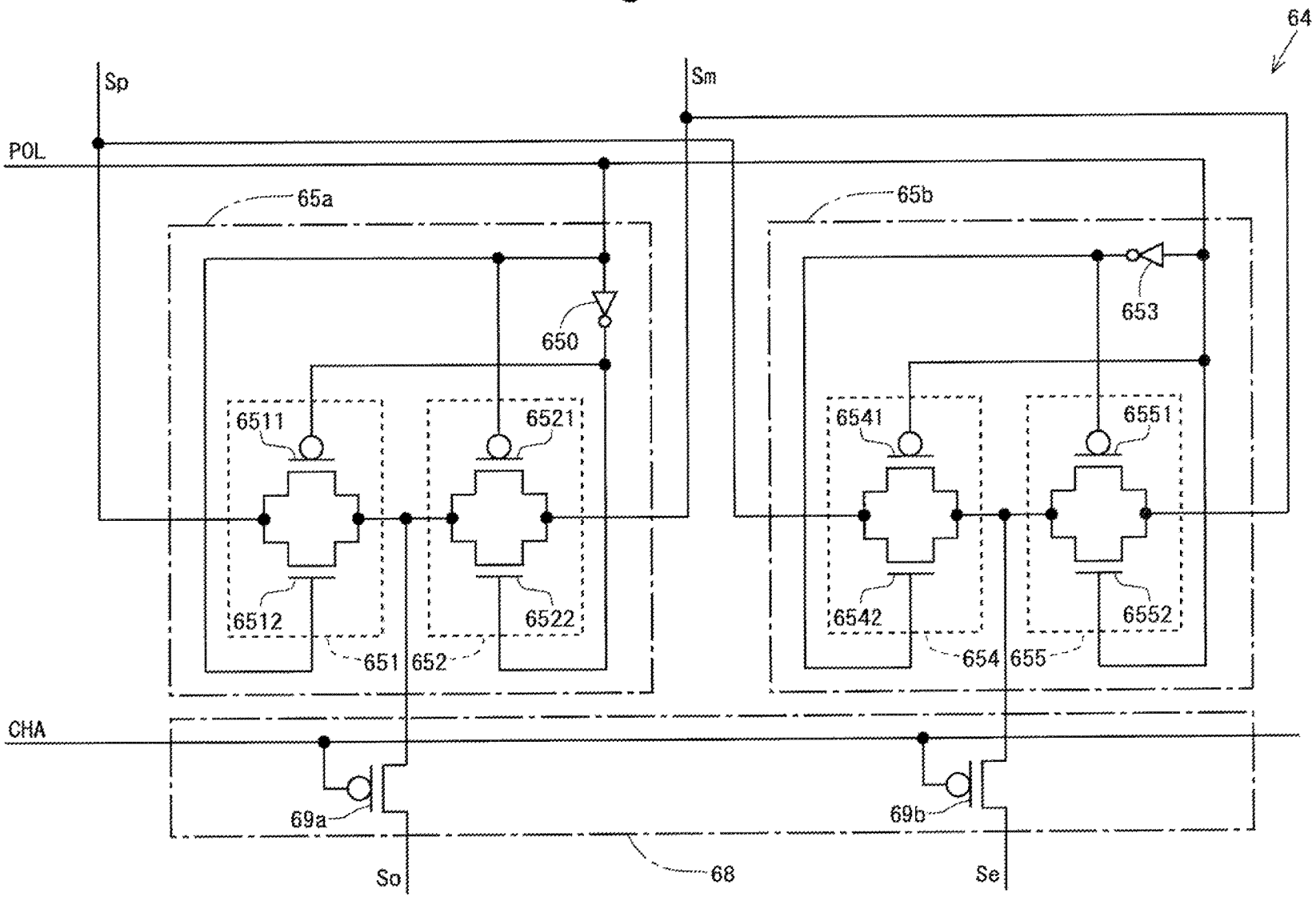
FIG. 6 is a circuit diagram showing a detailed exemplary configuration of a second switching unit in the output circuit in the first embodiment.

As shown in FIG. 6, the output control unit 68 is provided with a P-type TFT 69*a* for controlling output from the first connection control unit 65*a*; and a P-type TFT 69*b* for controlling output from the second connection control unit 65*b*. The P-type TFT 69*a* has a gate electrode to which a charge sharing control signal CHA is provided, has a drain electrode connected to the first connection control unit 65*a*, and has a source electrode connected to the odd-column source bus line So. The P-type TFT 69*b* has a gate electrode to which the charge sharing control signal CHA is provided, has a drain electrode connected to the second connection control unit 65*b*, and has a source electrode connected to the even-column source bus line Se.

In the above-described configuration, when the charge sharing control signal CHA is at a high level, the P-type TFTs 69*a* and 69*b* are in an off state. By this, the first connection control unit 65*a* and the odd-column source bus line So go into an electrically disconnected state, and the second connection control unit 65*b* and the even-column source bus line Se go into an electrically disconnected state. On the other hand, when the charge sharing control signal CHA is at a low level, the P-type TFTs 69*a* and 69*b* are in an on state. By this, the first connection control unit 65*a* and the odd-column source bus line So go into an electrically connected state, and the second connection control unit 65*b* and the even-column source bus line Se go into an electrically connected state.

Note that since the first switching unit 60 has the same configuration as the second switching unit 64, description thereof is omitted. Note, however, that the output control unit 68 (see FIG. 6) does not need to be provided in the first switching unit 60.

<1.2.3.2 Charge Sharing Circuit>

Figure 7:
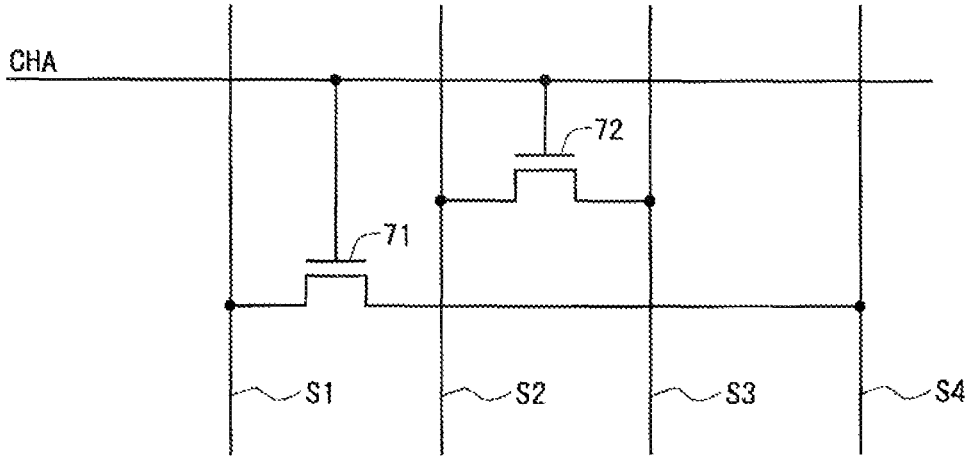
FIG. 7 is a circuit diagram showing an exemplary configuration of the charge sharing circuit in the first embodiment.

Next, with reference to FIG. 7, an exemplary configuration of the charge sharing circuit 327 will be described. Note that FIG. 7 only shows a portion corresponding to four source bus lines S1 to S4. As shown in FIG. 7, the charge sharing circuit 327 includes two N-type TFTs 71 and 72. The N-type TFT 71 corresponds to the short-circuit control switch 66 of FIG. 5, and the N-type TFT 72 corresponds to the short-circuit control switch 67 of FIG. 5.

In the above-described configuration, when the charge sharing control signal CHA is at a high level, the N-type TFTs 71 and 72 are in an on state. By this, the source bus line S1 and the source bus line S4 are short-circuited and the source bus line S2 and the source bus line S3 are short-circuited. As a result, charge sharing is performed between the source bus line S1 and the source bus line S4 and between the source bus line S2 and the source bus line S3. On the other hand, when the charge sharing control signal CHA is at a low level, the N-type TFTs 71 and 72 are in an off state. By this, the source bus line S1 and the source bus line S4 go into an electrically disconnected state, and the source bus line S2 and the source bus line S3 go into an electrically disconnected state.

1.3 Drive Method

1.3.1 Operation of the Portion Near the Output Portion

Figure 8:
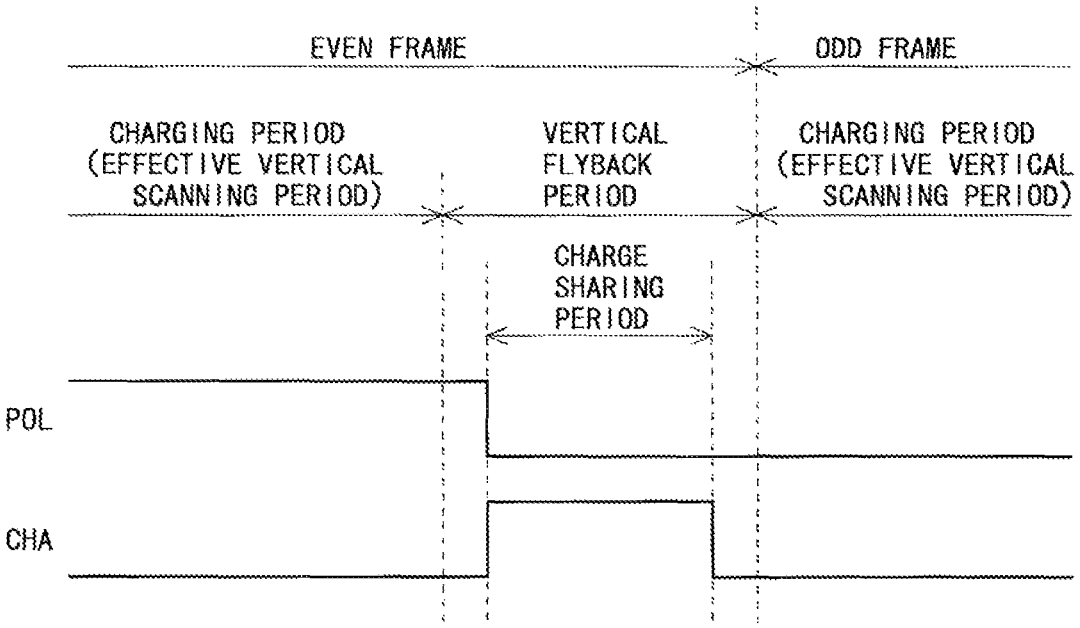
FIG. 8 is a signal waveform diagram showing changes in the waveforms of a polarity control signal and a charge sharing control signal upon transitioning from an even frame to an odd frame in the first embodiment.
Figure 9:
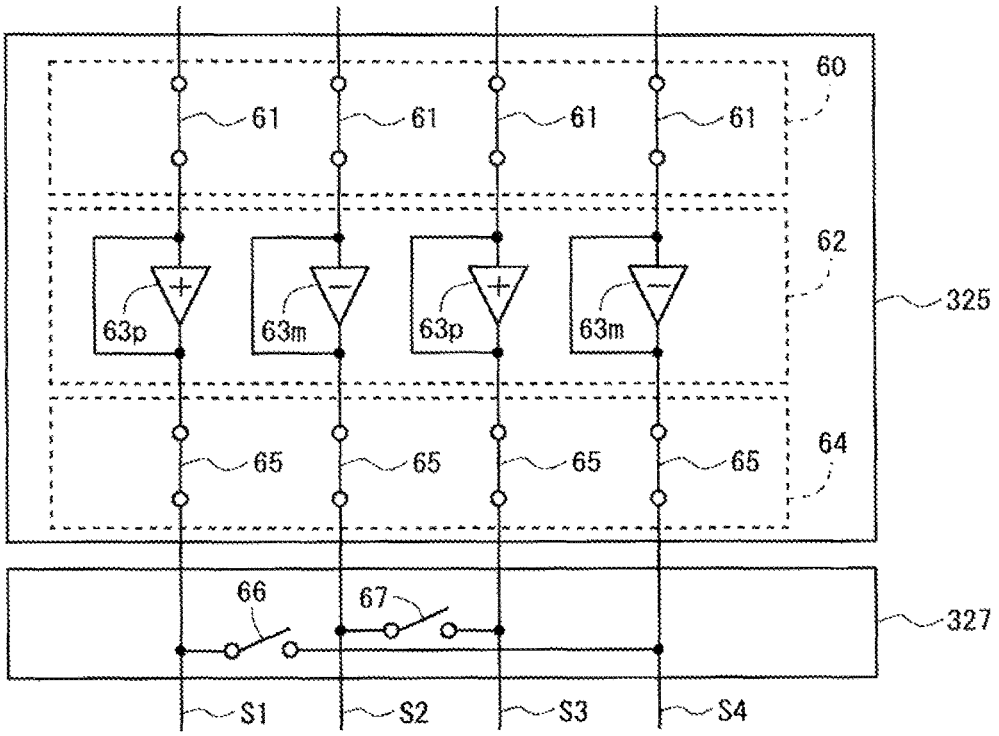
FIG. 9 is a diagram showing a connection state for a charging period (effective vertical scanning period) of the even frame in the first embodiment.
Figure 10:
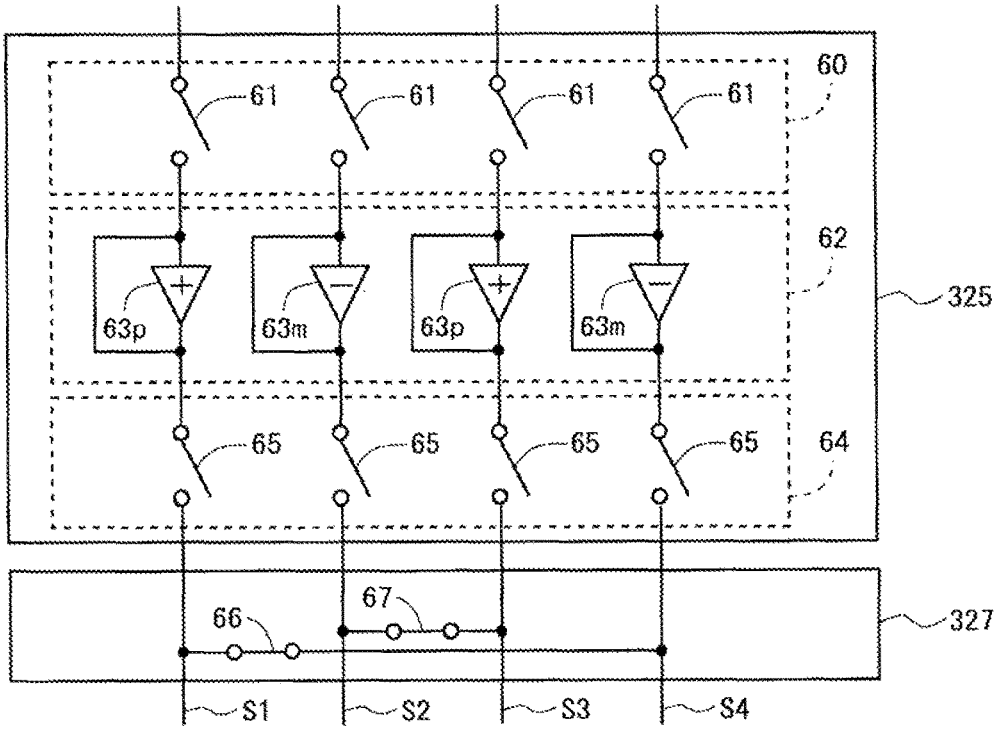
FIG. 10 is a diagram showing a connection state for a charge sharing period in the first embodiment.
Figure 11:
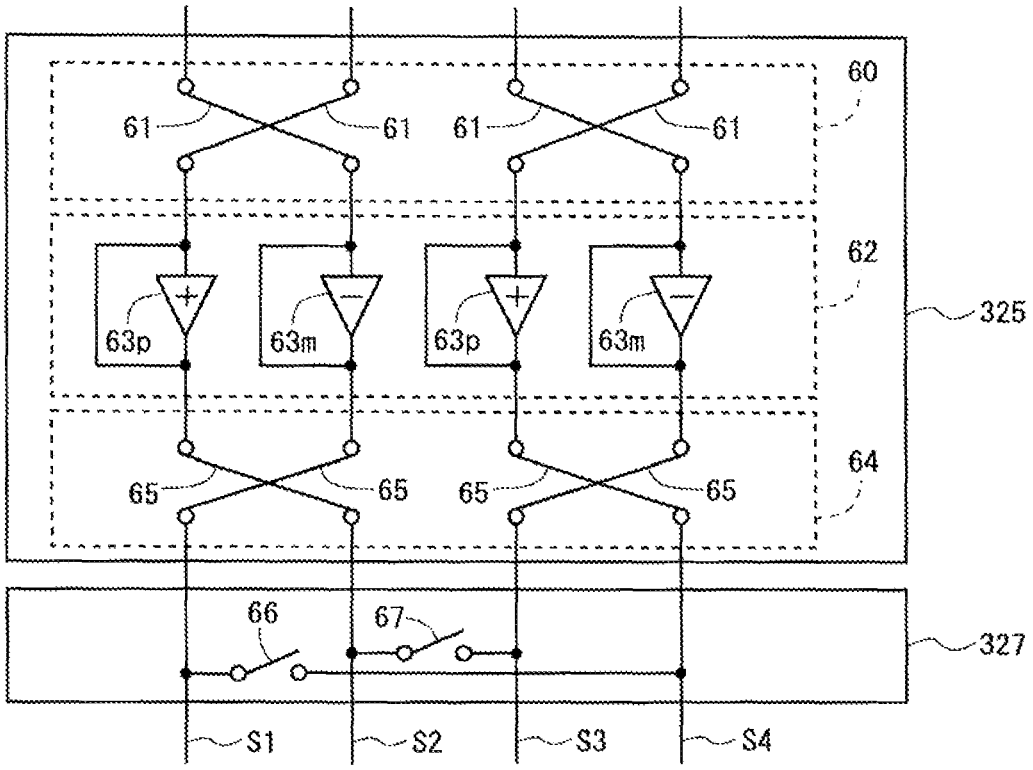
FIG. 11 is a diagram showing a connection state for a charging period (effective vertical scanning period) of the odd frame in the first embodiment.

With reference to FIGS. 8 to 11, the operation of the portion near the output portion (the output circuit 325 and the charge sharing circuit 327) of the source driver 300 will be described. FIG. 8 is a signal waveform diagram showing changes in the waveforms of a polarity control signal POL and a charge sharing control signal CHA upon transitioning from an even frame to an odd frame. FIG. 9 is a diagram showing a connection state for a charging period (effective vertical scanning period) of the even frame. FIG. 10 is a diagram showing a connection state for a charge sharing period. FIG. 11 is a diagram showing a connection state for a charging period (effective vertical scanning period) of the odd frame. Note that here attention is focused on the source bus lines S1 to S4.

During the charging period of the even frame, the charge sharing control signal CHA is maintained at a low level. Hence, in the charge sharing circuit 327, the short-circuit control switches 66 and 67 (the N-type TFTs 71 and 72 of FIG. 7) are maintained in an off state. Therefore, all source bus lines maintain a state of being electrically disconnected from other source bus lines (see FIG. 9). In addition, by the charge sharing control signal CHA being maintained at the low level, in the output control unit 68 (see FIG. 6) in the second switching unit 64 of the output circuit 325, the P-type TFTs 69*a* and 69*b* are maintained in an on state. In addition, during the charging period of the even frame, the polarity control signal POL is maintained at a high level. By providing the polarity control signal POL to the first switching unit 60 and the second switching unit 64 of the output circuit 325 (see FIG. 6), as shown in FIG. 9, the switching switches 61 and 65 operate such that a positive-polarity voltage is applied to the odd-column source bus lines S1 an S3 and a negative-polarity voltage is applied to the even-column source bus lines S2 and S4. By the above, in the even frame, a positive-polarity voltage is applied to the odd-column source bus lines S1 and S3, and a negative-polarity voltage is applied to the even-column source bus lines S2 and S4. By this, a positive-polarity voltage is applied to liquid crystal layers in pixel formation portions 5 connected to the odd-column source bus lines S1 and S3, and a negative-polarity voltage is applied to liquid crystal layers in pixel formation portions 5 connected to the even-column source bus lines S2 and S4.

After a lapse of a predetermined period from the start time of a vertical flyback period of the even frame, as shown in FIG. 8, the polarity control signal POL changes from the high level to a low level. According to the change in the level of the polarity control signal POL, the charge sharing control signal CHA changes from the low level to a high level. By this, a charge sharing period starts. During the charge sharing period, the charge sharing control signal CHA is maintained at the high level, by which in the output control unit 68 (see FIG. 6) in the second switching unit 64 of the output circuit 325, the P-type TFTs 69*a* and 69*b* are maintained in an off state. By this, as shown in FIG. 10, the buffer unit 62 in the output circuit 325 and the charge sharing circuit 327 maintain a state of being electrically disconnected from each other. In addition, during the charge sharing period, in the charge sharing circuit 327, the short-circuit control switches 66 and 67 are maintained in an on state. By the short-circuit control switch 66 maintained in an on state, the source bus line S1 and the source bus line S4 maintain a state of being short-circuited, and charge sharing is performed between the source bus line S1 and the source bus line S4. In addition, by the short-circuit control switch 67 maintained in an on state, the source bus line S2 and the source bus line S3 maintain a state of being short-circuited, and charge sharing is performed between the source bus line S2 and the source bus line S3. In the above-described manner, during the charge sharing period, charge sharing is performed using the above-described combinations (see FIG. 1). By the charge sharing control signal CHA changing from the high level to a low level, the charge sharing period ends.

During a charging period of the odd frame, as with the charging period of the even frame, all source bus lines maintain a state of being electrically disconnected from other source bus lines (see FIG. 11). In addition, in the output control unit 68 (see FIG. 6) in the second switching unit 64 of the output circuit 325, the P-type TFTs 69*a* and 69*b* are maintained in an on state. In addition, during the charging period of the odd frame, the polarity control signal POL is maintained at the low level. By providing the polarity control signal POL to the first switching unit 60 and the second switching unit 64 of the output circuit 325 (see FIG. 6), as shown in FIG. 11, the switching switches 61 and 65 operate such that a negative-polarity voltage is applied to the odd-column source bus lines S1 an S3 and a positive-polarity voltage is applied to the even-column source bus lines S2 and S4. By the above, in the odd frame, a negative-polarity voltage is applied to the odd-column source bus lines S1 and S3, and a positive-polarity voltage is applied to the even-column source bus lines S2 and S4. By this, a negative-polarity voltage is applied to the liquid crystal layers in the pixel formation portions 5 connected to the odd-column source bus lines S1 and S3, and a positive-polarity voltage is applied to the liquid crystal layers in the pixel formation portions 5 connected to the even-column source bus lines S2 and S4.

Note that operation performed upon transitioning from an odd frame to an even frame is the same as operation performed upon transitioning from an even frame to an odd frame (note, however, that the polarity control signal POL changes from a low level to a high level), and thus, description thereof is omitted.

1.3.2 Changes in Source Voltage

Taking into account the above operation, with reference to FIGS. 12 to 14, changes in source voltage before and after switching frames will be described. Note that here attention is focused on the source bus lines S1 to S12. Note also that, as described above, it is assumed that normally black mode is adopted as a display mode. Furthermore, it is assumed that the voltage of the common electrode is 5.0 V, the maximum value of the source application voltage is 9.5 V, and the minimum value of the source application voltage is 0.5 V.

Figure 12:
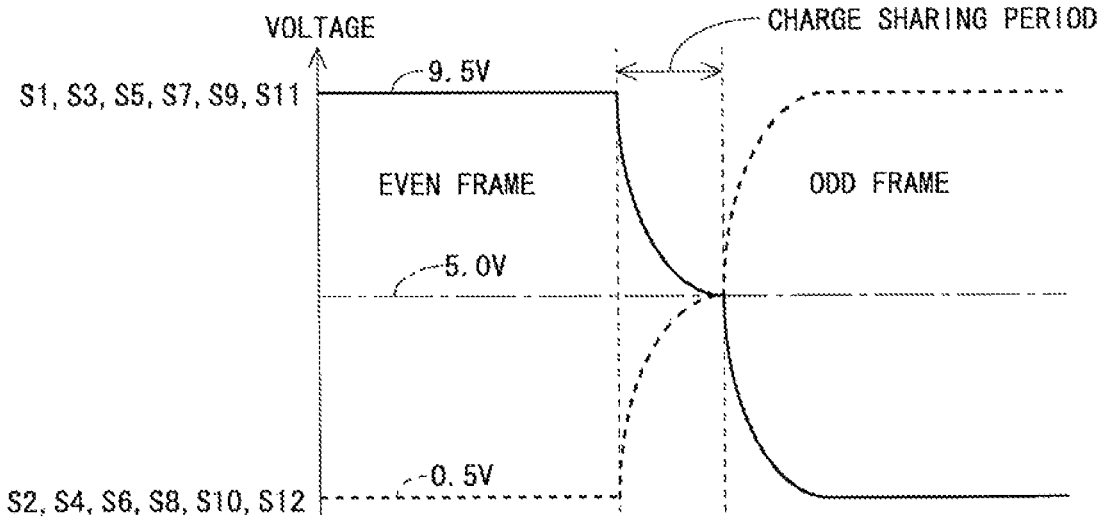
FIG. 12 is a waveform diagram showing changes in source voltage for when all-white display is performed in the first embodiment.

When all-white display is performed, the source voltages change as shown in FIG. 12. In an even frame, the source voltages of the source bus lines S1, S3, S5, S7, S9, and S11 are 9.5 V, and the source voltages of the source bus lines S2, S4, S6, S8, S10, and S12 are 0.5 V. When a charge sharing period has come, charge sharing is performed using the above-described combinations (see FIG. 1). At this time, charge sharing is performed between a source bus line with a source voltage of 9.5 V and a source bus line with a source voltage of 0.5 V. Therefore, the source voltages of all source bus lines approach 5.0 V. After the charge sharing period ends, a negative-polarity voltage is applied to the source bus lines S1, S3, S5, S7, S9, and S11, and a positive-polarity voltage is applied to the source bus lines S2, S4, S6, S8, S10, and S12. As a result, the source voltages of the source bus lines S1, S3, S5, S7, S9, and S11 decrease, and the source voltages of the source bus lines S2, S4, S6, S8, S10, and S12 increase. By this, in an odd frame, the source voltages of the source bus lines S1, S3, S5, S7, S9, and S11 become 0.5 V, and the source voltages of the source bus lines S2, S4, S6, S8, S10, and S12 become 9.5 V.

Figure 13:
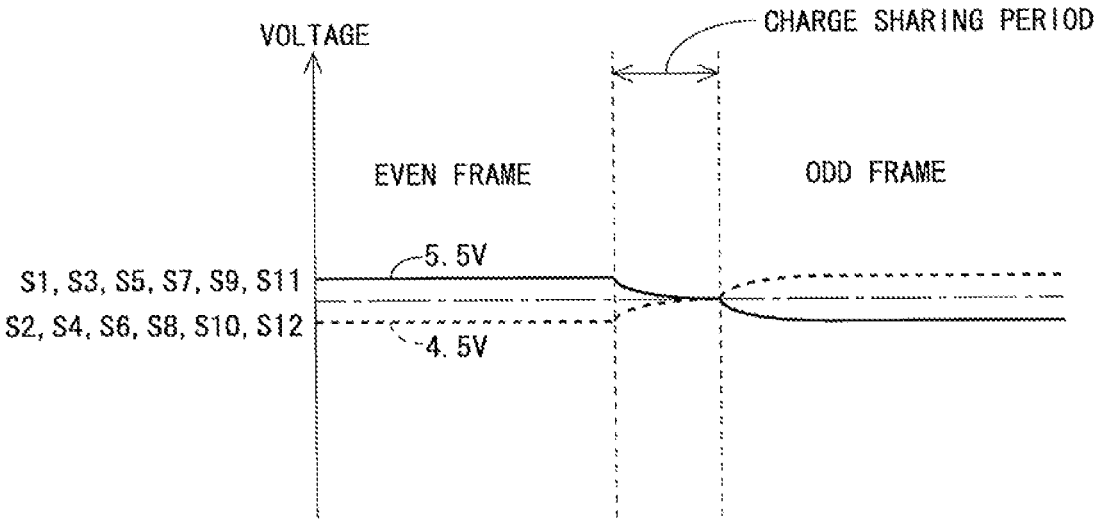
FIG. 13 is a waveform diagram showing changes in source voltage for when all-black display is performed in the first embodiment.

When all-black display is performed, the source voltages change as shown in FIG. 13. In an even frame, the source voltages of the source bus lines S1, S3, S5, S7, S9, and S1 are 5.5 V, and the source voltages of the source bus lines S2, S4, S6, S8, S10, and S12 are 4.5 V. When a charge sharing period has come, charge sharing is performed using the above-described combinations (see FIG. 1). At this time, charge sharing is performed between a source bus line with a source voltage of 5.5 V and a source bus line with a source voltage of 4.5 V. Therefore, the source voltages of all source bus lines approach 5.0 V. After the charge sharing period ends, a negative-polarity voltage is applied to the source bus lines S1, S3, S5, S7, S9, and S11, and a positive-polarity voltage is applied to the source bus lines S2, S4, S6, S8, S10, and S12. As a result, the source voltages of the source bus lines S1, S3, S5, S7, S9, and S11 decrease, and the source voltages of the source bus lines S2, S4, S6, S8, S10, and S12 increase. By this, in an odd frame, the source voltages of the source bus lines S1, S3, S5, S7, S9, and S11 become 4.5 V, and the source voltages of the source bus lines S2, S4, S6, S8, S10, and S12 become 5.5 V.

Figure 14:
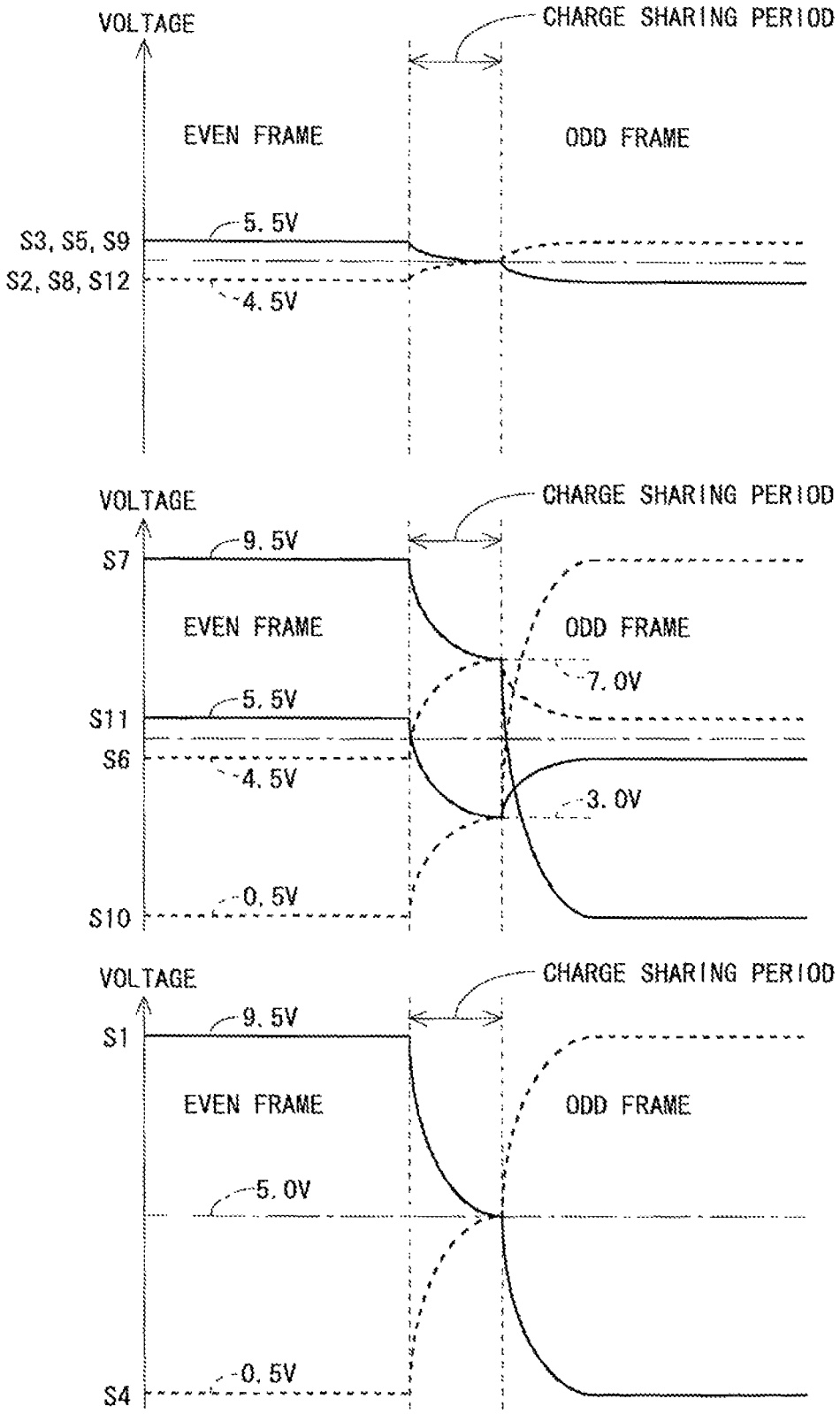
FIG. 14 is a waveform diagram showing changes in source voltage for when all-red display is performed in the first embodiment.

When all-red display is performed, the source voltages change as shown in FIG. 14. In an even frame, the source voltages of the source bus lines S1 and S7 are 9.5 V, the source voltages of the source bus lines S3, S5, S9, and S11 are 5.5 V, the source voltages of the source bus lines S2, S6, S8, and S12 are 4.5 V, and the source voltages of the source bus lines S4 and S10 are 0.5 V.

When a charge sharing period has come, charge sharing is performed using the above-described combinations. When attention is focused on the source bus lines S2, S3, S5, S8, S9, and S12, charge sharing is performed between a source bus line with a source voltage of 5.5 V and a source bus line with a source voltage of 4.5 V. Therefore, the source voltages of the source bus lines S2, S3, S5, S8, S9, and S12 approach 5.0 V. In addition, charge sharing is performed between the source bus line S7 with a source voltage of 9.5 V and the source bus line S6 with a source voltage of 4.5 V. Therefore, the source voltages of the source bus lines S6 and S7 approach 7.0 V. Furthermore, charge sharing is performed between the source bus line S11 with a source voltage of 5.5 V and the source bus line S10 with a source voltage of 0.5 V. Therefore, the source voltages of the source bus lines S10 and S11 approach 3.0 V. Moreover, charge sharing is performed between the source bus line S1 with a source voltage of 9.5 V and the source bus line S4 with a source voltage of 0.5 V. Therefore, the source voltages of the source bus lines S1 and S4 approach 5.0 V.

After the charge sharing period ends, a voltage of an opposite polarity to that for the even frame is applied to each source bus line. By this, in an odd frame, the source voltages of the source bus lines S1 and S7 become 0.5 V, the source voltages of the source bus lines S3, S5, S9, and S11 become 4.5 V, the source voltages of the source bus lines S2, S6, S8, and S12 become 5.5 V, and the source voltages of the source bus lines S4 and S10 become 9.5 V.

1.3.3 Comparison Examples

Now, as comparison examples, the operation of a portion near an output portion and changes in source voltage in conventional configurations will be described. As the conventional configurations, there are shown a configuration in which charge sharing is not performed (referred to as "first conventional configuration") and a configuration in which charge sharing is performed between two adjacent source bus lines (referred to as "second conventional configuration") (see FIG. 49). Note that each component is denoted by the same reference character as in the present embodiment. Note, however, that in the second conventional configuration a charge sharing circuit is denoted by reference character 90 and short-circuit control switches are denoted by reference characters 91 and 92 (see FIGS. 21 to 23).

<1.3.3.1 First Conventional Configuration>

Figure 15:
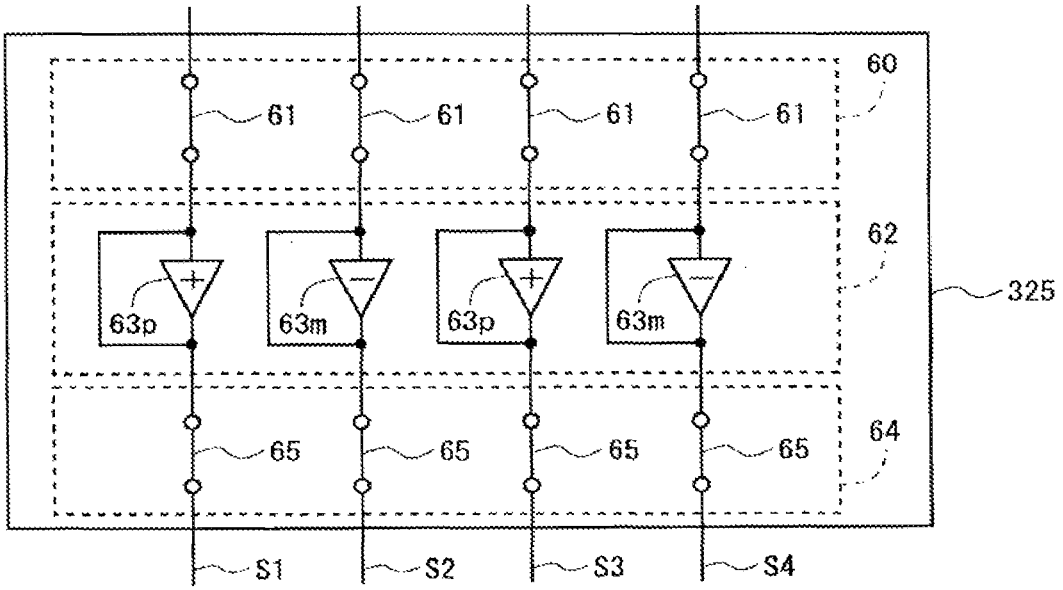
FIG. 15 is a diagram showing a connection state for a charging period (effective vertical scanning period) of an even frame in a first conventional configuration (a configuration in which charge sharing is not performed).
Figure 16:
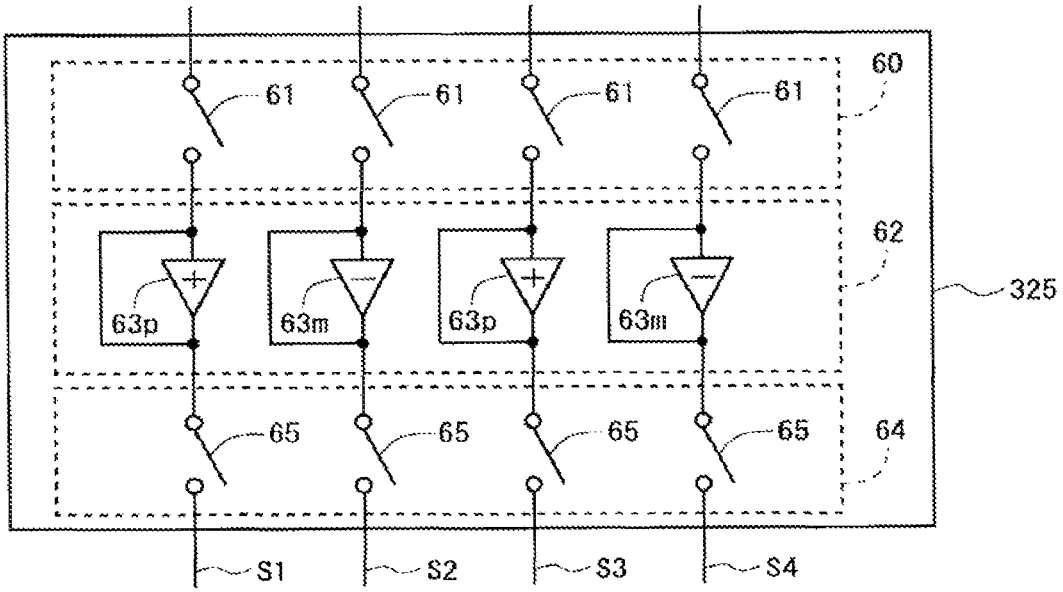
(RELATED ART) Fig.16
FIG. 16 is a diagram showing a connection state for a vertical flyback period in the first conventional configuration.
Figure 17:
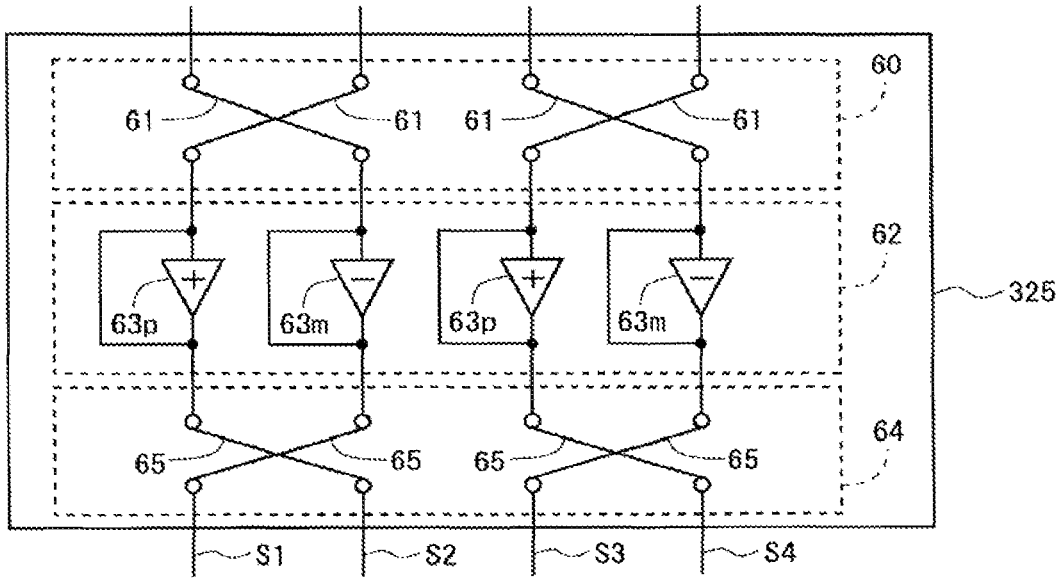
FIG. 17 is a diagram showing a connection state for a charging period (effective vertical scanning period) of an odd frame in the first conventional configuration.

With reference to FIGS. 15 to 17, the operation of a portion near an output portion of the first conventional configuration will be briefly described. During a charging period of an even frame, switching switches 61 and 65 operate as shown in FIG. 15, by which a positive-polarity voltage is applied to odd-column source bus lines S1 and S3 and a negative-polarity voltage is applied to even-column source bus lines S2 and S4. During a vertical flyback period, the switching switches 61 and 65 operate as shown in FIG. 16, by which an output circuit 325 and each source bus line go into a state of being electrically disconnected from each other. During a charging period of an odd frame, the switching switches 61 and 65 operate as shown in FIG. 17, by which a negative-polarity voltage is applied to the odd-column source bus lines S1 and S3 and a positive-polarity voltage is applied to the even-column source bus lines S2 and S4.

Taking into account the above operation, with reference to FIGS. 18 to 20, changes in source voltage before and after switching frames will be described.

Figure 18:
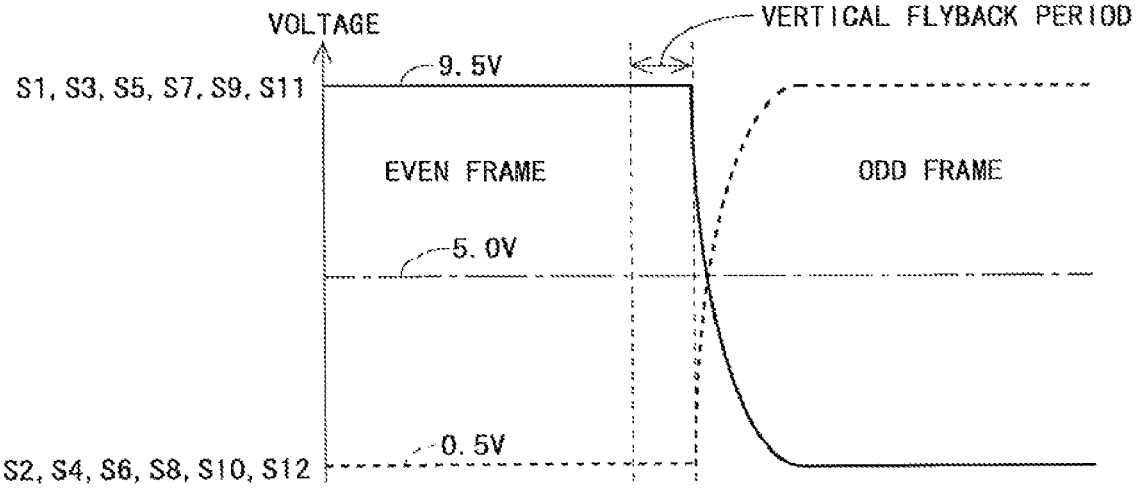
FIG. 18 is a waveform diagram showing changes in source voltage for when all-white display is performed in the first conventional configuration.

When all-white display is performed, the source voltages change as shown in FIG. 18. In an even frame, the source voltages of the source bus lines S1, S3, S5, S7, S9, and S11 are 9.5 V, and the source voltages of the source bus lines S2, S4, S6, S8, S10, and S12 are 0.5 V. During a vertical flyback period, since charge sharing is not performed in the first conventional configuration, the source voltages are maintained. When the frame is switched to an odd frame, a voltage of an opposite polarity to that for the even frame is applied to each source bus line. By this, in the odd frame, the source voltages of the source bus lines S1, S3, S5, S7, S9, and S11 become 0.5 V, and the source voltages of the source bus lines S2, S4, S6, S8, S10, and S12 become 9.5 V.

Figure 19:
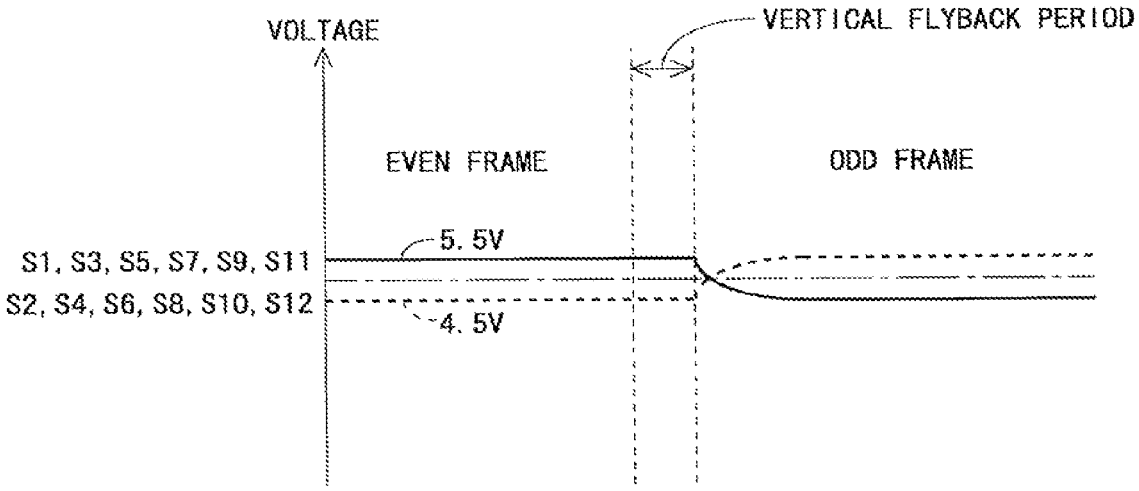
(RELATED ART) Fig.19
FIG. 19 is a waveform diagram showing changes in source voltage for when all-black display is performed in the first conventional configuration.

When all-black display is performed, the source voltages change as shown in FIG. 19. In an even frame, the source voltages of the source bus lines S1, S3, S5, S7, S9, and S11 are 5.5 V, and the source voltages of the source bus lines S2, S4, S6, S8, S10, and S12 are 4.5 V. During a vertical flyback period, since charge sharing is not performed in the first conventional configuration, the source voltages are maintained. When the frame is switched to an odd frame, a voltage of an opposite polarity to that for the even frame is applied to each source bus line. By this, in the odd frame, the source voltages of the source bus lines S1, S3, S5, S7, S9, and S11 become 4.5 V, and the source voltages of the source bus lines S2, S4, S6, S8, S10, and S12 become 5.5 V.

Figure 20:
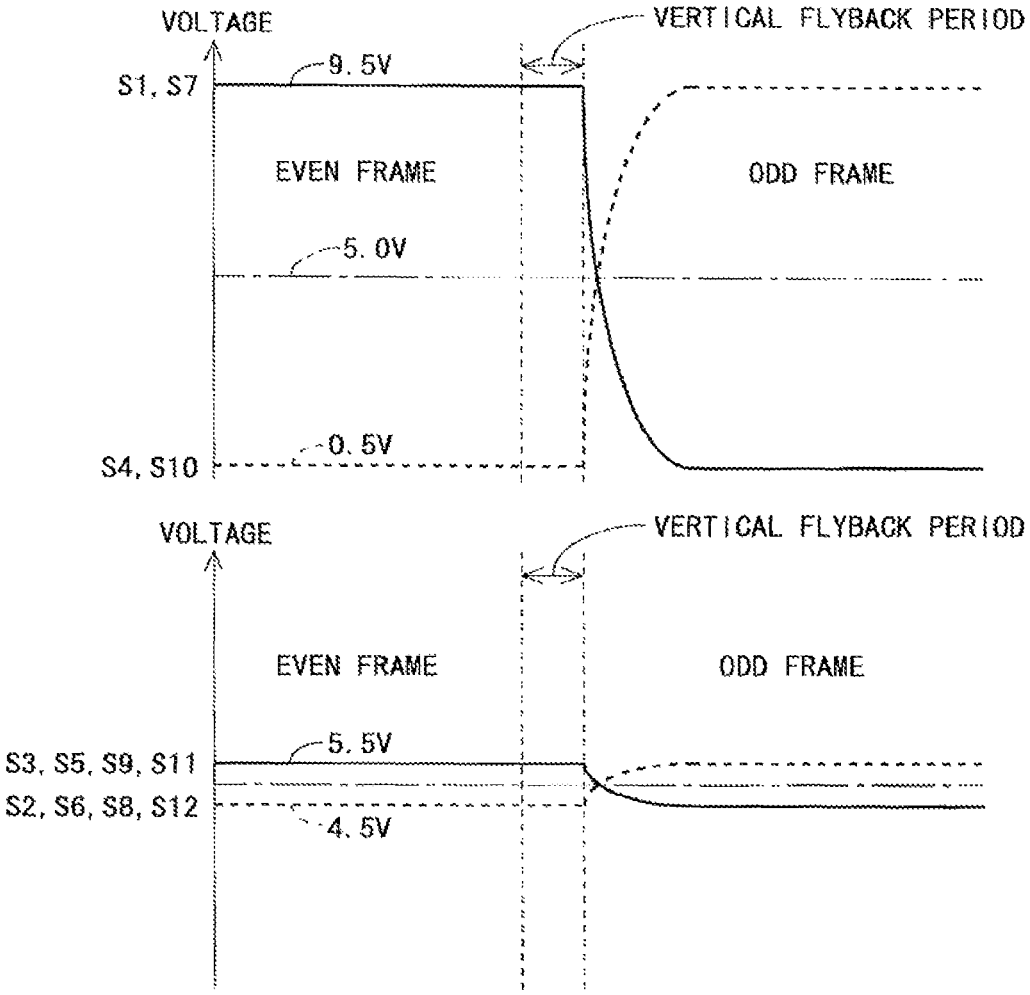
FIG. 20 is a waveform diagram showing changes in source voltage for when all-red display is performed in the first conventional configuration.

When all-red display is performed, the source voltages change as shown in FIG. 20. In an even frame, the source voltages of the source bus lines S1 and S7 are 9.5 V, the source voltages of the source bus lines S3, S5, S9, and S11 are 5.5 V, the source voltages of the source bus lines S2, S6, S8, and S12 are 4.5 V, and the source voltages of the source bus lines S4 and S10 are 0.5 V. During a vertical flyback period, since charge sharing is not performed in the first conventional configuration, the source voltages are maintained. When the frame is switched to an odd frame, a voltage of an opposite polarity to that for the even frame is applied to each source bus line. By this, in the odd frame, the source voltages of the source bus lines S1 and S7 become 0.5 V, the source voltages of the source bus lines S3, S5, S9, and S11 become 4.5 V, the source voltages of the source bus lines S2, S6, S8, and S12 become 5.5 V, and the source voltages of the source bus lines S4 and S10 become 9.5 V.

<1.3.3.2 Second Conventional Configuration>

Figure 21:
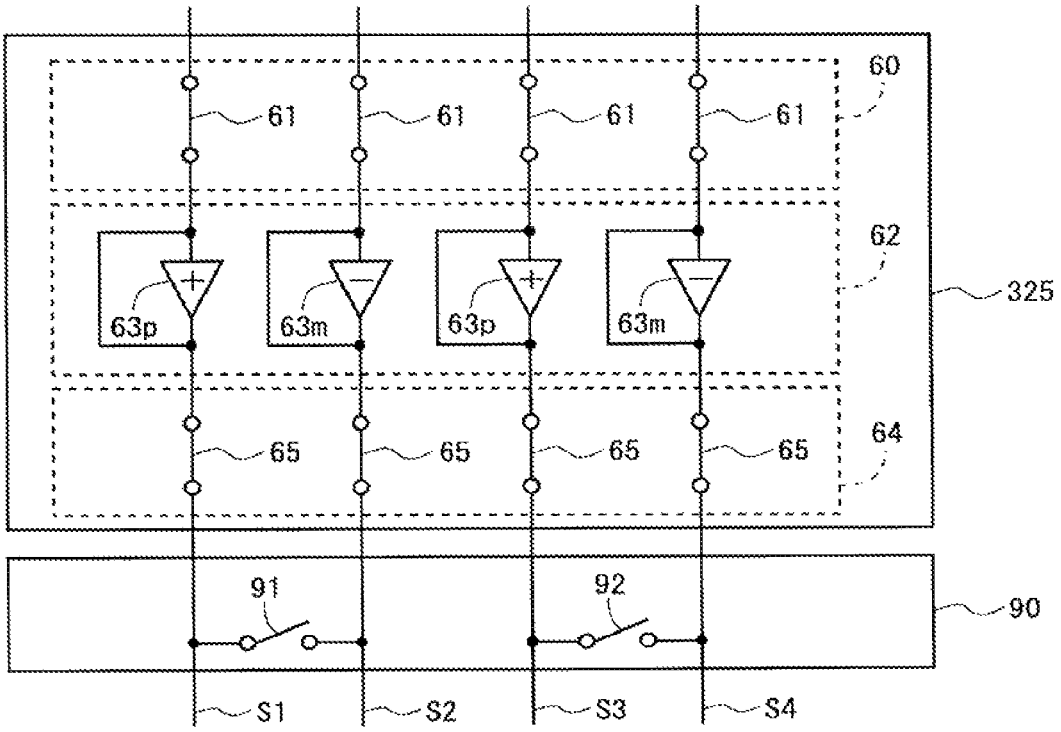
FIG. 21 is a diagram showing a connection state for a charging period (effective vertical scanning period) of an even frame in a second conventional configuration (a configuration in which charge sharing is performed between two adjacent source bus lines).
Figure 22:
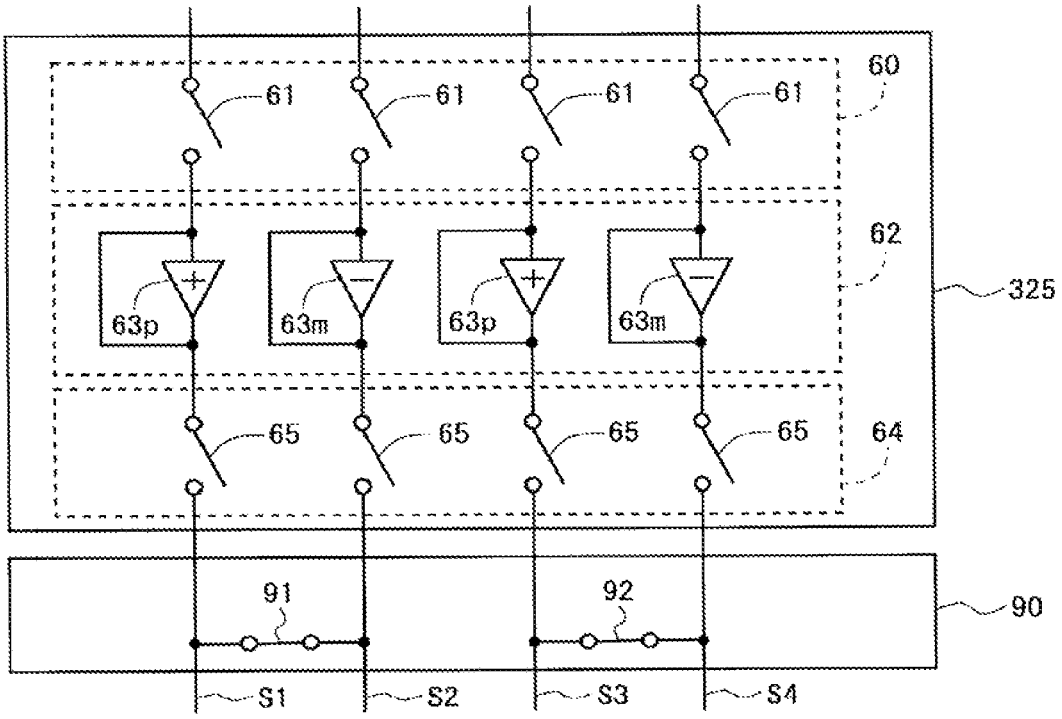
(RELATED ART) Fig.22
FIG. 22 is a diagram showing a connection state for a charge sharing period in the second conventional configuration.
Figure 23:
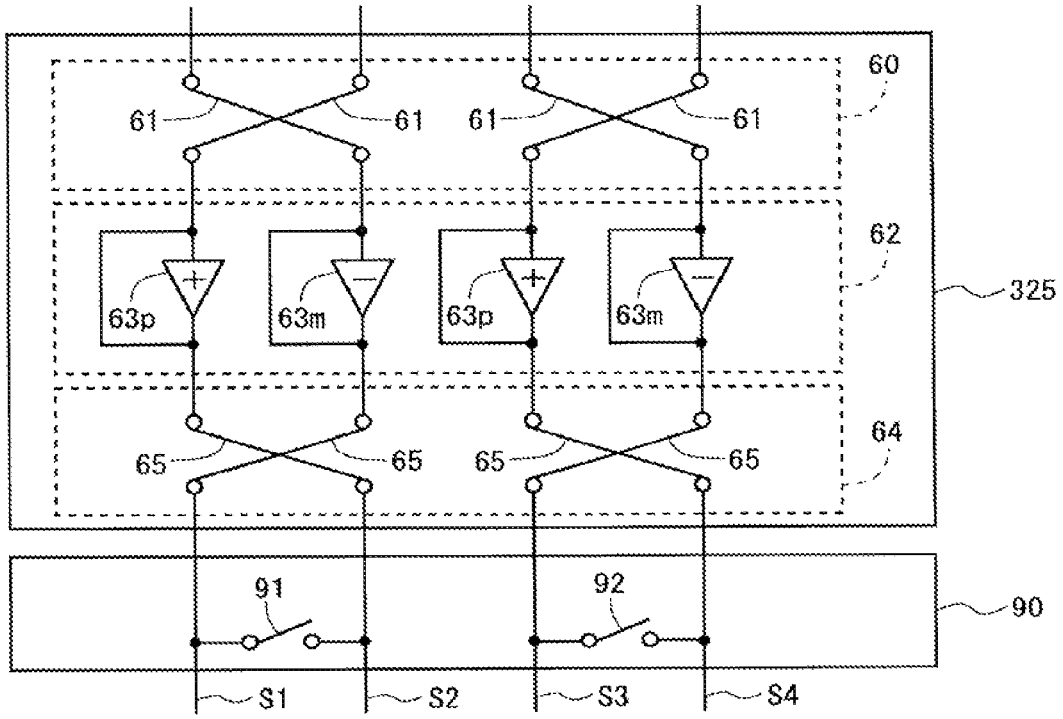
FIG. 23 is a diagram showing a connection state for a charging period (effective vertical scanning period) of an odd frame in the second conventional configuration.

With reference to FIGS. 21 to 23, the operation of a portion near an output portion of the second conventional configuration will be briefly described. During a charging period of an even frame, switching switches 61 and 65 and short-circuit control switches 91 and 92 operate as shown in FIG. 21, by which a positive-polarity voltage is applied to odd-column source bus lines S1 and S3 and a negative-polarity voltage is applied to even-column source bus lines S2 and S4. During a charge sharing period, the switching switches 61 and 65 and the short-circuit control switches 91 and 92 operate as shown in FIG. 22, by which charge sharing is performed between the source bus line S1 and the source bus line S2 and between the source bus line S3 and the source bus line S4. During a charging period of an odd frame, the switching switches 61 and 65 and the short-circuit control switches 91 and 92 operate as shown in FIG. 23, by which a negative-polarity voltage is applied to the odd-column source bus lines S1 and S3 and a positive-polarity voltage is applied to the even-column source bus lines S2 and S4.

Figure 50:
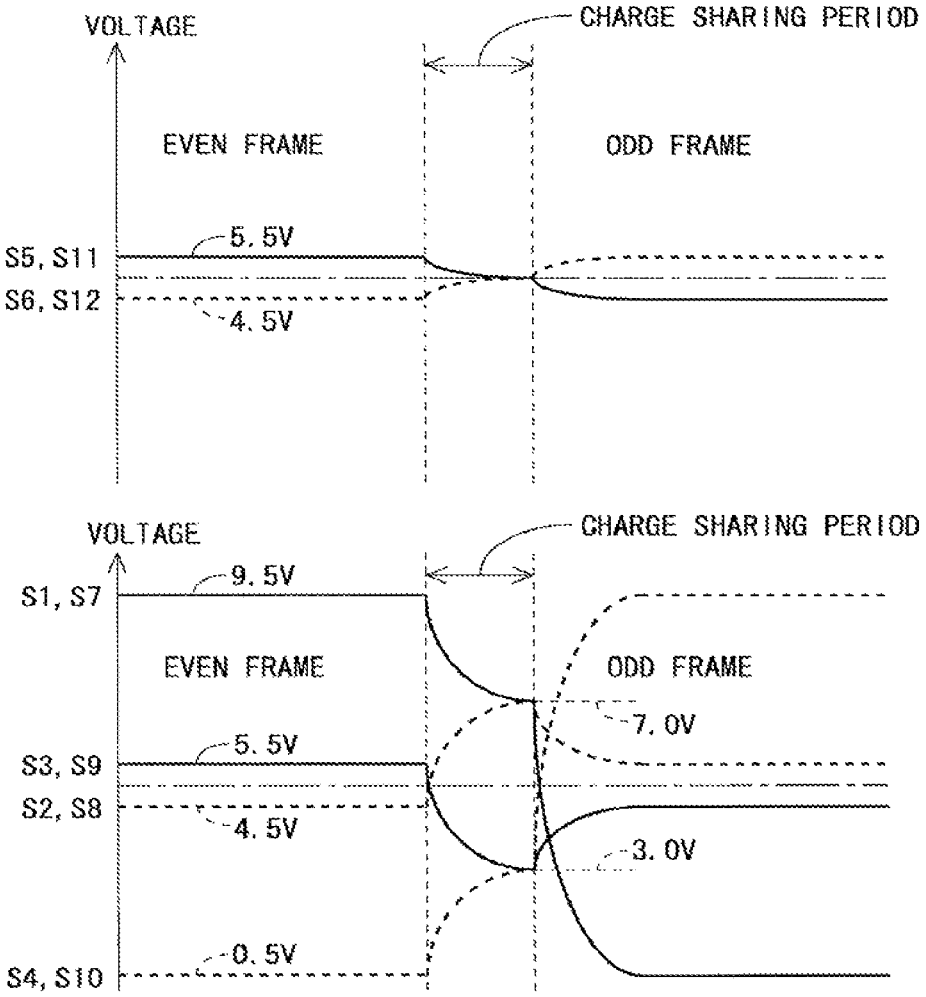
FIG. 50 is a waveform diagram showing changes in source voltage for when all-red display is performed in the second conventional configuration.

Taking into account the above operation, with reference to FIGS. 12, 13, and 50, changes in source voltage before and after switching frames will be described. When all-white display is performed and when all-black display is performed, the source voltages change in the same manner as in the first embodiment. That is, when all-white display is performed, the source voltages change as shown in FIG. 12, and when all-black display is performed, the source voltages change as shown in FIG. 13. Changes in source voltage for when all-red display is performed are already described in the "PROBLEMS TO BE SOLVED BY THE INVENTION" section. That is, when all-red display is performed, the source voltages change as shown in FIG. 50.

1.4 Power Consumption Comparison

Now, differences in power consumption between the first conventional configuration, the second conventional configuration, and the configuration according to the present embodiment will be described. Here, attention is focused on power required for the transition of source voltages upon switching from an even frame to an odd frame for when all-red display is performed. In addition, attention is focused on 12 source bus lines S1 to S12, and power required for the transition of the source voltages of the source bus lines S1 to S12 is denoted by P(S1) to P(S12). In addition, the total power required for the transition of the source voltages of the source bus lines S1 to S12 is denoted by P(total). Note that it is assumed that c (the wiring line capacitance of a source bus line) and f (reversal frequency) in an equation represented by "$P=cfV^2$" are constant.

1.4.1 Power Consumption in the First Conventional Configuration

First, power consumption in the first conventional configuration (a configuration in which charge sharing is not performed) will be described. For the source bus line S1, as can be grasped from 20, power for transitioning the source voltage from 9.5 V to 0.5 V needs to be supplied from the source driver 300. Therefore, power P(S1) is found as follows:

$$\begin{aligned} P(S1) &= cfV^2 \\ &= cf(0.5\ V - 9.5\ V)^2 \\ &= 81\ cf \end{aligned}$$

Likewise, P(S4), P(S7), and P(S10) are also 81 cf.

For the source bus line S2, as can be grasped from FIG. 20, power for transitioning the source voltage from 4.5 V to 5.5 V needs to be supplied from the source driver 300. Therefore, power P(S2) is found as follows:

$$\begin{aligned} P(S2) &= cfV^2 \\ &= cf(5.5\ V - 4.5\ V)^2 \\ &= cf \end{aligned}$$

Likewise, P(S3), P(S5), P(S6), P(S8), P(S9), P(S11), and P(S12) are also cf.

By the above, the total power P(total) required for the transition of the source voltages of the source bus lines S1 to S12 is found as follows:

$$\begin{aligned} P(\text{total}) &= 81\ cf \times 4 + cf \times 8 \\ &= 332\ cf \end{aligned}$$

1.4.2 Power Consumption in the Second Conventional Configuration

Next, power consumption in the second conventional configuration (a configuration in which charge sharing is performed between two adjacent source bus lines) will be described. For the source bus line S1, as can be grasped from FIG. 50, power for transitioning the source voltage from 7.0 V to 0.5 V needs to be supplied from the source driver 300. Therefore, power P(S1) is found as follows:

$$\begin{aligned} P(S1) &= cfV^2 \\ &= cf(0.5\ V - 7.0\ V)^2 \\ &= 42.25\ cf \end{aligned}$$

Likewise, P(S4), P(S7), and P(S10) are also 42.25 cf.

For the source bus line S2, as can be grasped from FIG. 50, power for transitioning the source voltage from 7.0 V to 5.5 V needs to be supplied from the source driver 300. Therefore, power P(S2) is found as follows:

$$\begin{aligned} P(S2) &= cfV^2 \\ &= cf(5.5\ V - 7.0\ V)^2 \\ &= 2.25\ cf \end{aligned}$$

Likewise, P(S3), P(S8), and P(S9) are also 2.25 cf.

For the source bus line S5, as can be grasped from FIG. 50, power for transitioning the source voltage from 5.0 V to 4.5 V needs to be supplied from the source driver 300. Therefore, power P(S5) is found as follows:

$$\begin{aligned} P(S5) &= cfV^2 \\ &= cf(4.5\ V - 5.0\ V)^2 \\ &= 0.25\ cf \end{aligned}$$

Likewise, P(S6), P(S11), and P(S12) are also 0.25 cf.

By the above, the total power P(total) required for the transition of the source voltages of the source bus lines S1 to S12 is found as follows:

$$\begin{aligned} P(\text{total}) &= 42.25\ cf \times 4 + 2.25\ cf \times 4 + 0.25\ cf \times 4 \\ &= 179\ cf \end{aligned}$$

1.4.3 Power Consumption in the Configuration According to the Present Embodiment Finally, power consumption in the configuration according to the present embodiment will be described. For the source bus line S1, as can be grasped from FIG. 14, power for transitioning the source voltage from 5.0 V to 0.5 V needs to be supplied from the source driver 300. Therefore, power P(S1) is found as follows:

$$P(S1) = cfV^2$$
$$= cf(0.5\ V - 5.0\ V)^2$$
$$= 20.25\ cf$$

Likewise, P(S4) is also 20.25 cf.

For the source bus line S2, as can be grasped from FIG. 14, power for transitioning the source voltage from 5.0 V to 5.5 V needs to be supplied from the source driver 300. Therefore, power P(S2) is found as follows:

$$P(S2) = cfV^2$$
$$= cf(5.5\ V - 5.0\ V)^2$$
$$= 0.25\ cf$$

Likewise, P(S3), P(S5), P(S8), P(S9), and P(S12) are also 0.25 cf.

For the source bus line S6, as can be grasped from FIG. 14, power for transitioning the source voltage from 7.0 V to 5.5 V needs to be supplied from the source driver 300, Therefore, power P(S6) is found as follows:

$$P(S6) = cfV^2$$
$$= cf(5.5\ V - 7.0\ V)^2$$
$$= 2.25\ cf$$

Likewise, P(S11) is also 2.25 cf.

For the source bus line S7, as can be grasped from FIG. 14, power for transitioning the source voltage from 7.0 V to 0.5 V needs to be supplied from the source driver 300. Therefore, power P(S7) is found as follows:

$$P(S7) = cfV^2$$
$$= cf(0.5\ V - 7.0\ V)^2$$
$$= 42.25\ cf$$

Likewise, P(S10) is also 42.25 cf.

By the above, the total power P(total) required for the transition of the source voltages of the source bus lines S1 to S12 is found as follows:

$$P(\text{total}) = 20.25\ cf \times 2 + 0.25\ cf \times 6 + 2.25\ cf \times 2 + 42.25\ cf \times 2$$
$$= 131\ cf$$

1.4.4 Conclusion

As described above, the power P(total) for the case of not adopting a charge sharing system is 332 cf, the power P(total) for the case of adopting the conventional charge sharing system is 179 cf, and the power P(total) for the case of adopting the charge sharing system according to the present embodiment is 131 cf. As can be grasped from the following expression, according to the present embodiment, the power P(total) is reduced by about 27% compared with the case of adopting the conventional charge sharing system.

(179−131)/179=about 27

As such, according to the present embodiment, power consumption is reduced over the conventional case.

Meanwhile, according to the conventional charge sharing system, as described above, upon performing all-red display, power loss occurs in one-third of all source bus lines. On the other hand, according to the present embodiment, upon performing all-red display, as can be grasped from FIG. 14, power loss occurs only in the source bus lines S6 and S11 among the source bus lines S1 to S12. That is, power loss occurs only in one-sixth of all source bus lines. Therefore, as described above, according to the present embodiment, power consumption is reduced over the conventional case.

1.5 Effect

According to the present embodiment, in a liquid crystal display device having pixels each composed of three subpixels, and adopting the source-reversal system as a polarity reversal system, with four source bus lines forming one set, charge sharing is performed between two outer source bus lines and between two inner source bus lines. Here, when attention is focused on two outer source bus lines among the source bus lines of each set, the two source bus lines are source bus lines for the same color (source bus lines connected to subpixels of the same color), and the polarity of a liquid crystal application voltage in each frame differs between one source bus line and the other source bus line. Hence, when, for example, single primary color display is performed, the overall amount of transition of source voltages by charge sharing increases over the conventional case. As such, in the present embodiment, even when an image that has not been able to sufficiently obtain an effect of reduction in power consumption by charge sharing in the conventional case is displayed, the effect of reduction in power consumption can be sufficiently obtained. As described above, a video signal line drive circuit using a charge sharing system that can achieve lower power consumption than the conventional case is implemented.

1.6 Variants

Variants of the first embodiment will be described below.

1.6.1 for Measures Against Parasitic Capacitances

Figure 24:
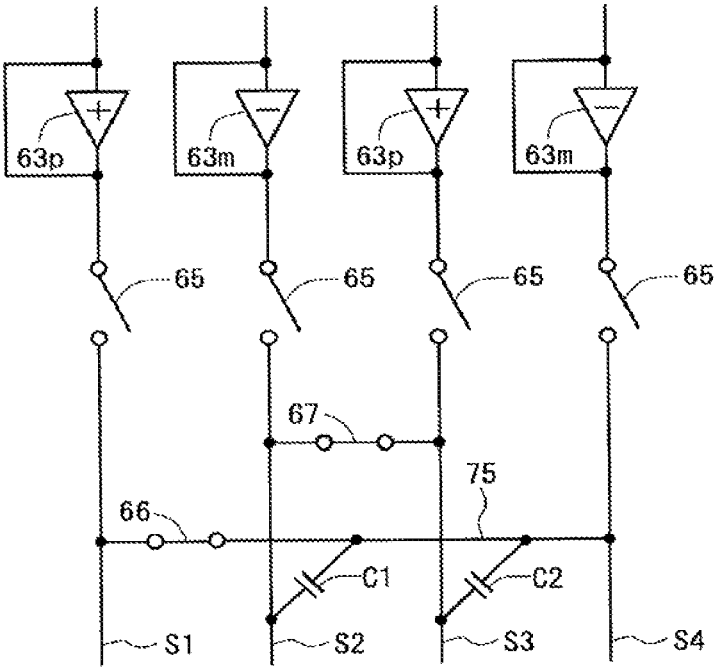
( RELATED ART ) Fig.24
FIG. 24 is a diagram for describing the occurrence of parasitic capacitances at intersection portions of video signal lines and a short-circuiting wiring line.

In the first embodiment, with four consecutive source bus lines forming one group, the charge sharing circuit 327 short-circuits the first and fourth source bus lines and short-circuits the second and third source bus lines in each group. Therefore, for example, when attention is focused on the source bus lines S1 to S4, as shown in FIG. 24, a short-circuiting wiring line 75 for short-circuiting the source bus line S1 and the source bus line S4 intersects the source bus lines S2 and S3. Hence, there is a concern about the occurrence of parasitic capacitances C1 and C2 at intersection portions.

Figure 25:
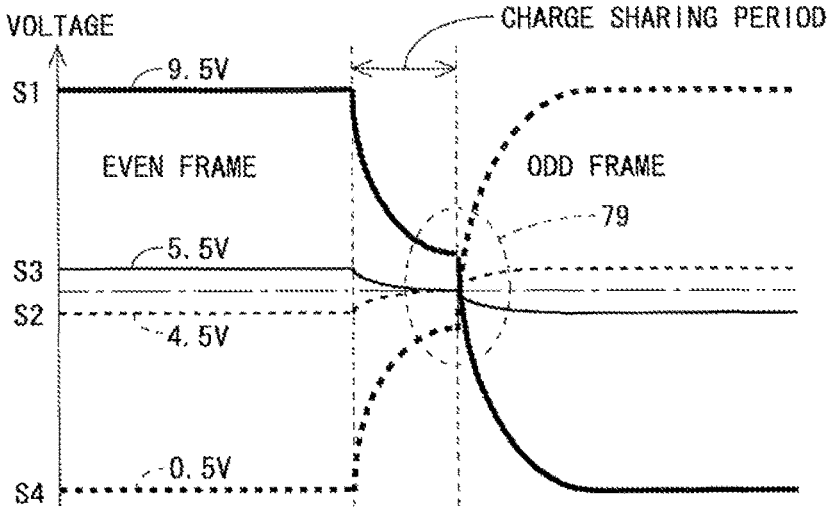
FIG. 25 is a waveform diagram for describing that source voltages do not sufficiently change during a charge sharing period due to the presence of the parasitic capacitances.

The speed of change in source voltage during a charge sharing period differs between charge sharing through a short-circuiting wiring line where parasitic capacitances have occurred and charge sharing through a short-circuiting wiring line where no parasitic capacitances have occurred. Specifically, the larger the parasitic capacitances occurring in a short-circuiting wiring line, the more gentle the change in source voltage. By the above, a difference may occur in a reaching rate for a potential assumed to be reached at the end time of a charge sharing period. For example, when all-red display is performed in the configuration of the first embodiment, the source voltages of the source bus lines S1 and S4 may not sufficiently change during a charge sharing period, as shown in a portion indicated by reference character 79 in FIG. 25. In view of this, measures such as those shown below may be taken.

<1.6.1.1 First Measures>

Figure 26:
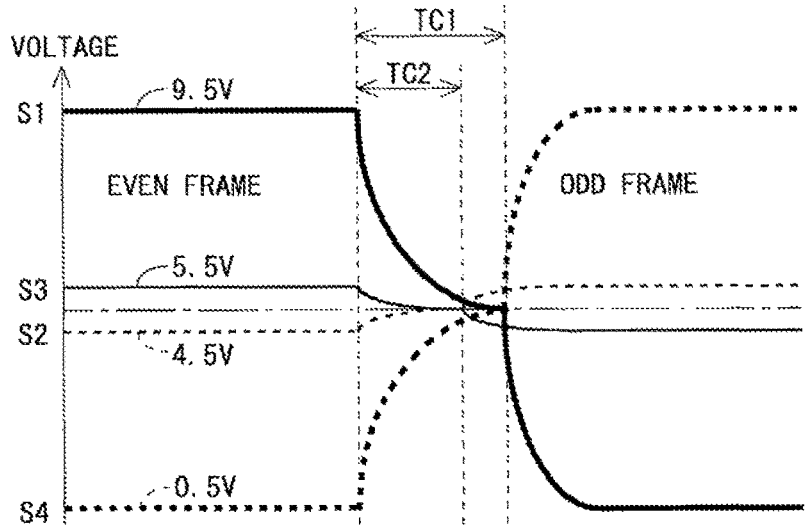
FIG. 26 is a waveform diagram for describing first measures as measures against the parasitic capacitances.
Figure 27:
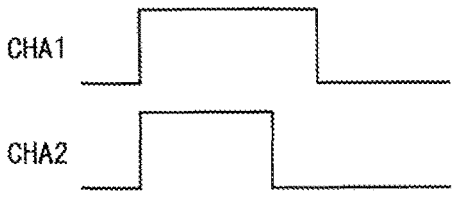
FIG. 27 is a signal waveform diagram for describing generation of two charge sharing control signals in the first measures.

As first measures, it is considered to set different lengths of charge sharing periods for charge sharing through a short-circuiting wiring line where parasitic capacitances have occurred and charge sharing through a short-circuiting wiring line where no parasitic capacitances have occurred. In the above-described example, as shown in FIG. 26, a charge sharing period TC1 during which charge sharing is performed between the source bus line S1 and the source bus line S4 is set to be longer than a charge sharing period TC2 during which charge sharing is performed between the source bus line S2 and the source bus line S3. To implement this, the configuration may be such that the charge sharing control circuit 326 (see FIG. 3) is configured to generate two charge sharing control signals CHA1 and CHA2 having different periods during which the signals are maintained at a high level, such as those shown in FIG. 27, and the charge sharing control signal CHA1 is provided to a gate electrode of the N-type TFT 71 provided between the source bus line S1 and the source bus line S4, and the charge sharing control signal CHA2 is provided to a gate electrode of the N-type TFT 72 provided between the source bus line S2 and the source bus line S3 (see FIG. 7).

As described above, in a configuration in which the first measures are taken as measures against parasitic capacitances occurring at intersection portions of source bus lines and a short-circuiting wiring line, the charge sharing circuit 327 sets longer time during which two source bus lines are short-circuited, for a larger difference between numbers assigned to two source bus lines forming each set.

<1.6.1.2 Second Measures>

Figure 28:
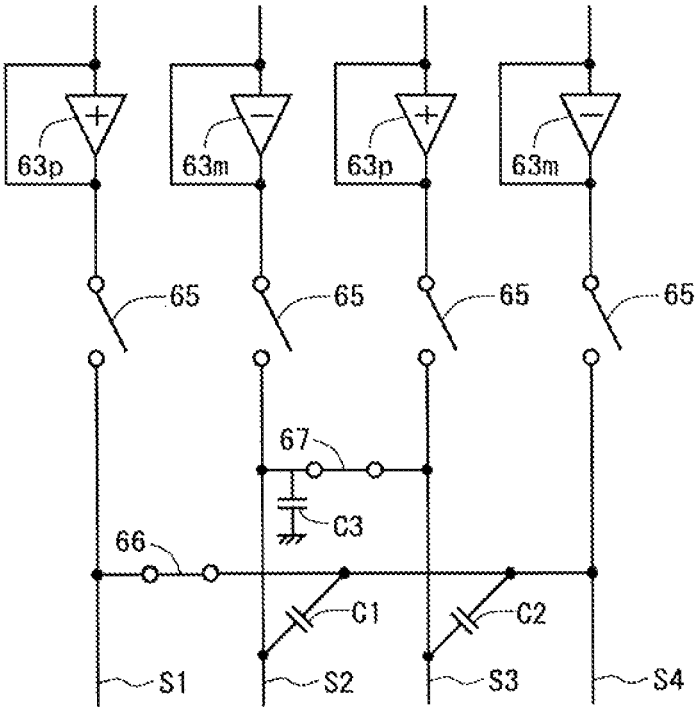
FIG. 28 is a diagram for describing second measures as measures against the parasitic capacitances.

As second measures, as shown in FIG. 28, it is considered to provide a capacitance C3 on a short-circuiting wiring line where no parasitic capacitances have occurred. More specifically, in an example shown in FIG. 28, when the capacitance values of parasitic capacitances C1 and C2 are also represented as C1 and C2, respectively, and the capacitance value of the capacitance C3 is also represented as C3, such a capacitance C3 that allows "C3=C1+C2" to hold true is provided on the short-circuiting wiring line where no parasitic capacitances have occurred. This suppresses the occurrence of a difference in reaching rate for a potential assumed to be reached at the end time of a charge sharing period, between source bus lines in which charge sharing is performed through a short-circuiting wiring line where parasitic capacitances have occurred and source bus lines in which charge sharing is performed through a short-circuiting wiring line where no parasitic capacitances have occurred.

As described above, in a configuration in which the second measures are taken as measures against parasitic capacitances occurring at intersection portions of source bus lines and a short-circuiting wiring line, a capacitance is provided on at least a short-circuiting wiring line for short-circuiting two source bus lines that form a set having the smallest difference between numbers assigned to two source bus lines in each group.

1.6.2 for Combinations of Source Bus Lines in which Charge Sharing is Performed In the first embodiment, with four source bus lines forming one group, charge sharing is performed between two outer source bus lines and between two inner source bus lines. However, the present invention is not limited thereto. Combinations of source bus lines in which charge sharing is performed are not particularly limited as long as the configuration is such that charge sharing is performed with two source bus lines forming one set, and that short-circuiting of source bus lines is performed such that the sum of numbers assigned to two source bus lines forming each set in each group is equal for all sets when it is assumed that K source bus lines (K is an even number greater than or equal to 4) form one group and the numbers from 1 to K are assigned to the K source bus lines.

Figure 29:
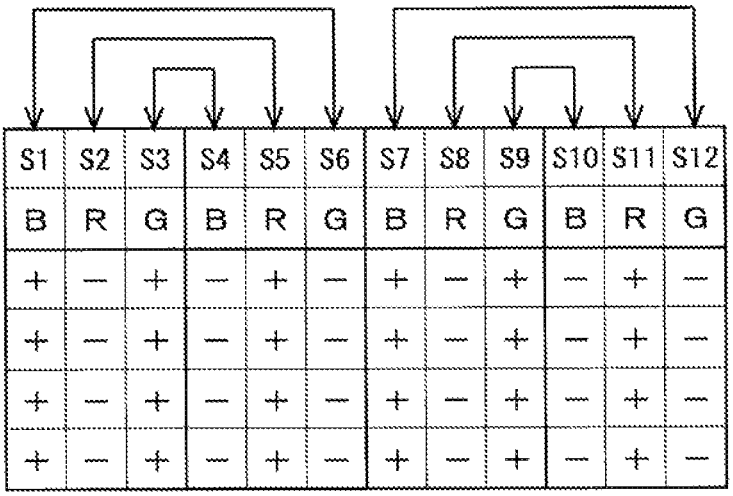
FIG. 29 is a schematic diagram for describing combinations of source bus lines used when charge sharing is performed with six source bus lines forming one group in a variant of the first embodiment.
Figure 30:
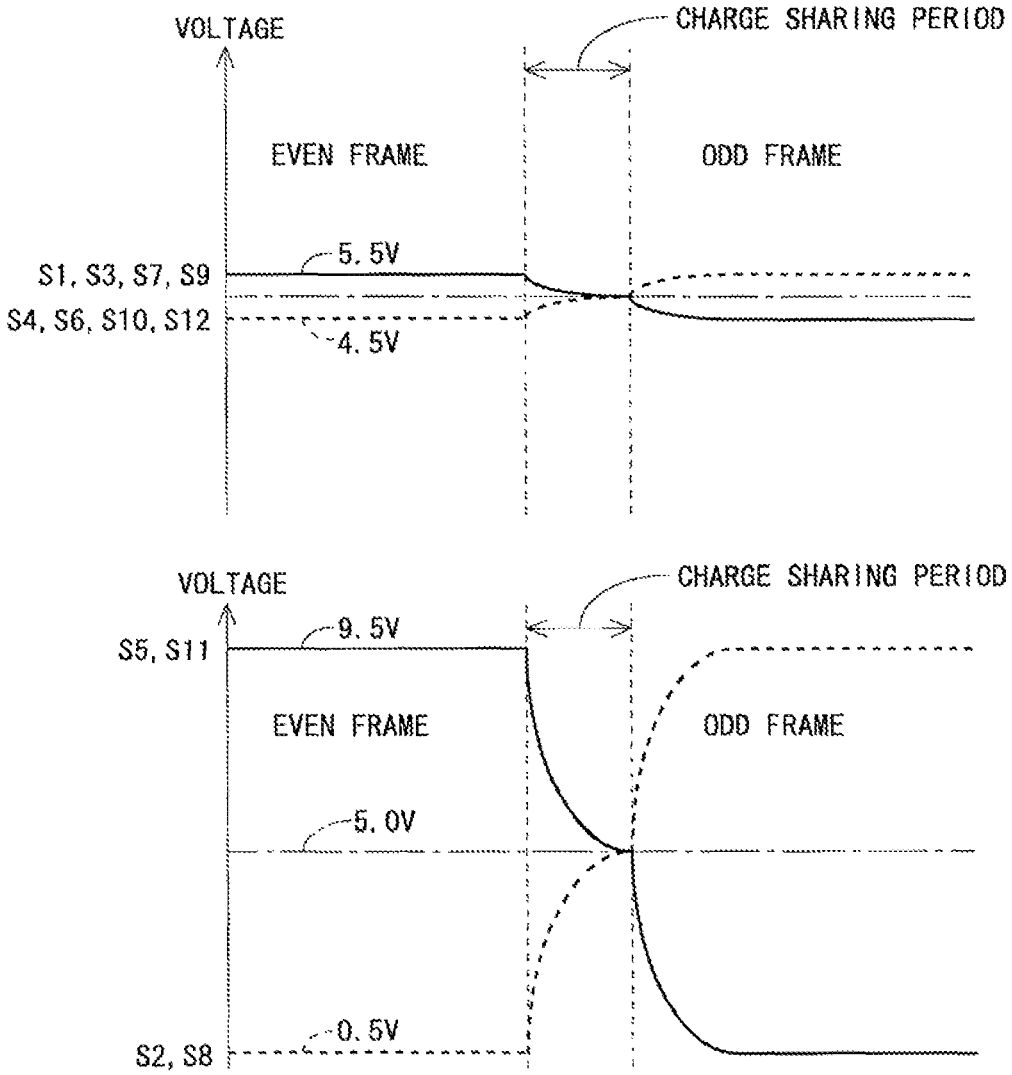
FIG. 30 is a waveform diagram showing changes in source voltage for when all-red display is performed with six source bus lines forming one group in the variant of the first embodiment.

For example, as shown in FIG. 29, six source bus lines can form one group. When attention is focused on sourced bus lines S1 to S6, charge sharing is performed between the source bus line S1 and the source bus line S6, between the source bus line S2 and the source bus line S5, and between the source bus line S3 and the source bus line S4. Such a configuration is repeated every six source bus lines. In this example, when all-red display is performed, source voltages change as shown in FIG. 30. It can be grasped from FIG. 30 that unlike the conventional charge sharing system (see FIG. 50), power loss does not occur.

1.6.3 for Polarity Reversal Systems

Figure 46:
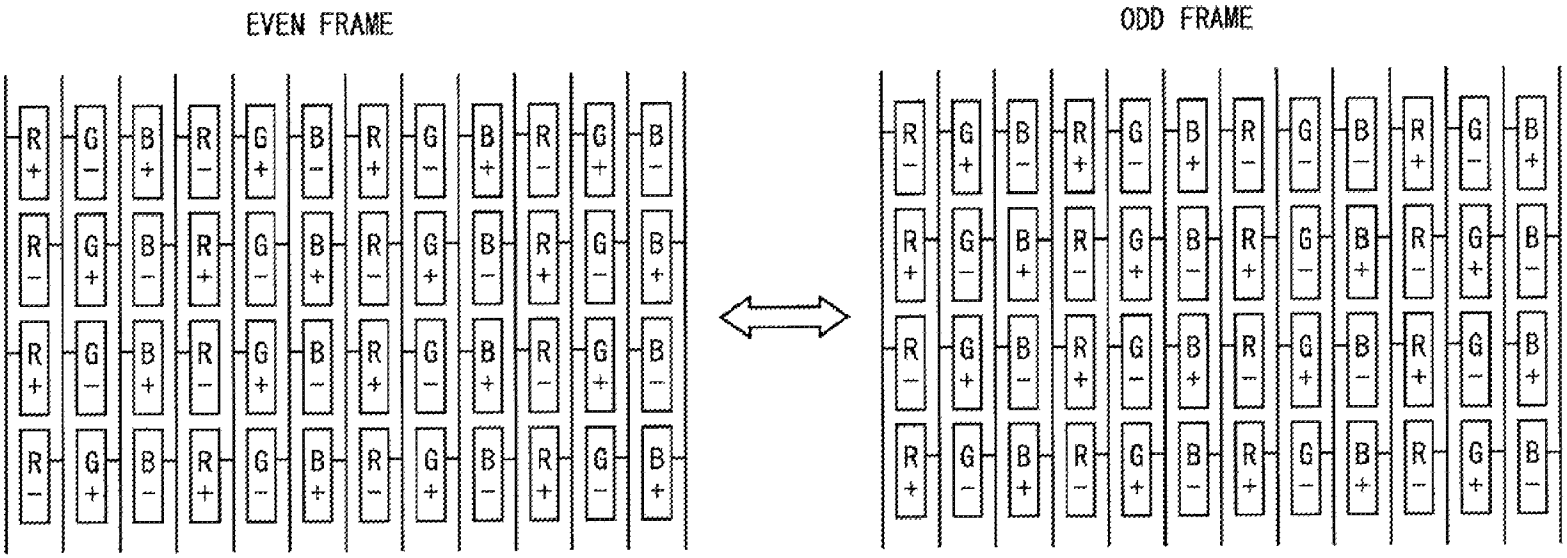
FIG. 46 is a diagram showing the arrangement of pixels and polarity changes at each pixel in a liquid crystal display device adopting a system called a "Z-reversal system".
Figure 47:
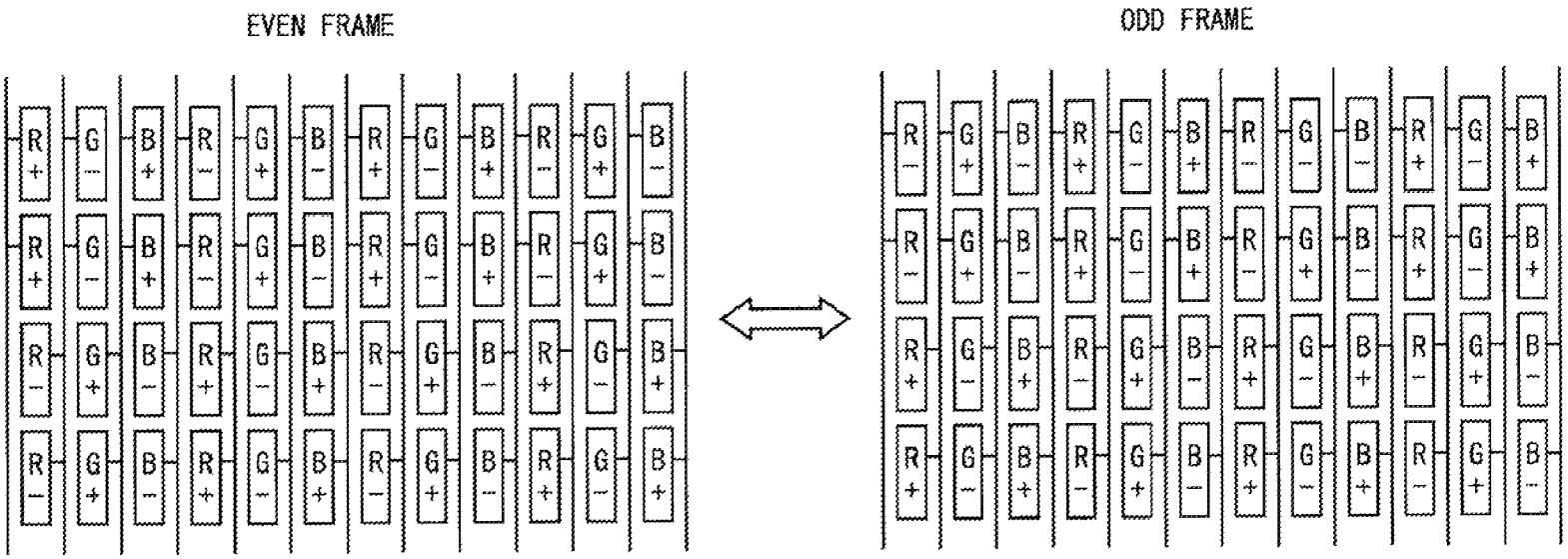
FIG. 47 is a diagram showing the arrangement of pixels and polarity changes at each pixel in a liquid crystal display device adopting a system called a "2H-Z-reversal system".
Figure 48:
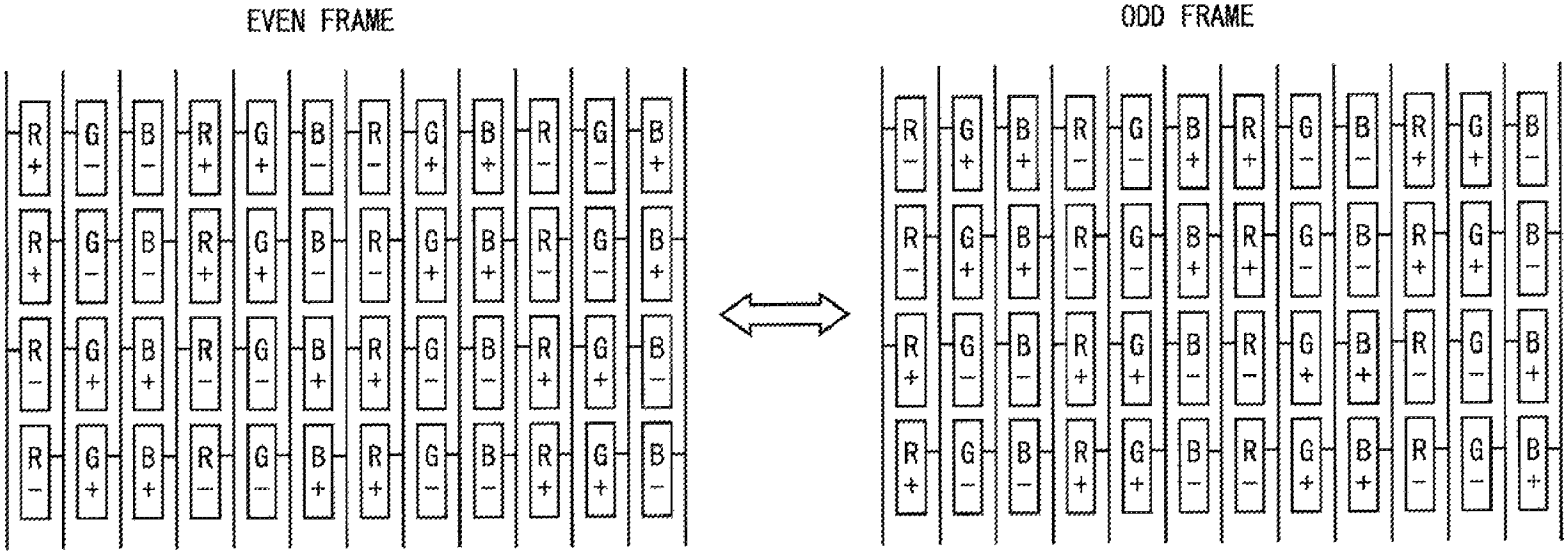
FIG. 48 is a diagram showing the arrangement of pixels and polarity changes at each pixel in a liquid crystal display device adopting a system in which the system called a "2H-Z-reversal system" and a system called a "2S-reversal system" are combined.

In the first embodiment, the source-reversal system is adopted as a polarity reversal system. However, the present invention is not limited thereto. The present invention can also be applied to a case in which other polarity reversal systems (see FIGS. 42, 43, 46, 47, and 48) than source-reversal system are adopted. Regarding this, by adopting the Z-reversal system (see FIG. 46), the 2H-Z-reversal system (see FIG. 47), or a system in which the 2H-Z-reversal system and the 2S-reversal system are combined (see FIG. 48), power consumption can be reduced and the occurrence of flicker can also be suppressed over the conventional case.

1.6.4 for the Configuration of the Output Circuit

In the first embodiment, the amplifiers provided in the buffer unit 62 of the output circuit 325 are separated into the amplifiers 63*p* for positive polarity and the amplifiers 63*m* for negative polarity. However, the present invention is not limited thereto. The present invention can also be applied to a configuration using amplifiers not separated into amplifiers for positive polarity and for negative polarity.

Figure 31:
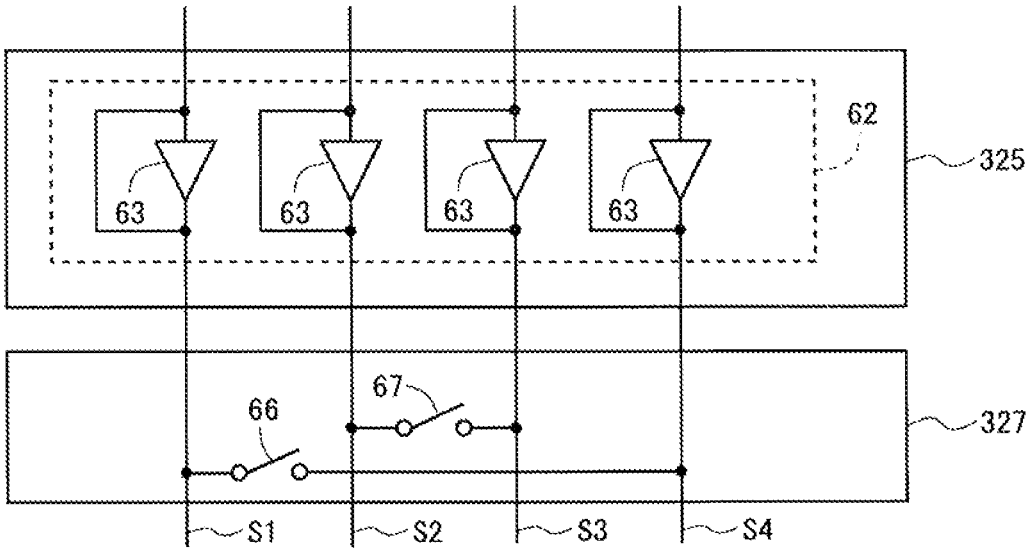
FIG. 31 is a circuit diagram showing a configuration of a portion near an output portion of a source driver (an output circuit and a charge sharing circuit) in a variant of the first embodiment.

FIG. 31 is a circuit diagram showing a configuration of a portion near an output portion (an output circuit and a charge sharing circuit) of a source driver for the case of using amplifiers not separated into amplifiers for positive polarity and for negative polarity. In this example, the output circuit 325 is composed of a buffer unit 62 including a plurality of amplifiers 63. That is, unlike the first embodiment, the output circuit 325 is not provided with the first switching unit 60 and the second switching unit 64. Therefore, the circuit size is reduced over the first embodiment.

2. Second Embodiment

A second embodiment of the present invention will be described. Note that description of the same respects as those in the first embodiment is omitted.

2.1 Configuration

Figure 32:
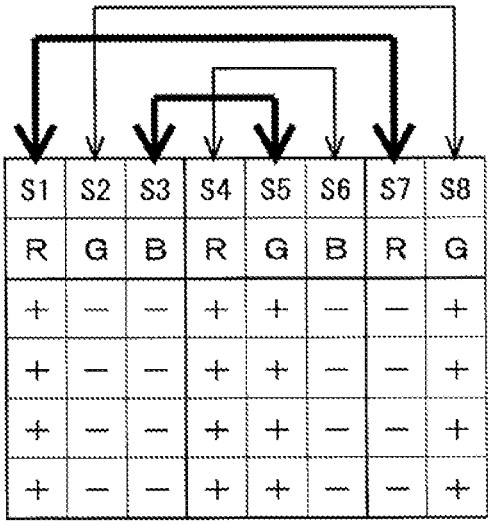
FIG. 32 is a schematic diagram for describing combinations of source bus lines used when an active matrix-type liquid crystal display device according to a second embodiment of the present invention performs charge sharing.

2.1.1 Combinations of Source Bus Lines in which Charge Sharing is Performed FIG. 32 is a schematic diagram for describing combinations of source bus lines in which charge sharing is performed. In the present embodiment, as shown in FIG. 32, when attention is focused on eight consecutive source bus lines S1 to S8, odd-column source bus lines S1, S3, S5, and S7 form one group, and even-column source bus lines S2, S4, S6, and S8 form another group. Then, in each group, charge sharing is performed between two outer source bus lines and between two inner source bus lines. In addition, in the present embodiment, a system called "2S reversal" is adopted as a polarity reversal system. In this system, spatially, the polarity is reversed every two source bus lines. By the above, in the present embodiment, too, as can be grasped from FIG. 32, charge sharing is performed between two source bus lines to which voltages of different polarities are applied in each frame.

2.1.2 Configuration of a Portion Near an Output Portion (an Output Circuit and a Charge Sharing Circuit)

Figure 33:
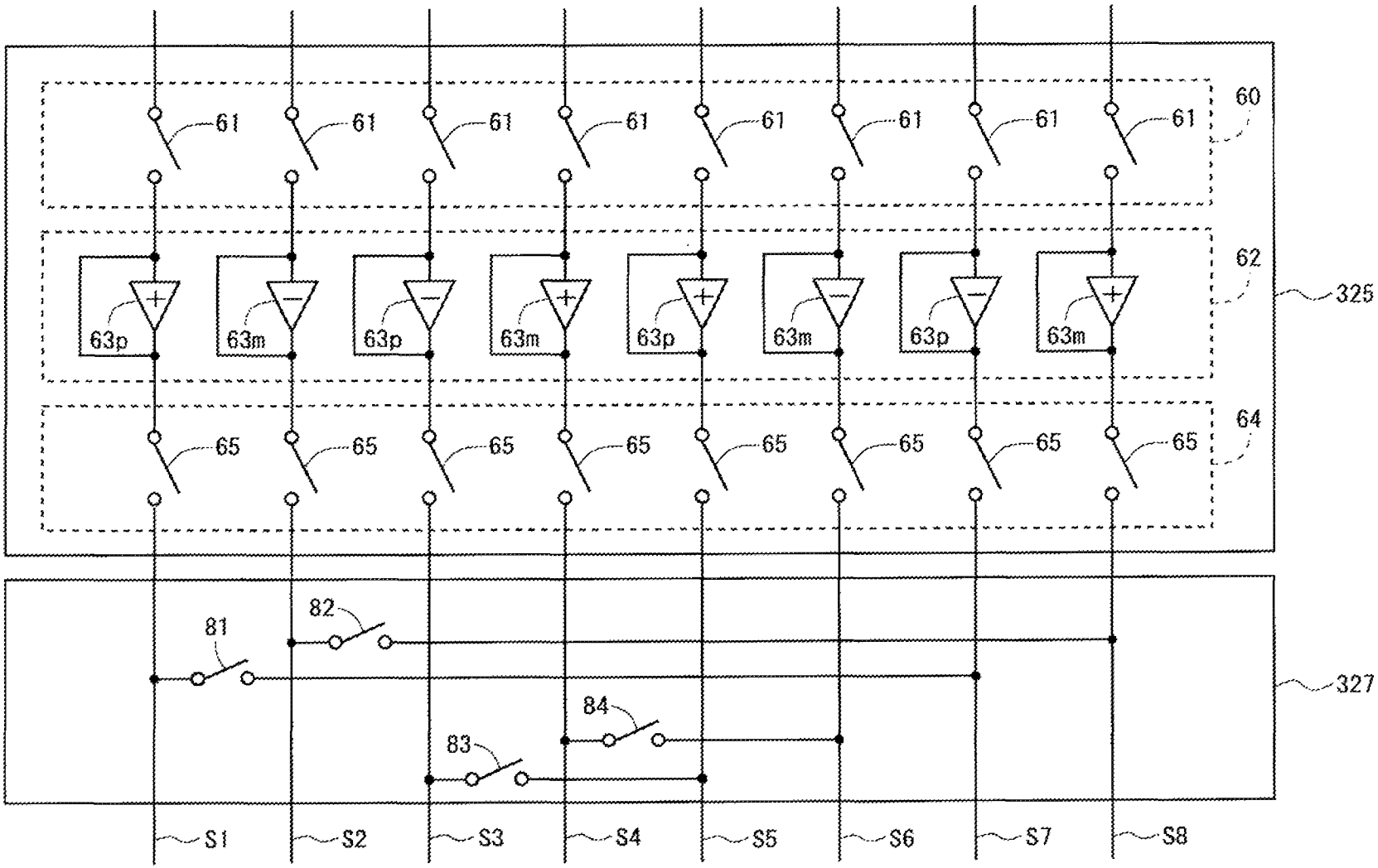
FIG. 33 is a circuit diagram showing a configuration of a portion near an output portion of a source driver (an output circuit and a charge sharing circuit) in the second embodiment.

FIG. 33 is a circuit diagram showing a configuration of a portion near an output portion (an output circuit 325 and a charge sharing circuit 327) of a source driver 300. Note that FIG. 33 only shows a portion corresponding to eight source bus lines S1 to S8.

The output circuit 325 has the same configuration as that of the first embodiment (see FIG. 5). The charge sharing circuit 327 is composed of a short-circuit control switch 81 that controls a short circuit between the source bus line S1 and the source bus line S7; a short-circuit control switch 82 that controls a short circuit between the source bus line S2 and the source bus line S8; a short-circuit control switch 83 that controls a short circuit between the source bus line S3 and the source bus line S5; and a short-circuit control switch 84 that controls a short circuit between the source bus line S4 and the source bus line S6. The operation of the short-circuit control switches 81 to 84 is controlled by a charge sharing control signal CHA.

2.2 Drive Method

2.2.1 Operation of the Portion Near the Output Portion

Figure 34:
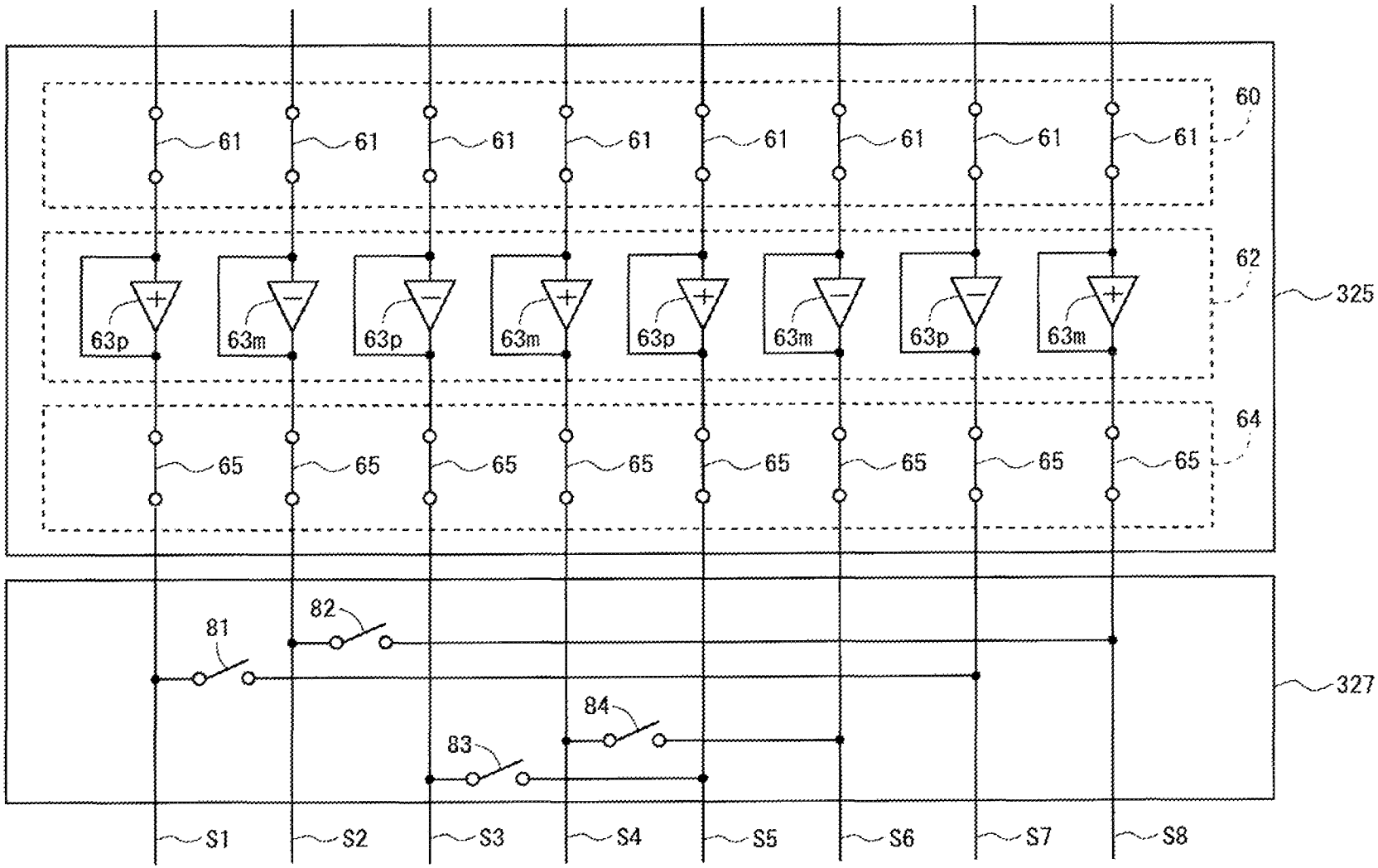
FIG. 34 is a diagram showing a connection state for a charging period (effective vertical scanning period) of an even frame in the second embodiment.
Figure 35:
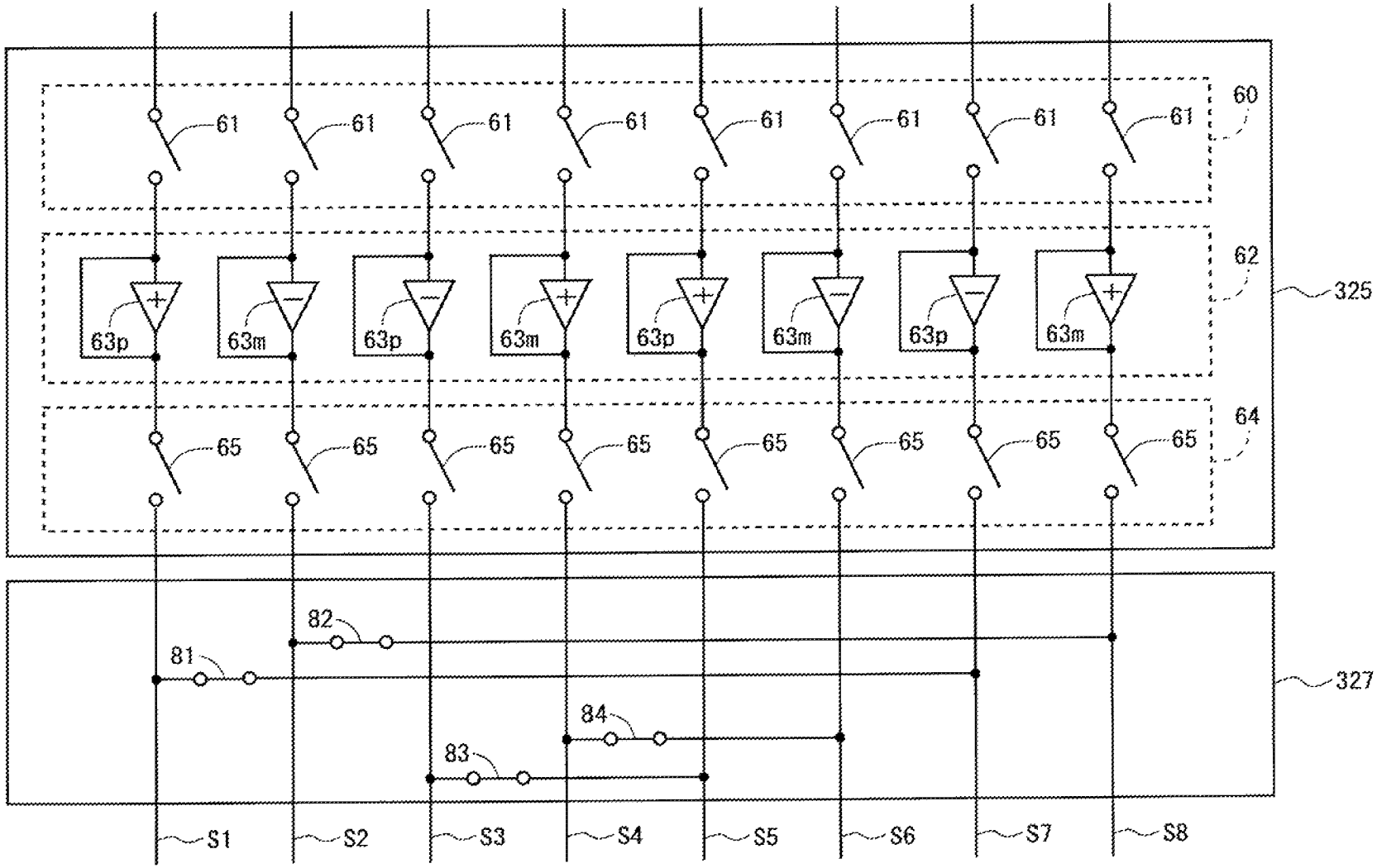
FIG. 35 is a diagram showing a connection state for a charge sharing period in the second embodiment.
Figure 36:
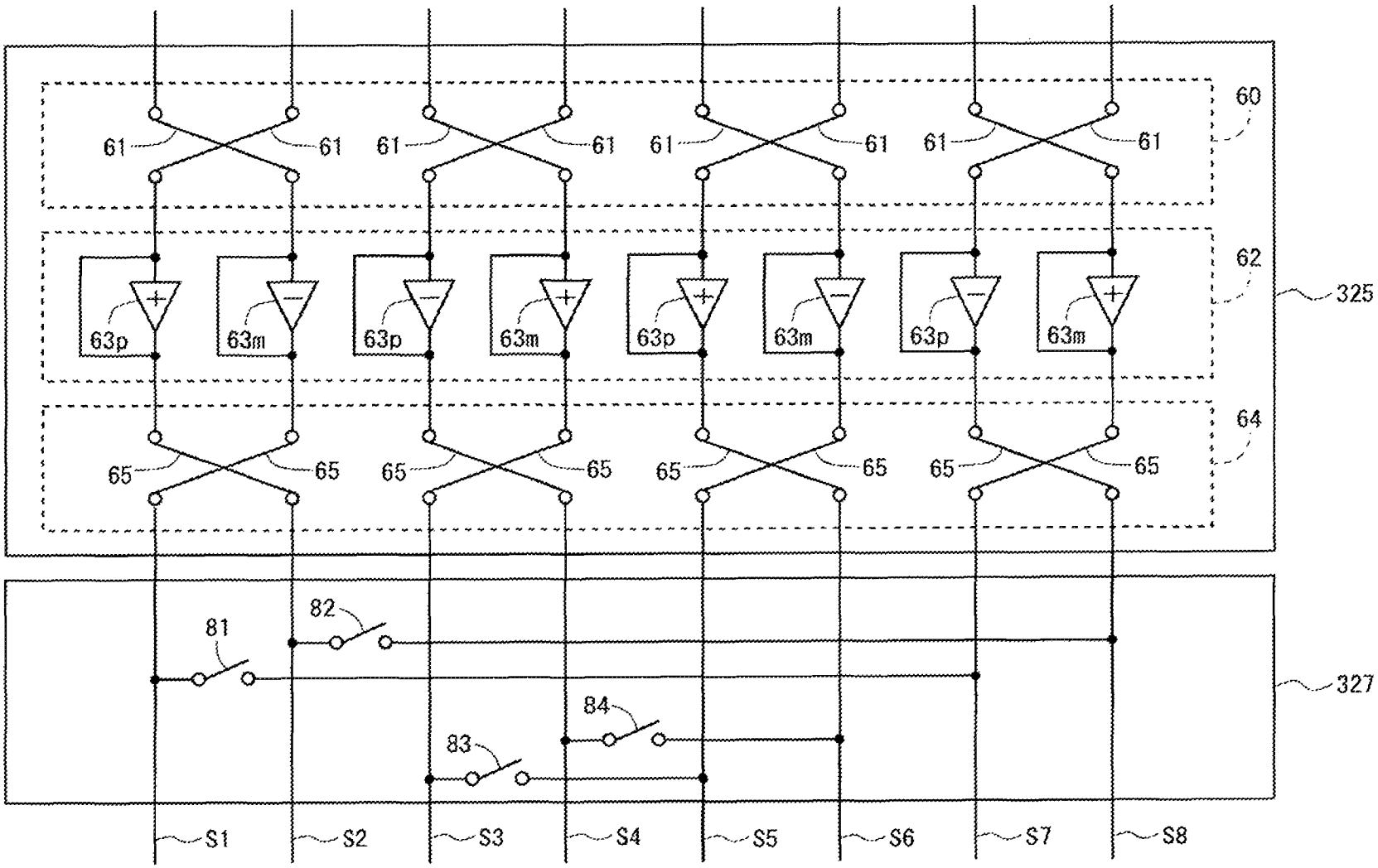
FIG. 36 is a diagram showing a connection state for a charging period (effective vertical scanning period) of an odd frame in the second embodiment.

The operation of the portion near the output portion (the output circuit 325 and the charge sharing circuit 327) of the source driver 300 will be described. FIG. 34 is a diagram showing a connection state for a charging period (effective vertical scanning period) of an even frame. FIG. 35 is a diagram showing a connection state for a charge sharing period. FIG. 36 is a diagram showing a connection state for a charging period (effective vertical scanning period) of an odd frame. Note that here attention is focused on the source bus lines S1 to S8.

Changes in the waveforms of a polarity control signal POL and a charge sharing control signal CHA are the same as those of the first embodiment (see FIG. 8). During the charging period of the even frame, the switching switches 61 and 65 and the short-circuit control switches 81 to 84 operate as shown in FIG. 34, by which a positive-polarity voltage is applied to the source bus lines S1, S4, S5, and S8, and a negative-polarity voltage is applied to the source bus lines S2, S3, S6, and S7. During the charge sharing period, the switching switches 61 and 65 and the short-circuit control switches 81 to 84 operate as shown in FIG. 35, by which charge sharing is performed between the source bus line S1 and the source bus line S7, between the source bus line S2 and the source bus line S8, between the source bus line S3 and the source bus line S5, and between the source bus line S4 and the source bus line S6. During the charging period of the odd frame, the switching switches 61 and 65 and the short-circuit control switches 81 to 84 operate as shown in FIG. 36, by which a negative-polarity voltage is applied to the source bus lines S1, S4, S5, and S8, and a positive-polarity voltage is applied to the source bus lines S2, S3, S6, and S7.

2.2.2 Changes in Source Voltage

Next, with reference to FIG. 37, changes in source voltage before and after switching frames upon performing all-red display will be described. Note that here attention is focused on the source bus lines S1 to S8. Note also that in the present embodiment, too, it is assumed that normally black mode is adopted as a display mode. Furthermore, it is assumed that the voltage of the common electrode is 5.0 V, the maximum value of the source application voltage is 9.5 V, and the minimum value of the source application voltage is 0.5 V.

Figure 37:
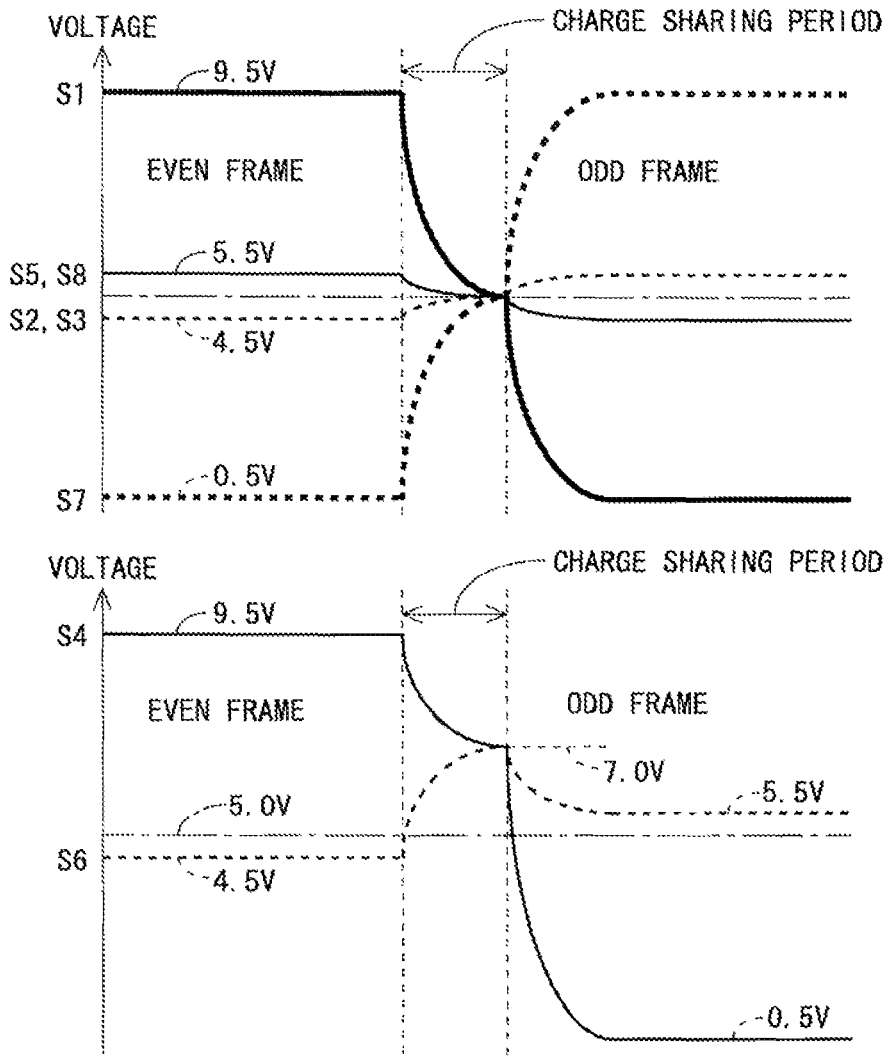
FIG. 37 is a waveform diagram showing changes in source voltage for when all-red display is performed in the second embodiment.

When all-red display is performed, the source voltages change as shown in FIG. 37. In an even frame, the source voltages of the source bus lines S1 and S4 are 9.5 V, the source voltages of the source bus lines S5 and S8 are 5.5 V, the source voltages of the source bus lines S2, S3, and S6 are 4.5 V, and the source voltage of the source bus line S7 is 0.5 V.

When a charge sharing period has come, charge sharing is performed using the above-described combinations. When attention is focused on the source bus lines S2, S3, S5, and S8, charge sharing is performed between a source bus line with a source voltage of 5.5 V and a source bus line with a source voltage of 4.5 V. Therefore, the source voltages of the source bus lines S2, S3, S5, and S8 approach 5.0 V. In addition, charge sharing is performed between the source bus line S1 with a source voltage of 9.5 V and the source bus line S7 with a source voltage of 0.5 V. Therefore, the source voltages of the source bus lines S1 and S7 approach 5.0 V. Furthermore, charge sharing is performed between the source bus line S4 with a source voltage of 9.5 V and the source bus line S6 with a source voltage of 4.5 V. Therefore, the source voltages of the source bus lines S4 and S6 approach 7.0 V.

After the charge sharing period ends, a voltage of an opposite polarity to that for the even frame is applied to each source bus line. By this, in an odd frame, the source voltages of the source bus lines S1 and S4 become 0.5 V, the source voltages of the source bus lines S5 and S8 become 4.5 V, the source voltages of the source bus lines S2, S3, and S6 become 5.5 V, and the source voltage of the source bus line S7 becomes 9.5 V.

2.2.3 Comparison Example

Now, as a comparison example, the operation of a portion near an output portion and changes in source voltage for a case of adopting 2S reversal as a polarity reversal system in the above-described second conventional configuration (a configuration in which charge sharing is performed between two adjacent source bus lines) will be described. Note that short-circuit control switches are denoted by reference characters 91*a* to 91*d* (see FIGS. 38 to 40).

Figure 38:
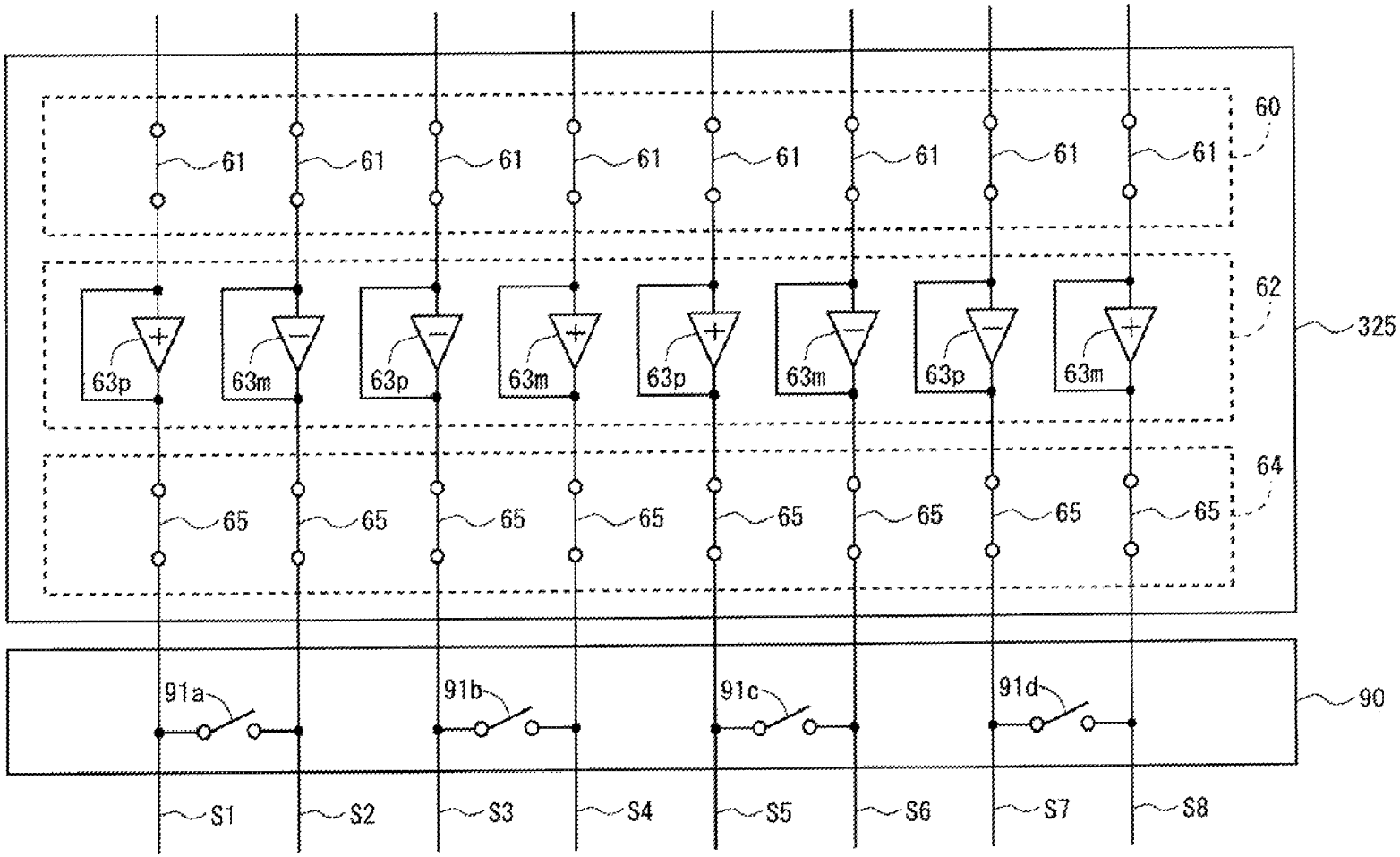
FIG. 38 is a diagram showing a connection state for a charging period (effective vertical scanning period) of an even frame in the second conventional configuration.
Figure 39:
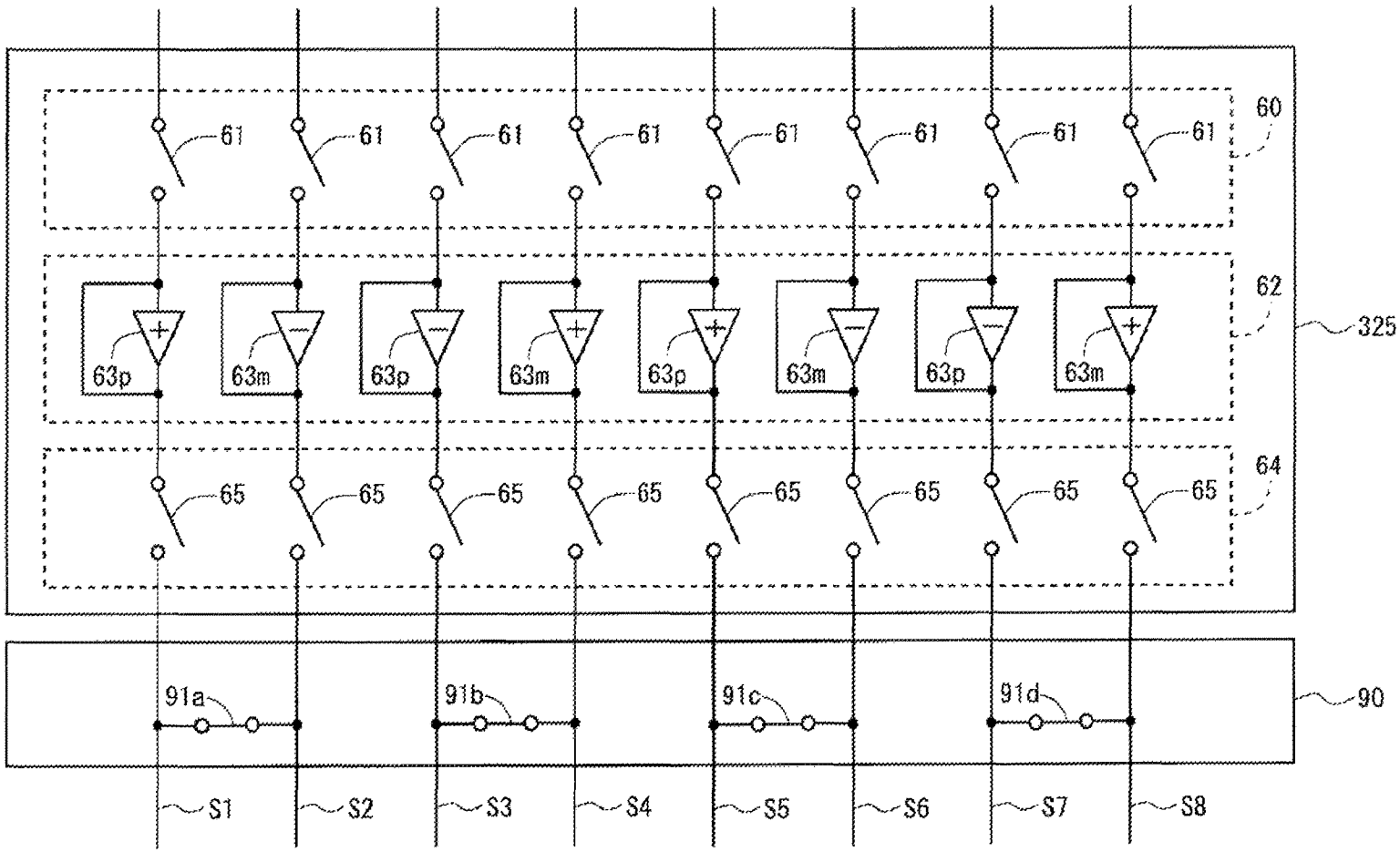
FIG. 39 is a diagram showing a connection state for a charge sharing period in the second conventional configuration.
Figure 40:
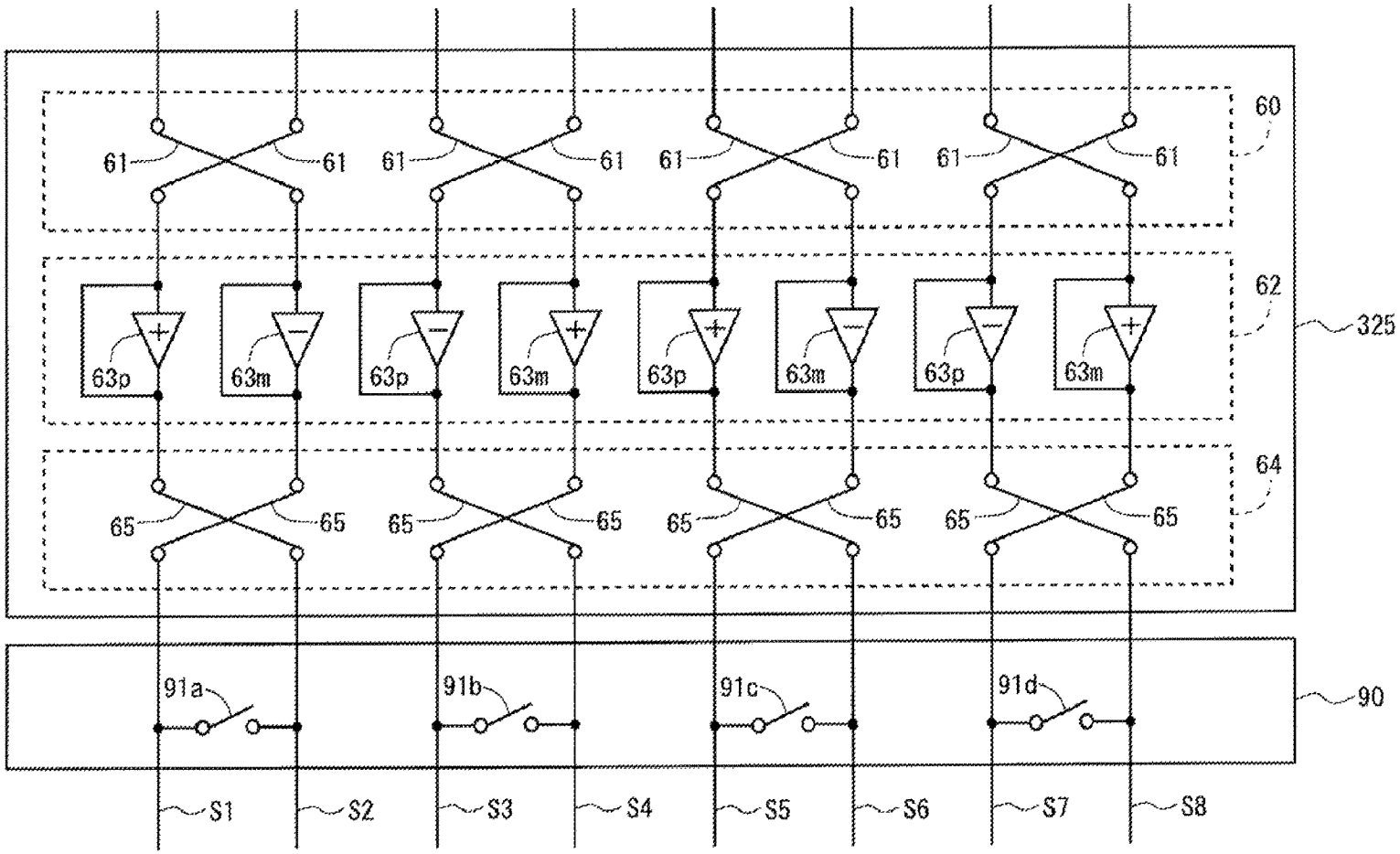
FIG. 40 is a diagram showing a connection state for a charging period (effective vertical scanning period) of an odd frame in the second conventional configuration.

First, with reference to FIGS. 38 to 40, the operation of a portion near an output portion of the second conventional configuration will be described. During a charging period of an even frame, switching switches 61 and 65 and short-circuit control switches 91*a* to 91*d* operate as shown in FIG. 38, by which a positive-polarity voltage is applied to source bus lines S1, S4, S5, and S8 and a negative-polarity voltage is applied to source bus lines S2, S3, S6, and S7. During a charge sharing period, the switching switches 61 and 65 and the short-circuit control switches 91*a* to 91*d* operate as shown in FIG. 39, by which charge sharing is performed between the source bus line S1 and the source bus line S2, between the source bus line S3 and the source bus line S4, between the source bus line S5 and the source bus line S6, and between the source bus line S7 and the source bus line S8. During a charging period of an odd frame, the switching switches 61 and 65 and the short-circuit control switches 91*a* to 91*d* operate as shown in FIG. 40, by which a negative-polarity voltage is applied to the source bus lines S1, S4, S5, and S8 and a positive-polarity voltage is applied to the source bus lines S2, S3, S6, and S7.

Next, with reference to FIG. 41, changes in source voltage before and after switching frames upon performing all-red display will be described. Note that here attention is focused on 12 source bus lines S1 to S12.

In an even frame, the source voltages of the source bus lines S1 and S4 are 9.5 V, the source voltages of the source bus lines S5, S8, S9, and S12 are 5.5 V, the source voltages of the source bus lines S2, S3, S6, and S11 are 4.5 V, and the source voltages of the source bus lines S7 and S10 are 0.5 V.

Figure 49:
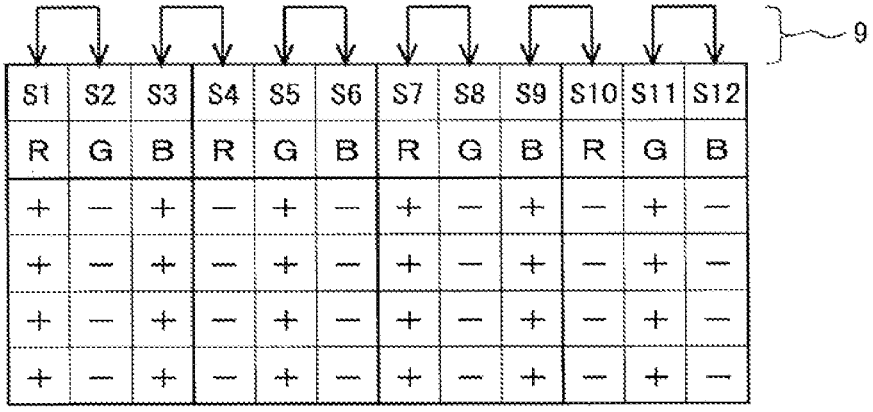
FIG. 49 is a schematic diagram for describing combinations of source bus lines used when charge sharing is performed in a conventional example.

When a charge sharing period has come, charge sharing is performed between two adjacent source bus lines (charge sharing is performed using the combinations shown in FIG. 49). When attention is focused on the source bus lines S5, S6, S11, and S12, charge sharing is performed between a source bus line with a source voltage of 5.5 V and a source bus line with a source voltage of 4.5 V. Therefore, the source voltages of the source bus lines S5, S6, S11, and S12 approach 5.0 V. In addition, when attention is focused on the source bus lines S1, S2, S3, and S4, charge sharing is performed between a source bus line with a source voltage of 9.5 V and a source bus line with a source voltage of 4.5 V. Therefore, the source voltages of the source bus lines S1, S2, S3, and S4 approach 7.0 V. Furthermore, when attention is focused on the source bus lines S7, S8, S9, and S10, charge sharing is performed between a source bus line with a source voltage of 5.5 V and a source bus line with a source voltage of 0.5 V. Therefore, the source voltages of the source bus lines S7, S8, S9, and S10 approach 3.0 V.

After the charge sharing period ends, a voltage of an opposite polarity to that for the even frame is applied to each source bus line. By this, in an odd frame, the source voltages of the source bus lines S1 and S4 become 0.5 V, the source voltages of the source bus lines S5, S8, S9, and S12 become 4.5 V, the source voltages of the source bus lines S2, S3, S6, and S11 become 5.5 V, and the source voltages of the source bus lines S7 and S10 become 9.5 V.

2.3 Power Consumption Comparison

Now, a difference in power consumption between the second conventional configuration and the configuration according to the present embodiment will be described. Here, attention is focused on power required for the transition of source voltages upon switching from an even frame to an odd frame for when all-red display is performed. Note that the same denotations as those of the above-described first embodiment are used.

2.3.1 Power Consumption in the Second Conventional Configuration

First, power consumption in the second conventional configuration (a configuration in which charge sharing is performed between two adjacent source bus lines) will be described. For the source bus line S1, as can be grasped from FIG. 41, power for transitioning the source voltage from 7.0 V to 0.5 V needs to be supplied from the source driver 300. Therefore, P(S1) is 42.25 cf. Likewise, P(S4), P(S7), and P(S10) are also 42.25 cf.

Figure 41:
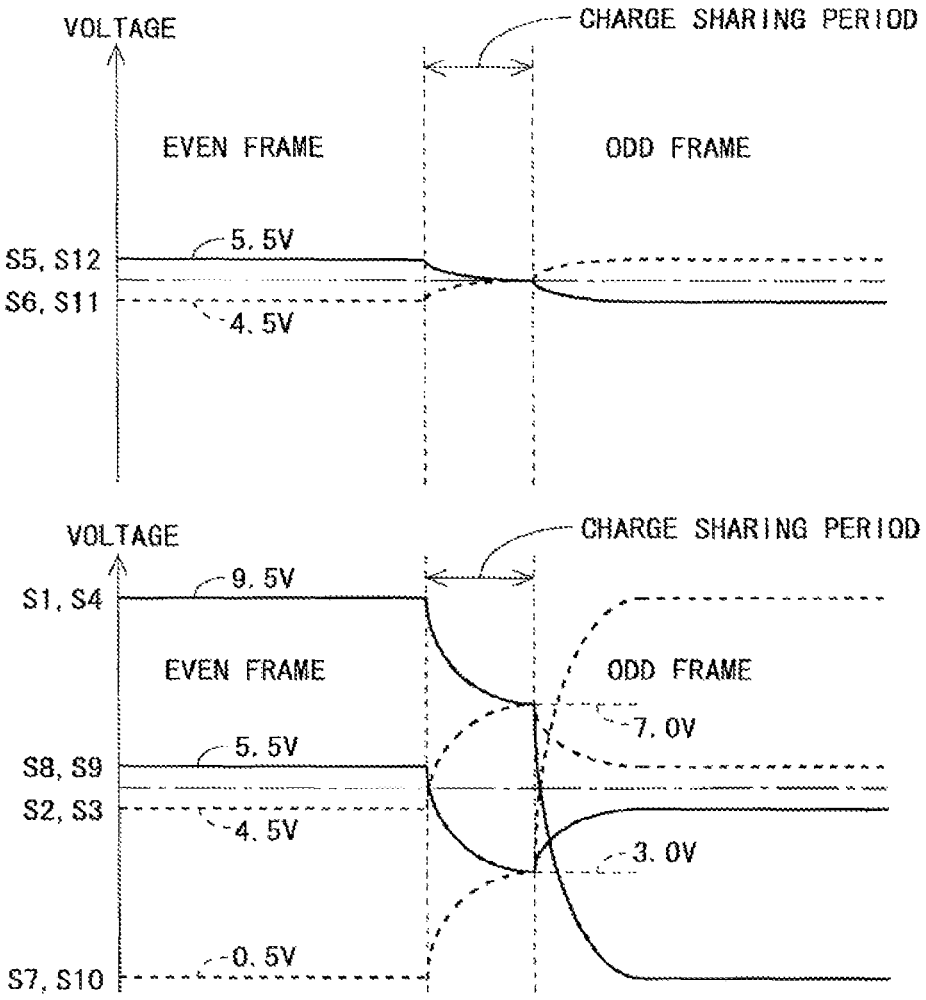
FIG. 41 is a waveform diagram showing changes in source voltage for when all-red display is performed in the second conventional configuration.
Figure 42:
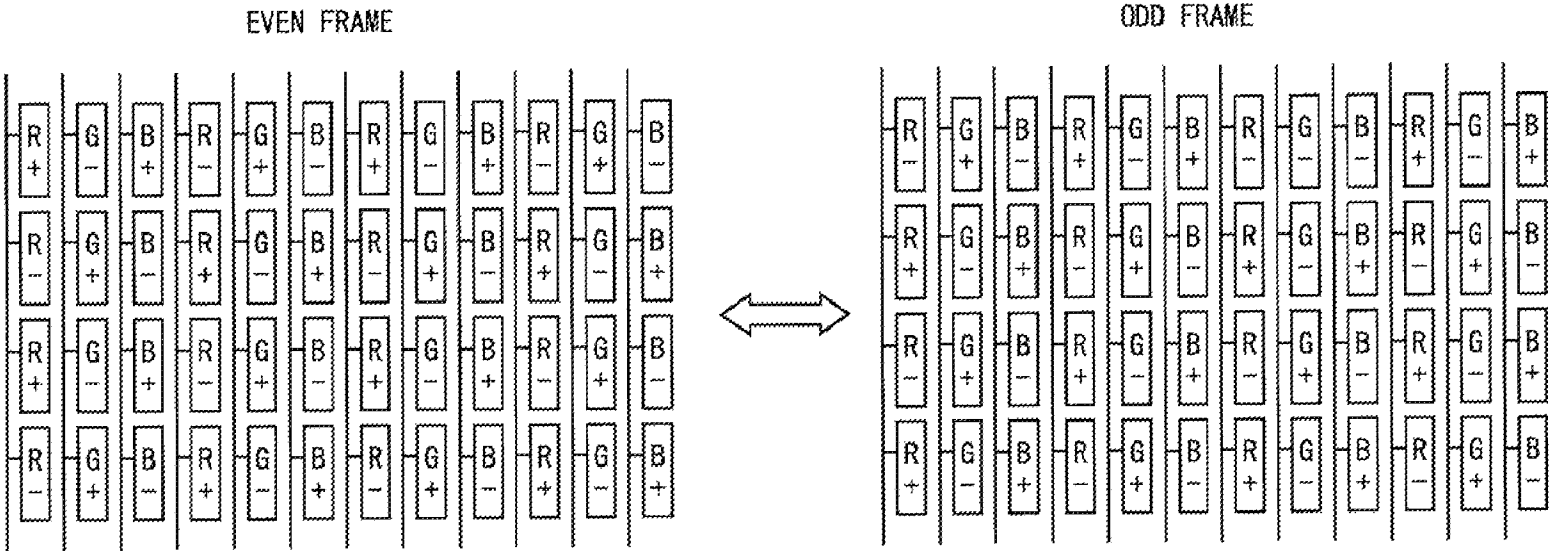
FIG. 42 is a diagram showing the arrangement of pixels and polarity changes at each pixel in a liquid crystal display device adopting a system called a "dot-reversal system".
Figure 43:
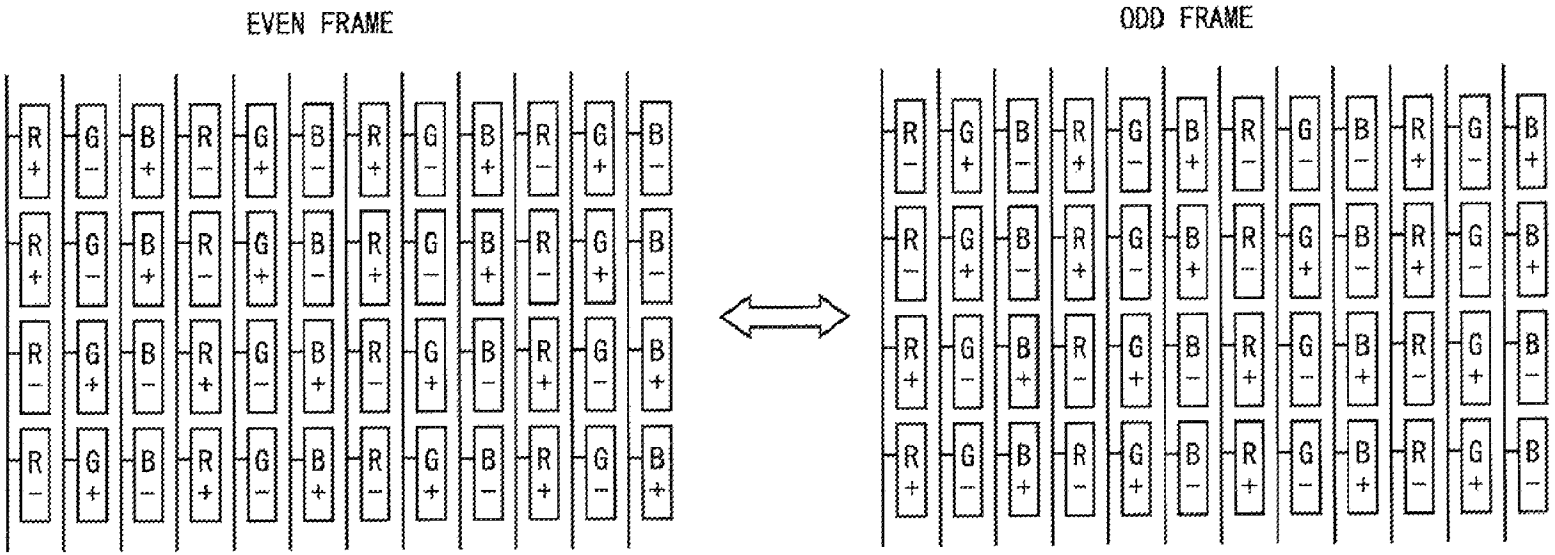
FIG. 43 is a diagram showing the arrangement of pixels and polarity changes at each pixel in a liquid crystal display device adopting a system called a "two-dot-reversal system".

For the source bus line S2, as can be grasped from FIG. 41, power for transitioning the source voltage from 7.0 V to 5.5 V needs to be supplied from the source driver 300. Therefore, P(S2) is 2.25 cf. Likewise, P(S3), P(S8), and P(S9) are also 2.25 cf.

For the source bus line S5, as can be grasped from FIG. 41, power for transitioning the source voltage from 5.0 V to 4.5 V needs to be supplied from the source driver 300. Therefore, P(S5) is 0.25 cf. Likewise, P(S6), P(S11), and P(S12) are also 0.25 cf.

By the above, the total power P(total) required for the transition of the source voltages of the source bus lines S1 to S12 is found as follows:

$$P(\text{total}) = 42.25\ cf \times 4 + 2.25\ cf \times 4 + 0.25\ cf \times 4$$
$$= 179\ cf$$

2.3.2 Power Consumption in the Present Embodiment

Next, power consumption in the configuration according to the present embodiment will be described. For the source bus line S1, as can be grasped from FIG. 37, power for transitioning the source voltage from 5.0 V to 0.5 V needs to be supplied from the source driver 300. Therefore, P(S1) is 20.25 cf. Likewise, P(S7) is also 20.25 cf.

For the source bus line S2, as can be grasped from FIG. 37, power for transitioning the source voltage from 5.0 V to 5.5 V needs to be supplied from the source driver 300. Therefore, P(S2) is 0.25 cf. Likewise, P(S3), P(S5), and P(S8) are also 0.25 cf.

For the source bus line S6, as can be grasped from FIG. 37, power for transitioning the source voltage from 7.0 V to 5.5 V needs to be supplied from the source driver 300. Therefore, P(S6) is 2.25 cf.

For the source bus line S4, as can be grasped from FIG. 37, power for transitioning the source voltage from 7.0 V to 0.5 V needs to be supplied from the source driver 300. Therefore, P(S4) is 42.25 cf.

By the above, the total power P(total) required for the transition of the source voltages of the source bus lines S1 to S8 is found as follows:

$$P(\text{total}) = 20.25\ cf \times 2 + 0.25\ cf \times 4 + 2.25\ cf \times 1 + 42.25\ cf \times 1$$
$$= 86\ cf$$

2.3.3 Conclusion

The total power found for the second conventional configuration is power required for the transition of the source voltages of 12 source bus lines, and the total power found for the present embodiment is power required for the transition of the source voltages of 8 source bus lines. Hence, in order to compare them, the total power found above is converted to power required for the transition of the source voltages of 24 source bus lines. As a result, the power in the second conventional configuration is 358 cf, and the power in the configuration according to the present embodiment is 262 cf. As can be grasped from the following expression, according to the present embodiment, the power is reduced by about 27% compared with the case of adopting the conventional charge sharing system.

(358−262)/358=about 27

As such, according to the present embodiment, power consumption is reduced over the conventional case.

2.4 Effect

According to the present embodiment, in a liquid crystal display device having pixels each composed of three subpixels, and adopting the 2S-reversal system (a system in which the polarity is spatially reversed every two source bus lines) as a polarity reversal system, when, for example, single primary color display is performed, the overall amount of transition of source voltages by charge sharing increases over the conventional case. As such, as in the first embodiment, a video signal line drive circuit using a charge sharing system that can achieve lower power consumption than the conventional case is implemented.

3. Others

The present invention is not limited to the above-described embodiments (including the variants), and various modifications may be made without departing from the spirit and scope of the present invention. For example, although an active matrix-type liquid crystal display device is described as an example in the above-described embodiments, the present invention is not limited thereto. The present invention can be applied as long as a display device is of an alternating-current driven-type.

In addition, although the charge sharing control circuit 326 that generates a charge sharing control signal CHA is provided inside the source driver 300 in the above-described embodiments, the present invention is not limited thereto. For example, a charge sharing control signal CHA may be generated in the timing control circuit 100.

Furthermore, although one pixel is composed of three subpixels (a red subpixel, a green subpixel, and a blue subpixel) in the above-described embodiments, the present invention is not limited thereto. For example, one pixel may be composed of four subpixels (a red subpixel, a green subpixel, a blue subpixel, and a white subpixel) arranged side by side in a direction in which the gate bus lines extend. As such, the configuration of subpixels included in one pixel is not particularly limited.

This application claims priority to Japanese Patent Application No. 2016-109822, entitled "Video Signal Line Drive Circuit, Display Device Including Same, And Drive Method For Video Signal Line", filed Jun. 1, 2016, the content of which is incorporated herein by reference.

61 and 65: SWITCHING SWITCH
62: BUFFER UNIT
63*p*: AMPLIFIER FOR POSITIVE POLARITY
63*m*: AMPLIFIER FOR NEGATIVE POLARITY
66 and 67: SHORT-CIRCUIT CONTROL SWITCH
68: OUTPUT CONTROL UNIT
100: TIMING CONTROL CIRCUIT
200: GATE DRIVER
300: SOURCE DRIVER
325: OUTPUT CIRCUIT
326: CHARGE SHARING CONTROL CIRCUIT
327: CHARGE SHARING CIRCUIT
400: COMMON DRIVER
500: DISPLAY UNIT
CHA: CHARGE SHARING CONTROL SIGNAL
POL: POLARITY CONTROL SIGNAL
S and S1 to Sn: SOURCE BUS LINE

The invention claimed is:

1. A video signal line drive circuit that drives a plurality of video signal lines, the video signal line drive circuit comprising:

a charging voltage output unit configured to apply charging voltages including a positive-polarity voltage and a negative-polarity voltage, to the plurality of video signal lines in each frame; and a short-circuiting circuit configured to short-circuit two video signal lines forming each set upon switching frames, with the two video signal lines to which charging voltage of different polarities are applied in each frame being treated as one set, wherein the short-circuiting circuit short-circuits the video signal lines such that a sum of numbers assigned to the two video signal lines forming each set in each group is equal for all sets when it is assumed that K video signal lines form one group and numbers from 1 to K are assigned to the K video signal lines, K being an even number greater than or equal to 4.

2. The video signal line drive circuit according to claim 1, wherein the K video signal lines are K consecutive video signal lines.

3. The video signal line drive circuit according to claim 2, wherein the charging voltage output unit applies a charging voltage of a reversed polarity every video signal line.

4. The video signal line drive circuit according to claim 1, wherein the K video signal lines are K alternate video signal lines.

5. The video signal line drive circuit according to claim 4, wherein the charging voltage output unit applies charging voltages of reversed polarities every two video signal lines.

6. The video signal line drive circuit according to claim 1, wherein the K video signal lines are four video signal lines.

7. The video signal line drive circuit according to claim 6, wherein when attention is focused on eight consecutive video signal lines, odd-numbered video signal lines form one group, and even-numbered video signal lines form another group.

8. The video signal line drive circuit according to claim 1, wherein the short-circuiting circuit sets longer time during which two video signal lines are short-circuited, for a larger difference between numbers assigned to two video signal lines forming each set.

9. The video signal line drive circuit according to claim 1, wherein a capacitance is provided on at least a wiring line for short-circuiting two video signal lines that form a set having a smallest difference between numbers assigned to two video signal lines in each group.

10. A display device comprising:

a video signal line drive circuit according to claim 1; and a display unit including a plurality of video signal lines; a plurality of scanning signal lines intersecting the plurality of video signal lines; and a plurality of pixel formation portions arranged in a matrix form at respective intersections of the plurality of video signal lines and the plurality of scanning signal lines.

11. The display device according to claim 10, wherein the plurality of pixel formation portions include a red pixel formation portion that forms a pixel for displaying red; a green pixel formation portion that forms a pixel for displaying green; and a blue pixel formation portion that forms a pixel for displaying blue, and the red pixel formation portion, the green pixel formation portion, and the blue pixel formation portion are arranged side by side in a direction in which the plurality of scanning signal lines extend.

12. The display device according to claim 11, wherein

K video signal lines are four consecutive video signal lines, and the charging voltage output unit applies a charging voltage of a reversed polarity every video signal line.

13. The display device according to claim 11, wherein

K video signal lines are four alternate video signal lines, when attention is focused on eight consecutive video signal lines, odd-numbered video signal lines form one group, and even-numbered video signal lines form another group, and the charging voltage output unit applies charging voltages of reversed polarities every two video signal lines.

14. The display device according to claim 10, wherein when attention is focused on any video signal line among the plurality of video signal lines, pixel formation portions that receive supply of a video signal from the focused video signal line are arranged in a staggered manner every scanning signal line or every two scanning signal lines.

15. A method for driving a plurality of video signal lines, the method comprising:

a charging voltage outputting step of applying charging voltages including a positive-polarity voltage and a negative-polarity voltage, to the plurality of video signal lines in each frame; and a short-circuiting step of short-circuiting two video signal lines forming each set upon switching frames, with the two video signal lines to which charging voltages of different polarities are applied each frame being treated as one set, wherein in the short-circuiting step, the video signal lines are short-circuited such that a sum of numbers assigned to the two video signal lines forming each set in each group is equal for all sets when it is assumed that K video signal lines form one group and numbers from 1 to K are assigned to the K video signal lines, K being an even number greater than or equal to 4.

* * * * *